US006749979B2

(12) United States Patent
Takeuchi et al.

(10) Patent No.: US 6,749,979 B2
(45) Date of Patent: Jun. 15, 2004

(54) ELECTROPHOTOGRAPHY PHOTOSENSITIVE BODY AND A ELECTROPHOTOGRAPHY DEVICE EQUIPPED WITH THE SAME

(76) Inventors: Masaru Takeuchi, c/o Fuji Electric Imaging Device Co., Ltd. 4-18-1, Tsukama, Matsumoto, Nagano, 390-0821 (JP); Kenichi Ohkura, c/o Fuji Electric Imaging Device Co., Ltd. 4-18-1, Tsukama, Matsumoto, Nagano, 390-0821 (JP)

( * ) Notice: Subject to any disclaimer, the term of this patent is extended or adjusted under 35 U.S.C. 154(b) by 0 days.

(21) Appl. No.: 09/861,871

(22) Filed: May 21, 2001

(65) Prior Publication Data

US 2002/0025484 A1 Feb. 28, 2002

(30) Foreign Application Priority Data

May 23, 2000 (JP) ..... 2000-151230

(51) Int. Cl.[7] ..... G03G 5/04

(52) U.S. Cl. ..... 430/78; 430/70; 430/72; 430/73; 430/76; 430/83; 430/56

(58) Field of Search ..... 430/78, 83, 76, 430/73, 72, 70

(56) References Cited

U.S. PATENT DOCUMENTS 5,298,353 A * 3/1994 Ohmori ..... 430/78
5,523,189 A * 6/1996 Molaire ..... 430/58
5,780,194 A * 7/1998 Katsukawa et al. ..... 430/83
5,972,551 A * 10/1999 Miyauchi et al. ..... 430/78
6,150,064 A * 11/2000 Egota et al. ..... 430/78
6,200,717 B1 * 3/2001 Takeuchi et al. ..... 430/83

FOREIGN PATENT DOCUMENTS

JP 7-084389 3/1995
JP 9-281734 10/1997

* cited by examiner

*Primary Examiner*—Christopher Rodee
(74) *Attorney, Agent, or Firm*—Darby & Darby

(57) ABSTRACT

An electrophotography photosensitive body has a single layer photosensitive layer on top of a conductive substrate, directly or via an undercoat layer. The single layer photosensitive layer contains at least a resin binder, a charge generating substance, and a charge transport substance, wherein at least one of the charge generating substances is a titanyl phthalocyanine, which, in a x-ray powder diffraction spectrum having a radiation source of CuK $\alpha$ and within a range of a Bragg angle $2\theta=5\sim35°$, a ratio, R, of a value, P, of a diffraction intensity of a highest peak and a value, B, of a diffraction intensity of the background satisfies the equation $R=(P-B)/B\leqq7.0$. The resulting electrophotographic photosensitive layer shows excellent electrical properties with positive charging as well as excellent stability when repeatedly used.

17 Claims, 6 Drawing Sheets

ELECTROPHOTOGRAPHY PHOTOSENSITIVE BODY AND A ELECTROPHOTOGRAPHY DEVICE EQUIPPED WITH THE SAME

BACKGROUND TO THE INVENTION

The present invention relates to a photosensitive body for electrophotography (henceforth may also be referred to as simply "photosensitive body") and to an electrophotography device equipped with this electrophotography photosensitive body.

In recent years, in the field of electrophotography photosensitive bodies, many of what are called organic electrophotography photosensitive bodies, which use organic photoconductive materials, have been proposed and implemented. These are non-polluting and have low cost, and because there is a large degree of freedom in the choice of materials, they can be designed to have varied photosensitive body properties.

The photosensitive layer of an organic electrophotography photosensitive body comprises mainly a layer in which organic photoconductive materials are dispersed in a resin. Many laminated constructions and single layer constructions have been proposed. In a laminated construction, a layer in which a charge generating substance is dispersed in a resin and a layer in which a charge transport substance is dispersed in a resin are layered. A single-layer construction comprises a single layer in which a charge generating substance and a charge transport substance are dispersed in a resin.

Among these, a photosensitive body using a function-separated model for the construction of the photosensitive layer has been widely implemented because of its excellent photosensitive body properties and durability. A function-separated model has a charge transport layer laminated on top of a charge generating layer. In this function-separated laminated photosensitive body, a hole transport material is mainly used for the charge transport layer. As a result, they are generally used with a negative charging process. Negative corona charging used in the negative charging process is unstable compared to positive corona charging, and the amount of generated ozone is also large. As a result, there are problems of having a negative impact on the photosensitive body and a negative impact on the usage environment.

For solving these problems, an organic electrophotography photosensitive body that can use a positive charging is effective. As a result, currently there is a demand for a positive charge photosensitive body with high sensitivity. For this positive charge photosensitive body, there have been many proposals for a function-separated photosensitive body or a single-layer photosensitive body. The function-separated photosensitive body has a photosensitive layer in which a charge generating layer is layered on top of a hole transport layer or a photosensitive layer in which an electron transport layer is layered on top of a charge generating layer. A single layer photosensitive body has a photosensitive layer containing a charge generating substance and a charge transporting substance in a single layer.

In recent years, in Japanese Laid Open Patent Publication Number 1-206349, Japanese Laid Open Patent Publication number 4-360148, Denshishashin Gakkaishi (Electrophotography Society Journal) Vol. 30, p. 266~273 (1991), Japanese Laid-Open Patent Publication Number 3-290666, Japanese Laid Open Patent Publication Number 5-92936, Pan-Pacific Imaging Conference/Japan Hardcopy '98 Jul. 15-17, 1998 J A HALL, Tokyo, Japan, preliminary draft collection p. 207-210, Japanese Laid-Open Patent Publication Number 9-151157, Japan Hardcopy '97 Collection of papers Jul. 9, 10, 11, 1997 J A Hall (Tokyo-Ohtemachi) p.21–24, Japanese Laid Open Patent Publication Number 5-279582, Japanese Laid Open Patent Publication Number 7-179775, Japan Hardcopy '92 collection of papers Jul. 6, 7, 8, 1992 J A Hall (Tokyo-Ohtemachi) p. 173–176, Japanese Laid Open Patent Publication Number 10-73937, and the like, many electron transport substances and electrophotography photosensitive bodies using these electron transport substances have been proposed and described, and there has been much interest in them. Furthermore, as described in Japanese Laid Open Patent Publication Number 5-150481, Japanese Laid Open Patent Publication Number 6-130688, Japanese Laid-Open patent Publication Number 9-281728, Japanese Laid-Open patent Publication Number 9-281729, Japanese Laid-Open Patent Publication number 10-239874, a photosensitive body using a combination of a hole transport substance and an electron transport substance in a single layer photosensitive layer has been attracting attention as having high sensitivity, and this has been implemented by some. However, with the positive charge photosensitive body, the electrical properties of sensitivity and the like are still deficient compared to the negative charge function-separated photosensitive body.

Furthermore, for the charge generating substance, various studies have been conducted from the prior art. In general, for the charge generating substance, various pigments are used according to the sensitivity range of the photosensitive body. In particular, for photosensitive bodies responding to light of semiconductor laser light or infrared LED light and the like which have wavelengths in the infrared or near-infrared region, phthalocyanine pigments such as metal free phthalocyanine, titanyl phthalocyanine, and the like are widely used. There are various crystal types for these phthalocyanine pigments. It is known that the wavelength region and quantum efficiency of the absorbed light are different depending on the different crystal types, and for the electrophotography photosensitive body using these pigments as a charge generating substance, the different crystal types also affect the sensitivity and electrical properties such as the residual voltage, dark attenuation, as well as the stability of the photosensitive body over repeated use, and the like. Various studies have been conducted on the relationship between the crystal type and the photosensitive body electrical properties.

For example, in Japanese Laid Open Patent Publication Number 61-217050, there is proposed a single layer photosensitive body having a photosensitive layer comprising an alpha titanyl phthalocyanine dispersed in a binding resin. In an X ray diffraction spectrum having CuK alpha as the radiation source, this alpha titanyl phthalocyanine shows strong diffraction peaks at Bragg angles ($2\theta \pm 0.2$ degrees) of 7.5, 12.3, 16.3, 25.3, and 28.7 degrees.

In addition in Japanese Laid Open Patent Publication Number 9-73182, there is proposed an electrophotography photosensitive body that is a single layer photosensitive body containing a charge transport substance and a charge generating substance in a photosensitive layer. The charge generating substance comprises, in an x-ray diffraction spectrum as described above, a mixture of a metal free phthalocyanine showing diffraction peaks at Bragg angles ($2\theta \pm 0.2$ degrees) of 7.5, 9.1, 16.7, 17.4, 22.3, and 28.6 degrees and a titanyl phthalocyanine showing diffraction peaks at Bragg angles ($2\theta \pm 0.2$ degrees) of 9.5, 14.2, 24.0, and 27.2 degrees. The content ratio of the titanyl phthalocyanine to the total weight of the charge generating substance is greater than 50 weight %.

However, even with these numerous single layer electrophotography photosensitive bodies that have been proposed, the electrical properties of sensitivity and the like are not adequate compared to the function-separated photosensitive body of negative charge of the prior art. Photosensitive bodies that can use positive charge and that have good electrical properties have still not been satisfactorily achieved.

OBJECTS AND SUMMARY OF THE INVENTION

It is an object of the present invention to provide an electrophotography photosensitive body which solves the above problems.

It is a further object of the present invention to provide an electrophotography photosensitive body and an electrophotography device equipped with the same, in which for an electrophotography photosensitive body having a single layer photosensitive layer, the electrical properties with positive charging are excellent and there is excellent stability over repeated use.

As a result of intensive study in order to solve the above object, the present inventors have discovered the following. With an electrophotography photosensitive body having a single layer photosensitive layer containing at least a resin binder, a charge generating substance and a charge transport substance, by using as a charge generating substance a titanyl phthalocyanine with a crystallinity equal to or less than a constant value, the electrical properties with positive charging, such as the sensitivity, the residual electric potential, and dark attenuation, were improved, and the present invention was completed.

In other words, the present invention is an electrophotography photosensitive body, having a single layer photosensitive layer on top of a conductive substrate directly or via an undercoat layer, and the single layer photosensitive layer containing at least a resin binder, a charge generating substance, and a charge transport substance, wherein: at least one of the charge generating substances is a titanyl phthalocyanine; with the titanyl phthalocyanine, in a x-ray powder diffraction spectrum having a radiation source of CuK alpha and within a range of a Bragg angle 2θ±5~35 degrees, a ratio R (henceforth referred to as "crystallinity") of a value P of a diffraction intensity of a highest peak and a value B of a background diffraction intensity satisfies a following equation $$R=(P-B)/B<=7.0,$$

and preferably satisfies a following equation $$R=(P-B)/B<=3.0$$

wherein P is a value of a diffraction intensity of a highest peak. At a same Bragg angle as the highest peak, B is a value of a diffraction intensity of a line that connects the troughs on either side of the highest peak.

In the present invention, the charge transport substance can be a hole transport substance. In addition, it can also include both a hole transport substance and an electron transport substance.

In addition, at least one type of the hole transport substance is preferably a compound having a construction represented by one of the following general formulas (HT1)~(HT4).

(HT1)

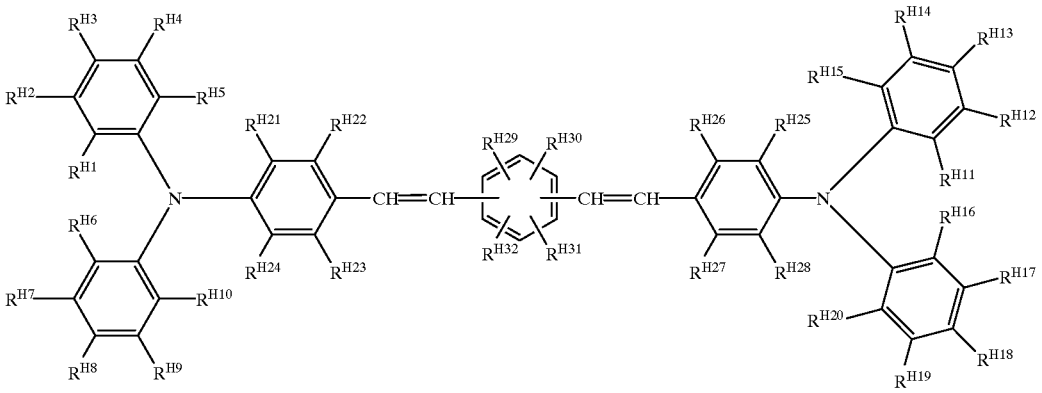

In formula (HT1), $R^{H1}$~$R^{H32}$ are each independently a hydrogen atom, a $C_1$–$C_6$ alkyl group, or a $C_1$–$C_6$ alkoxy group with a carbon number of 1~6.

(HT2)

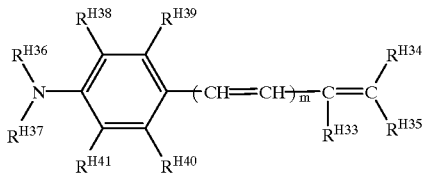

In formula (HT2), $R^{H33}$ represents a hydrogen atom or a $C_1$–$C_6$ alkyl group. $R^{H34}$ and $R^{H35}$ each independently represent a hydrogen atom, a $C_1$–$C_6$ alkyl group, a $C_1$–$C_6$ alkoxy group, or an optionally substituted aryl group, and they can form a ring by directly bonding or bonding via an oxygen atom, sulfur atom, or a carbon chain. $R^{H36}$ and $R^{H37}$ each independently represent a $C_1$–$C_6$ alkyl group, an optionally substituted $C_3$–$C_{12}$ cycloalkyl group, an optionally substituted aryl group, or an optionally substituted aralkyl group. $R^{H38}$~$R^{H41}$ each independently represent a hydrogen atom, a $C_1$–$C_6$ alkyl group, a $C_1$–$C_6$ alkoxy group, or an optionally substituted aryl group. Of $R^{H36}$~$R^{H41}$, two or more of the groups can be bonded directly or via an oxygen atom, sulfur atom, or carbon chain to form a ring. m represents 0 or 1. The substitution group represents a halogen atom, a $C_1$–$C_6$ alkyl group, a $C_1$–$C_6$ alkoxy group, an optionally substituted aryl group, an optionally substituted aryl alkoxy group, a hydroxyl group, a cyano group, an amino group, a nitro group, a halogenated alkyl group, an alkyl substituted amino group, or an aryl substituted amino group. Of the substitution groups, two or more of the groups can be bonded directly or bonded via an oxygen atom, sulfur atom, or carbon chain to form a ring.

(HT3)

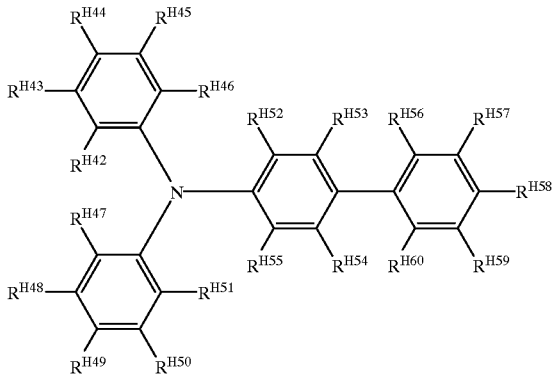

In formula (HT3), $R^{H42}$~$R^{H60}$ each independently represent a hydrogen atom, a halogen atom, a $C_1$–$C_{12}$ alkyl group, a $C_1$–$C_{12}$ alkoxy group, an alkyl substituted amino group, or an optionally substituted aryl group. Of these, two or more groups can be bonded directly or via an oxygen atom, sulfur atom, or a carbon chain to form a ring. The substitution group represents a halogen atom, a $C_1$–$C_6$ alkyl group, a $C_1$–$C_6$ alkoxy group, a hydroxyl group, a cyano group, an amino group, a nitro group, or a halogenated alkyl group. Of the substitution groups, two or more of the groups can be bonded directly or via an oxygen atom, a sulfur atom, or a carbon chain to form a ring.

(HT4)

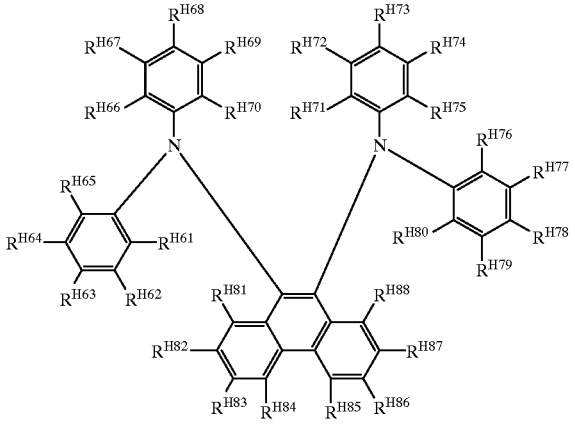

In formula (HT4), $R^{H61}$~$R^{H88}$ each independently represent hydrogen atom, a halogen atom, a $C_1$–$C_{12}$ alkyl group, a $C_1$–$C_{12}$ alkoxy group, or an optionally substituted aryl group. The substitution group represents a halogen atom, a $C_1$–$C_6$ alkyl group, a $C_1$–$C_6$ alkoxy group, or an aryl group.

Furthermore, at least one type of the electron transport substance is preferably a compound having a construction represented by one of the following general formulas (ET1)~(ET4).

(ET1)

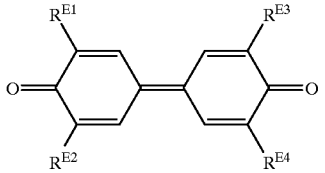

In formula (ET1), $R^{E1}$~$R^{E4}$ each independently represent a hydrogen atom, a $C_1$–$C_{12}$ alkyl group, a $C_1$–$C_{12}$ alkoxy group, an optionally substituted aryl group, a cycloalkyl group, an optionally substituted aralkyl group, or a halogenated alkyl group. The substitution group represents a halogen atom, a $C_1$–$C_6$ alkyl group, a $C_1$–$C_6$ alkoxy group, a hydroxyl group, a cyano group, an amino group, a nitro group, or a halogenated alkyl group.

(ET2)

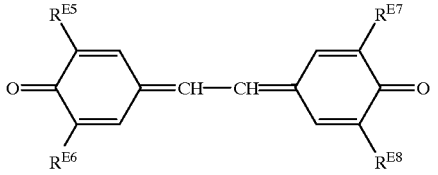

In formula (ET2), $R^{E51}$~$R^{E8}$ each independently represent a hydrogen atom, a $C_1$–$C_{12}$ alkyl group, a $C_1$–$C_{12}$ alkoxy group, an optionally substituted aryl group, a cycloalkyl group, an optionally substituted aralkyl group, or a halogenated alkyl group. The substitution group represents a halogen atom, a $C_1$–$C_6$ alkyl group, a $C_1$–$C_6$ alkoxy group, a hydroxyl group, a cyano group, an amino group, a nitro group, or a halogenated alkyl group.

(ET3)

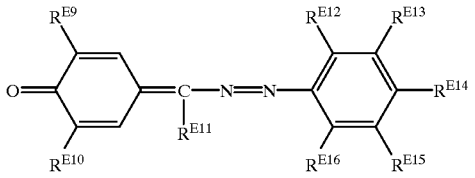

In formula (ET3), $R^{E9}$ and $R^{E10}$ each independently represent a hydrogen atom, a $C_1$–$C_{12}$ alkyl group, a $C_1$–$C_{12}$ alkoxy group, an optionally substituted aryl group, a cycloalkyl group, an optionally substituted aralkyl group, or a halogenated alkyl group. $R^{E11}$ represents a hydrogen atom, a $C_1$–$C_6$ alkyl group, a $C_1$–$C_6$ alkoxy group, an optionally substituted aryl group, a cycloalkyl group, an optionally substituted aralkyl group, or a halogenated alkyl group. $R^{E12}$~$R^{E16}$ each independently represent a hydrogen atom, a halogen atom, a $C_1$–$C_{12}$ alkyl group, a $C_1$–$C_{12}$ alkoxy group, an optionally substituted aryl group, an optionally substituted aralkyl group, an optionally substituted phenoxy group, a halogenated alkyl group, a cyano group, or a nitro group. Of these, two or more of the groups can be bonded to form a ring. The substitution group represents a halogen atom, a $C_1$–$C_6$ alkyl group, a $C_1$–$C_{12}$ alkoxy group, a hydroxyl group, a cyano group, an amino group, a nitro group, or a halogenated alkyl group.

(ET4)

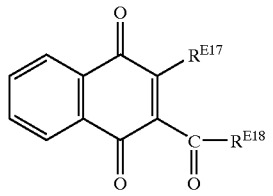

In formula (ET4), $R^{E17}$ represents an optionally substituted alkyl group or an optionally substituted aryl group. $R^{E18}$ represents an optionally substituted alkyl group, an optionally substituted aryl group, or a group represented by a following formula (ET4a), $$—O—R^{E19} \quad \text{(ET4a)}$$

wherein, $R^{E19}$ represents an optionally substituted alkyl group or an optionally substituted aryl group. The substitution group represents a halogen atom, a $C_1$–$C_6$ alkyl group, a $C_1$–$C_6$ alkoxy group, an aryl group, a hydroxyl group, a cyano group, an amino group, a nitro group, or a halogenated alkyl group.

Furthermore, at least one type of the resin binder is a polycarbonate having a construction unit represented by a following general formula (BD1) as a main repeating unit, (BD1)

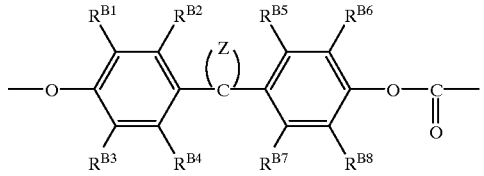

wherein $R^{B1}$~$R^{B8}$ each independently represent a hydrogen atom, a $C_1$–$C_6$ alkyl group, an optionally substituted aryl group, a cycloalkyl group or a halogen atom. Z represents an atomic group that is necessary to form an optionally substituted carbon ring. The substitution group represents a $C_1$–$C_6$ alkyl group, an aryl group, or a halogen atom.

In addition, the electrophotography device of the present invention is equipped with an electrophotography photosensitive body of the present invention as described above. In addition, the charging process is conducted by a positive charging process.

The above, and other objects, features, and advantages of the present invention will become apparent from the following description read in conjunction with the accompanying drawings, in which like reference numerals designate the same elements.

DESCRIPTION OF THE INVENTION

Figure 1:
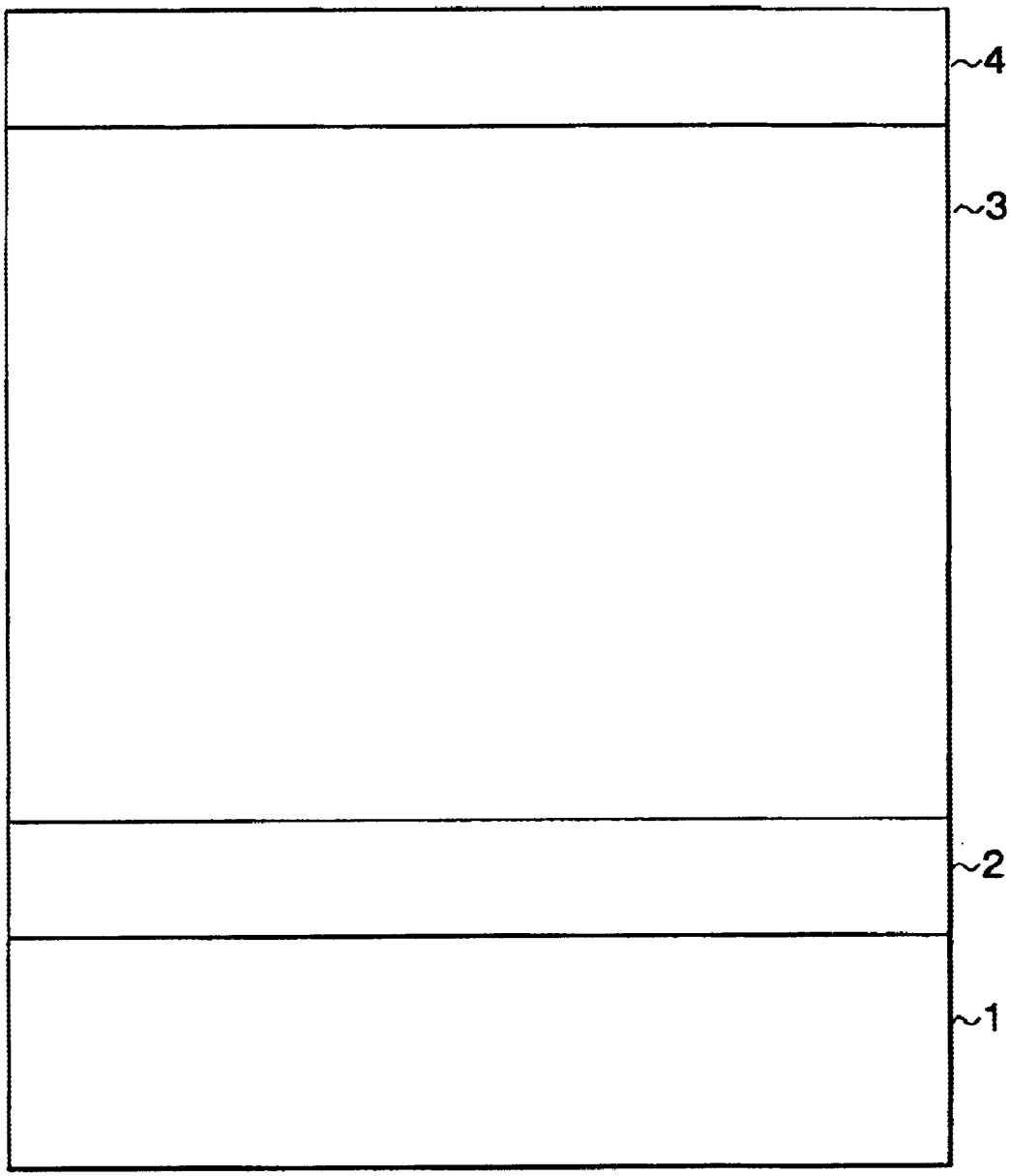
FIG. 1 is a model cross-sectional drawing showing one construction example of an electrophotography photosensitive body of the present invention.

Referring to the drawings, the embodiments of the electrophotography photosensitive body of the present invention are described.

As described above, the electrophotography photosensitive body of the present invention is a single layer photosensitive body and has on top of a conductive substrate a photosensitive layer containing at least a resin binder and a charge generating substance and a charge transport substance. For at least one of the charge generating substances, a titanyl phthalocyanine having a specified crystallinity is used.

The crystallinity of the titanyl phthalocyanine as the charge generating substance in the present invention is defined by a ratio R (=(P−B)/B). Within the range of Bragg angle 2θ=5~35° in a X ray powder diffraction spectrum having a radiation source of CuK α (wavelength 1.541 Å), value P is the diffraction intensity of the highest peak, and value B is the diffraction intensity of the background. When the present inventors studied the relationship of crystallinity R of this charge generating substance with the electrical properties of the photosensitive body, it was discovered that the sensitivity of the photosensitive body was greatly improved when crystallinity R was 7.0 or less, and this resulted in the present invention.

In other words, with the present invention, it is important that this ratio R satisfies the following equation, $$R=(P-B)/B<=7.0$$

Preferably, it satisfies the following equation, $$R=(P-B)/B<=3.0$$

In the present invention, the detailed mechanism for why the electrical properties of sensitivity and the like with positive charging is improved by using a charge generating substance whose crystallinity satisfies the above relationship is not known. However, it is thought to be because the titanyl phthalocyanine of the present invention shows a high absorbance with respect to semiconductor laser light and infrared LED light having wavelengths in the infrared to the near-infrared region, and it also shows high quantum yield.

In a X ray diffraction spectrum obtained by a X-ray powder diffraction method, crystallinity R of the titanyl phthalocyanine of the present invention is obtained from the following. Value P is the diffraction intensity of the peak that is the highest of the plurality of diffraction peaks within the range of Bragg angle 2θ=5~35° (the diffraction intensity of the highest peak). Value B is the diffraction intensity of the point where a line, which connects the two troughs between the highest peak and the peaks positioned on either side of it, crosses a perpendicular line, which is drawn from the peak position of the highest peak to the horizontal axis (the diffraction intensity of a line, that connects the troughs on either side of the highest peak, at the same Bragg angle as the highest peak).

The X ray powder diffraction method for the measurement of crystallinity uses, for example, a X-ray diffraction device MPX-18 manufactured by MAC Science Corporation as the X-ray diffraction device. Measurement can be ideally conducted under the following conditions.

| | |
|---|---|
| X ray generating device: | 18 kW |
| Radiation source: | CuK α ray (1.54056 Å) |
| Tube voltage: | 40 kV |
| Tube current: | 50 mA |
| Sampling width: | 0.02° |
| Scanning velocity: | 4°/minute |
| Divergence slit: | 0.5° |
| Scattering slit: | 0.5° |
| Light receiving slit: | 0.30 mm |

Below, concrete constructions and the like of the photosensitive body of the present invention are described in detail, but the present invention only needs to satisfy the above described requirements and is not limited to what is described below.

Layer Construction

Referring to FIG. 1, a conceptual cross-sectional figure showing one embodiment of a photosensitive body of the present invention is shown. There is a conductive substrate 1, an undercoat layer 2, a photosensitive layer 3, and a protective layer 4. Undercoat layer 2 and protective layer 4 are provided as needed. Photosensitive layer 3 of the present invention has a charge generating function and a charge transport function and is a single layer photosensitive layer having both functions in a single layer.

Conductive Substrate

Conductive substrate 1 has the role of an electrode for the photosensitive body, and at the same time, it is also a supporting body for each of the other layers. Conductive substrate 1 can be in the shape of a tube, board, or film. In terms of the material, conductive substrate 1 can be a metal such as aluminum, stainless steel, nickel, and the like, or it can be a material in which conductive treatment is applied on top of glass or resin and the like.

Undercoat Layer

Undercoat layer 2 can be provided as needed for the purposes of preventing injection of unnecessary charge from the conductive substrate to the photosensitive layer, of covering the defects of the substrate surface, of improving the adhesion of the photosensitive layer, and the like. Undercoat layer 2 comprises a layer which has resin as its main component or an oxidation film of alumite and the like.

For the resin binder, polymers and copolymers of polycarbonate resin, polyester resin, polyvinyl acetal resin, polyvinyl butyral resin, polyvinyl alcohol resin, vinyl chloride resin, vinyl acetate resin, polyethylene, polypropylene, polystyrene, acrylic resin, polyurethane resin, epoxy resin, melamine resin, silicon resin, silicone resin, polyamide resin, polystyrene resin, polyacetal resin, polyarylate, polysulfone resin, ester methacrylate can be used. They can be used singly or two or more can be suitably combined and used. Furthermore, the same type of resins with differing molecular weights can be combined and used.

Furthermore, the resin binder can also contain metal oxides such as silicon oxide (silica), titanium oxide, zinc oxide, calcium oxide, aluminum oxide (alumina), zirconium oxide, and the like; metal sulfides such as barium sulfate, calcium sulfate, and the like; metal nitride fine particles, such as silicon nitride, aluminum nitride, and the like; organic metal compounds; silane coupling agents; substances formed from organic metal compounds and silane coupling agents, and the like. Their contents can be set as appropriate within a range where a layer can be formed.

When the undercoat layer has a resin as the main component, for the purposes of having charge transport properties and of reducing the charge trapping and the like, the undercoat layer can contain hole transport substances and electron transport substances. The content of the hole transport substances and electron transport substances is 0.1~60 weight % with respect to the solid part of the undercoat layer and is preferably 5~40 weight %. Furthermore, as needed, within a range where the electrophotography properties are not negatively affected, the undercoat layer can contain other known additives.

The undercoat layer can be used as a single layer, however, two or more layers of differing types can be layered and also used. The film thickness of the undercoat layer depends on the mixing composition of the undercoat layer, but it can be set as appropriate within a range where there is no negative impact such as increased residual electric potential when used repeatedly. Preferably, the film thickness is 0.1~10 μm.

Photosensitive Layer

Photosensitive layer 3 of the present invention is a single layer construction with at least a resin binder, a charge generating substance, and a charge transport substance.

For the charge generating substance of the present invention, at least one titanyl phthalocyanine as described above must be used. However, in addition, other phthalocyanine pigments other than this titanyl phthalocyanine, naphthalocyanine pigments, azo pigments, polycyclic quinone pigments such as anthraquinone and anthanthrone, perylene pigments, perinone pigments, squarilium dyes, azulenium dyes, thiapyrilium dyes, cyanine dyes, quinacridone dyes, and the like can be used. These charge generating substances can be used singly or two or more types can be combined and used within a range that the electrophotography properties are not negatively affected greatly. In particular, the following are preferred: for the azo pigments, a disazo pigment, a trisazo pigment; for the anthanthrone pigments, 3,9-dibromoanthanthrone; for the perylene pigments, N,N'-bis(3,5-dimethyl phenyl)-3,4:9, 10-perylene bis (carboxyimide); for phthalocyanine pigments, metal-free phthalocyanine, copper phthalocyanine, titanyl phthalocyanine. Furthermore, the following are preferred: X type metal-free phthalocyanine (U.S. Pat. No. 3,357,989 and others), tau type metal-free phthalocyanine (Japanese Laid Open Patent Publication Number 58-183757 and others), epsilon type copper phthalocyanine (Japanese Laid Open Patent Number 53-39325, Japanese Laid Open Patent Publication Number 57-149358, and others), cc type titanyl phthalocyanine (Japanese Laid Open Patent Publication Number 61-217050, Japanese Laid Open Patent Publication Number 61-239248, and others), beta-type titanyl phthalocyanine (Japanese Laid Open Patent Publication Number 63-218768, Japanese Laid Open Patent Publication Number 62-67094, and others), amorphous titanyl phthalocyanine (Japanese Laid Open Patent Publication Number 62-275272 and others), Y-type titanyl phthalocyanine (Japanese Laid Open Patent Publication Number 64-17066 and others), I type titanyl phthalocyanine (Japanese Laid Open Patent Publication number 3-128973 and others), and a titanyl phthalocyanine as described in Japanese Laid Open Patent Publication Number 8-209023 having a maximum peak of a Bragg angle 2θ of 9.6° in a CuK α: X ray diffraction spectrum. The content of this charge generating substance is 0.1~20 weight % with respect to the solid part of the photosensitive layer and is preferably 0.5~10 weight %.

In the present invention, as the charge transport substance, a hole transport substance can be used by itself, or both a hole transport substance and an electron transport substance can also be used.

For the hole transport substance, compounds with the structural formula represented in the previous general formulas (HT1)(HT4) are suitable, but in addition hydrazone compounds, pyrazoline compounds, pyrazolone compounds, oxadiazole compounds, oxazole compounds, arylamine compounds, benzidene compounds, stilbene compounds, styryl compounds, polyvinyl carbazole, polysilane, and the like can be used. These hole transport substances can be used singly or two or more types can be combined and used. Concrete examples of compounds of structural formulas represented by the previous general formulas (HT1)~(HT4) include compounds with structural formulas shown in the following formulas (HT1-1)~(HT4-20), for example. Furthermore, concrete examples of other hole transport substances are given as compounds of structural formulas shown in the following formulas (HT-1)~(HT-37). However, the present invention is not limited to these. The content of the hole transport substances is 5~80 weight % with respect to the solid part of the photosensitive layer and is preferably 10~60 weight %.

(HT1-1)

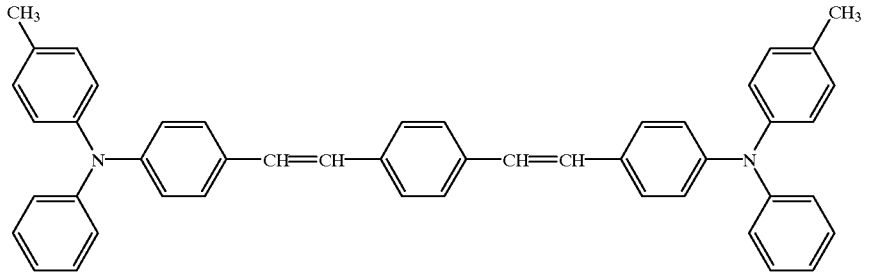

(HT1-2)

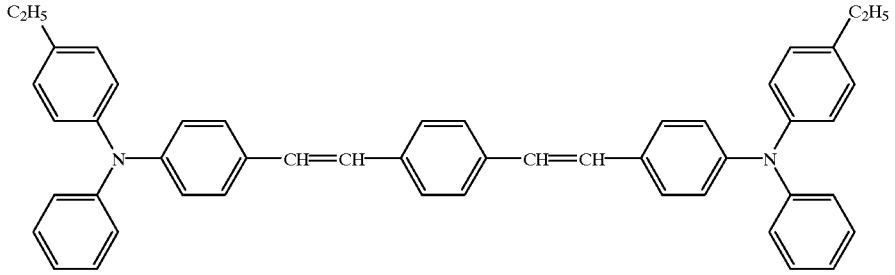

(HT1-3)

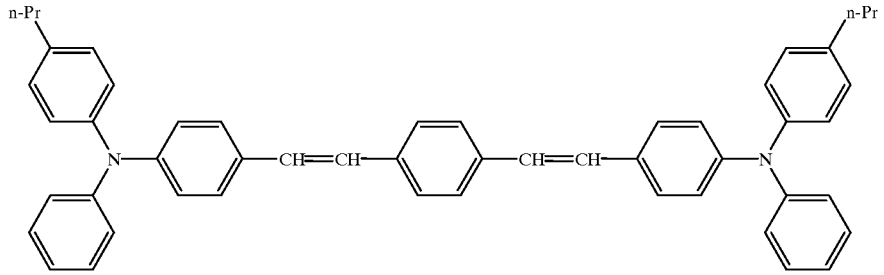

(HT1-4)

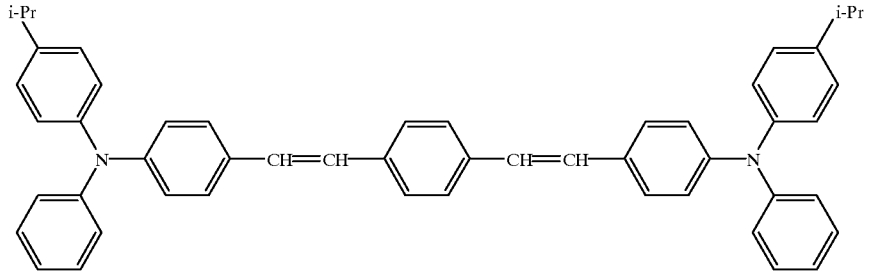

-continued
(HT1-5)
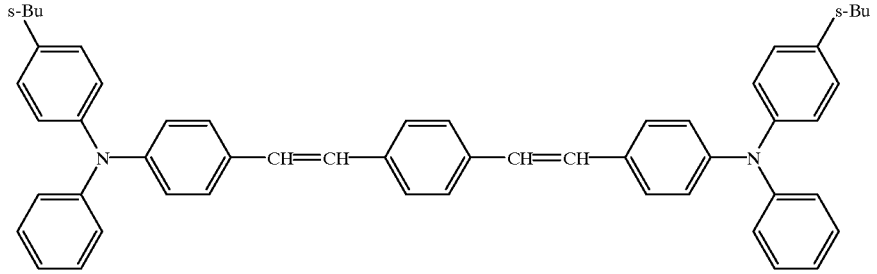
(HT1-6)
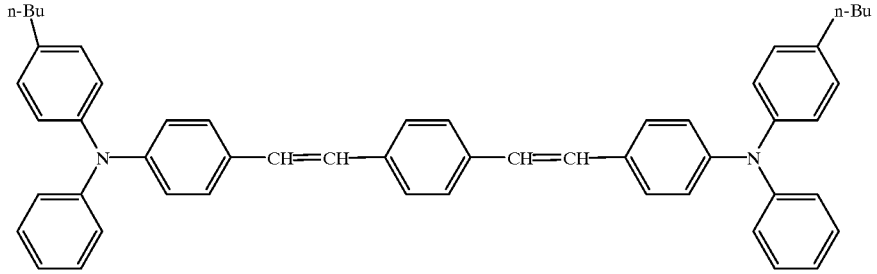
(HT1-7)
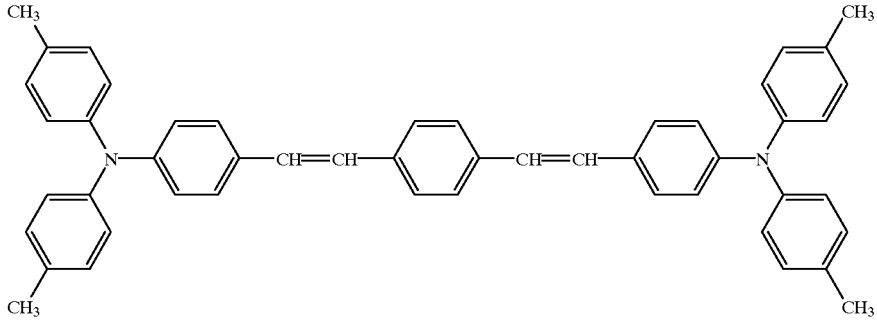
(HT1-8)
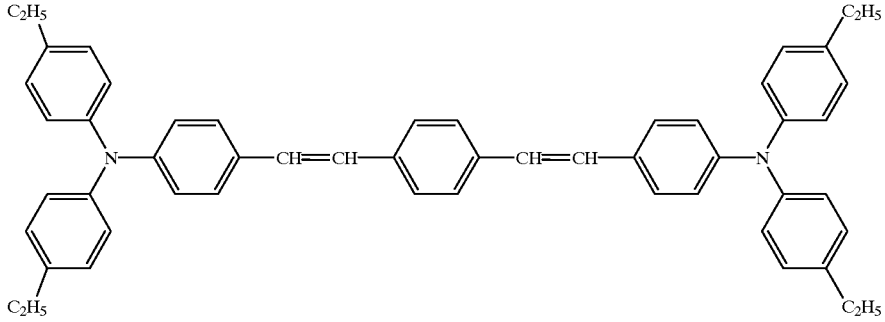
(HT1-9)
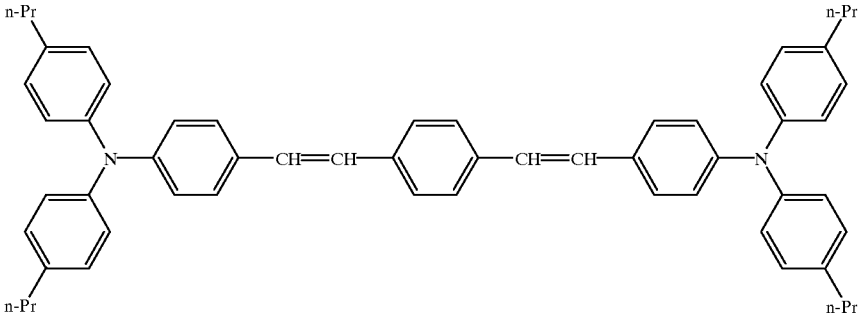

-continued
(HT1-10)
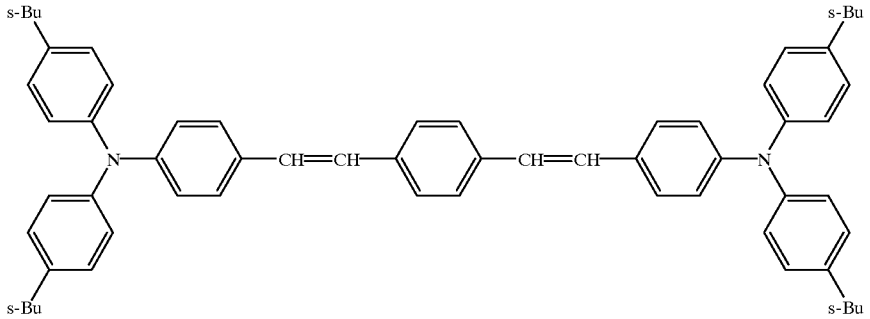
(HT1-11)
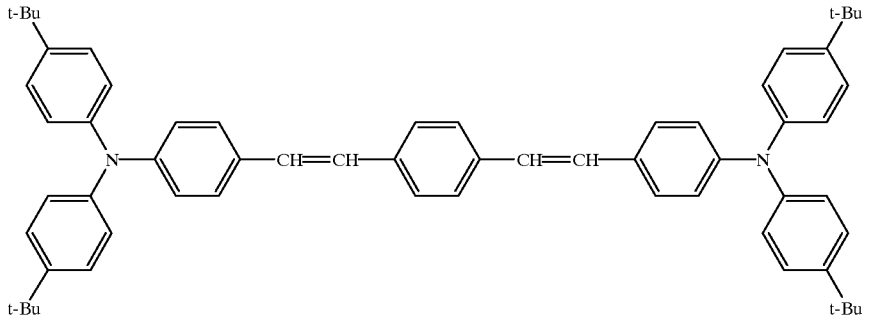
(HT1-12)
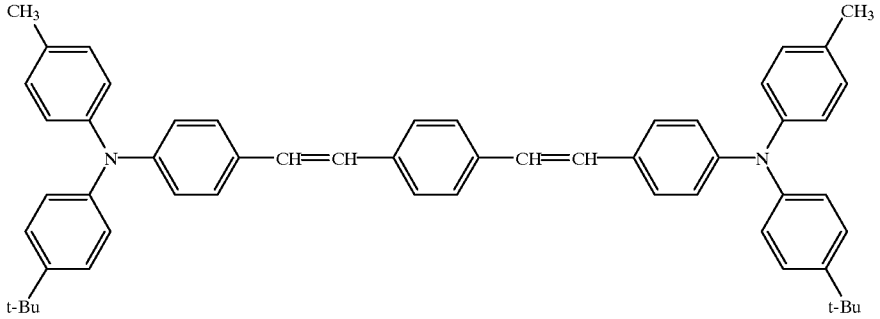
(HT1-13)
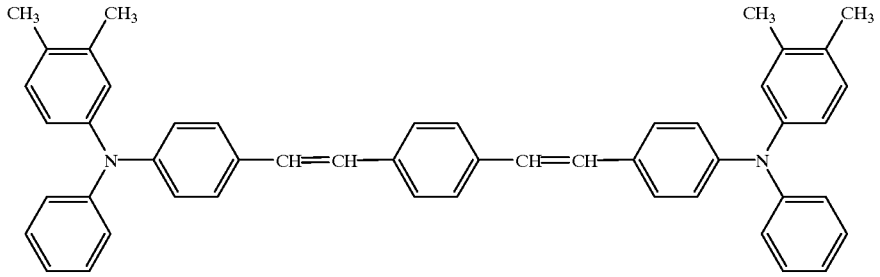
(HT1-14)
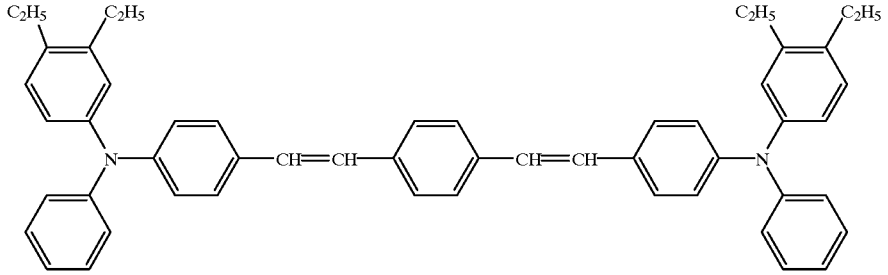

-continued
(HT1-15)
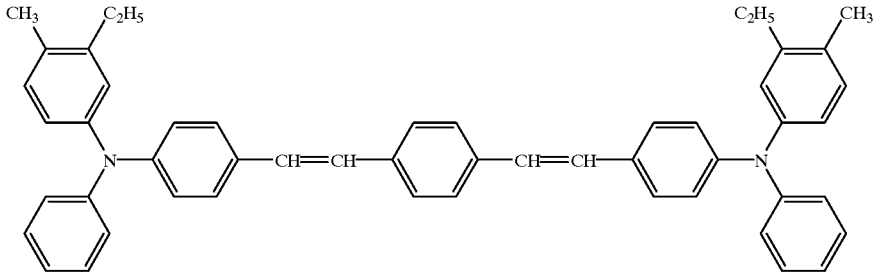
(HT1-16)
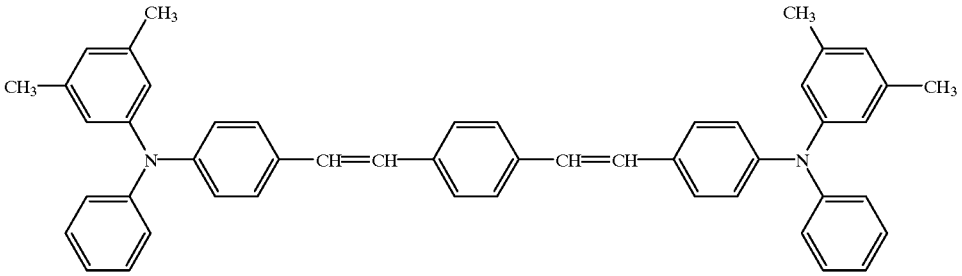
(HT1-17)
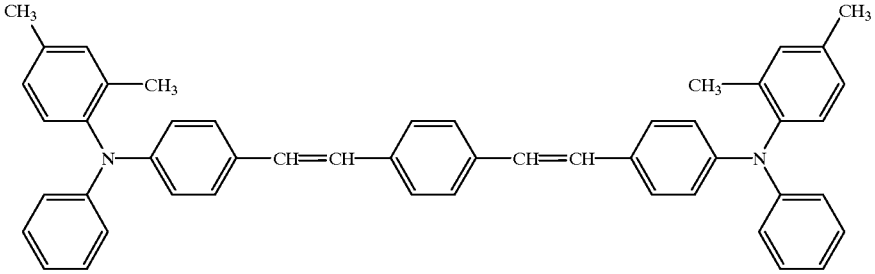
(HT1-18)
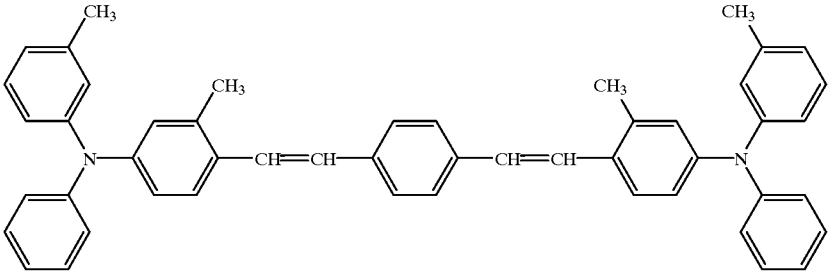
(HT1-19)
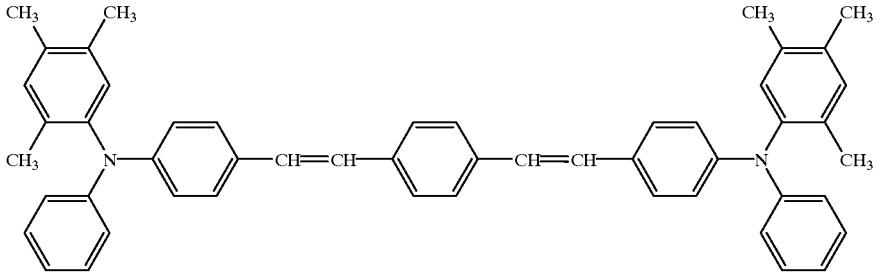

-continued
(HT1-20)
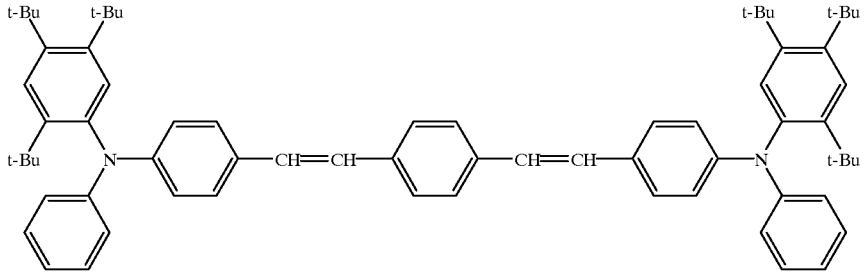
(HT1-21)
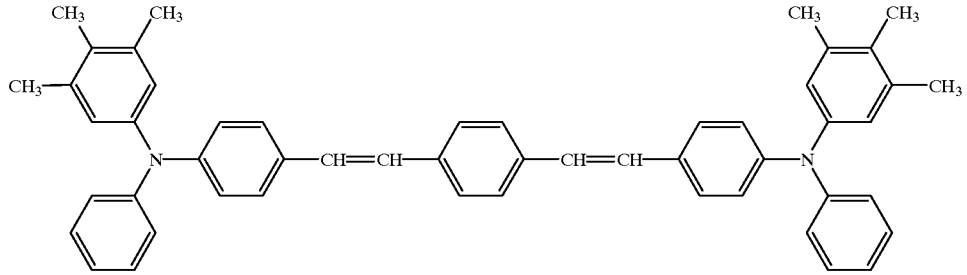
(HT1-22)
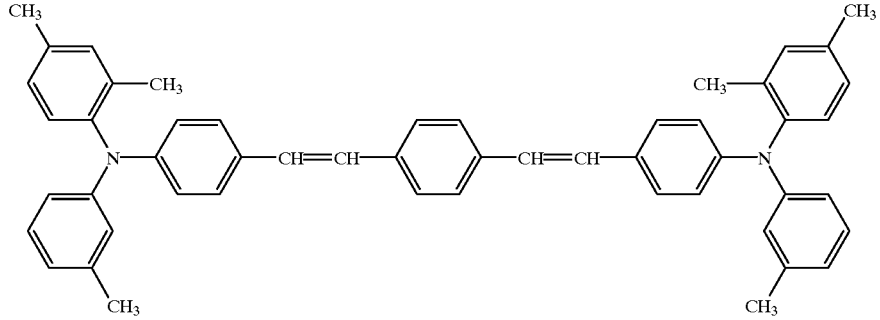
(HT1-23)
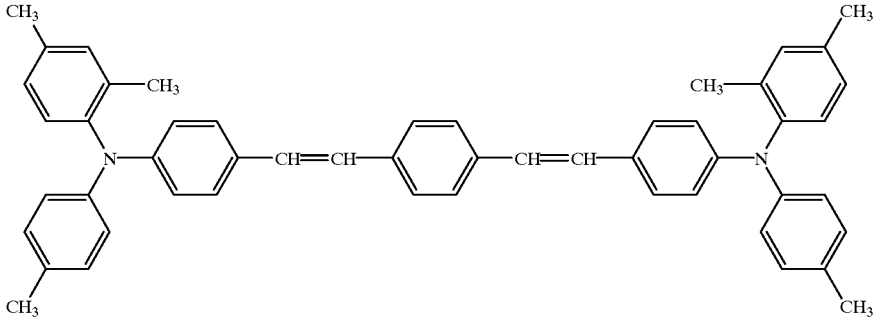
(HT1-24)
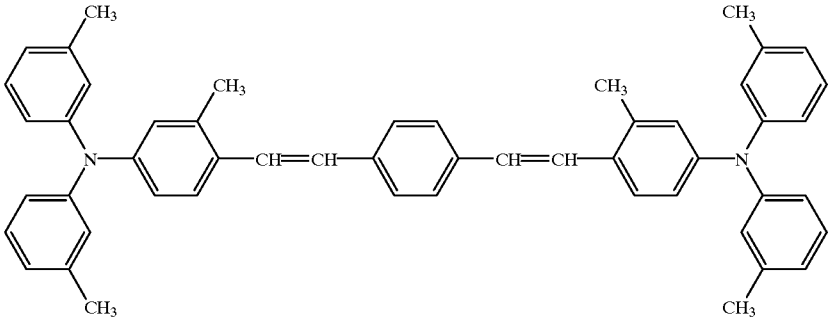

-continued
(HT1-25)
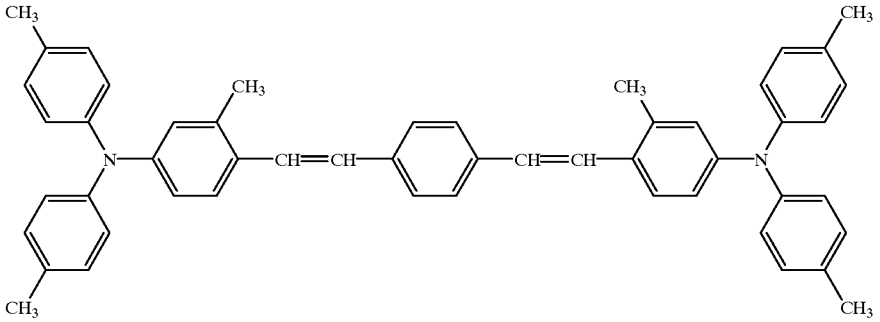
(HT1-26)
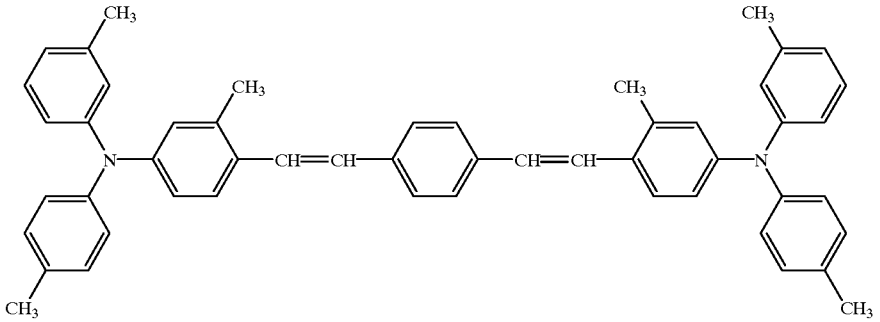
(HT1-27)
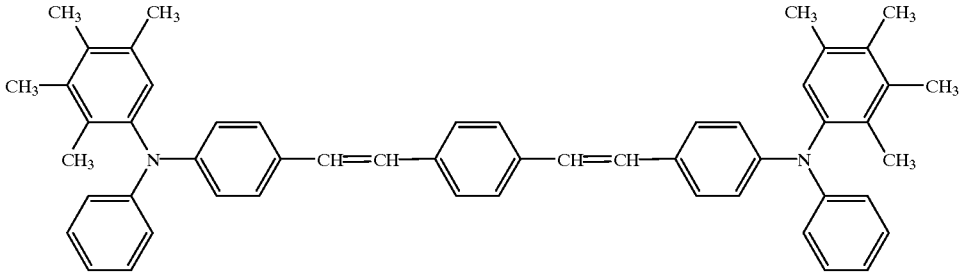
(HT1-28)
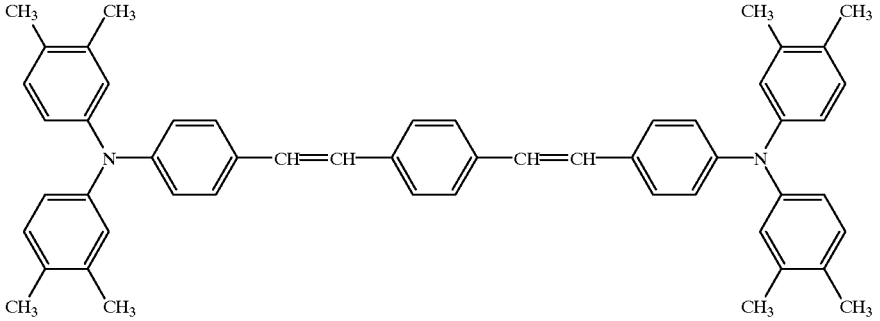
(HT1-29)
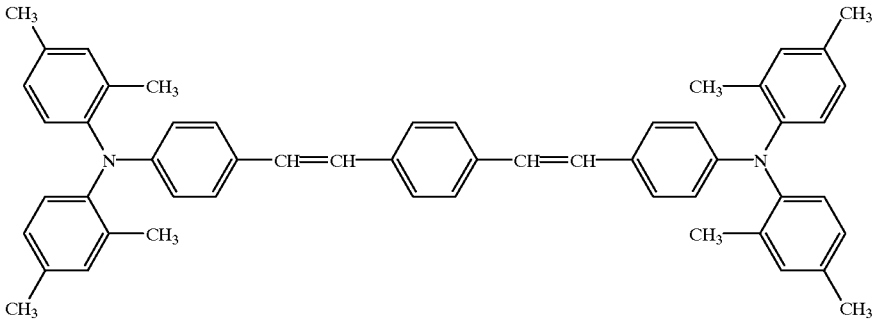

-continued
(HT1-30)
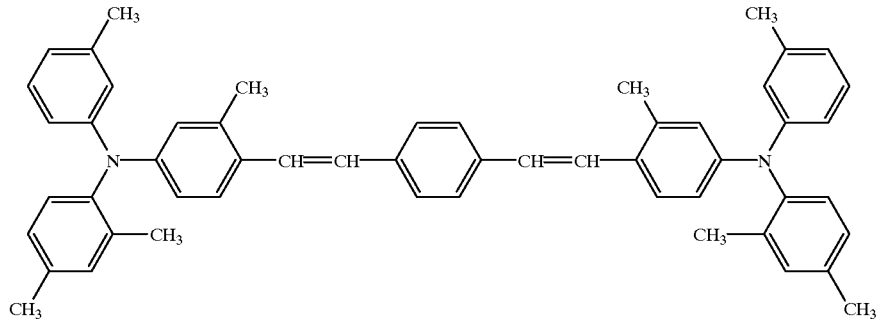
(HT1-31)
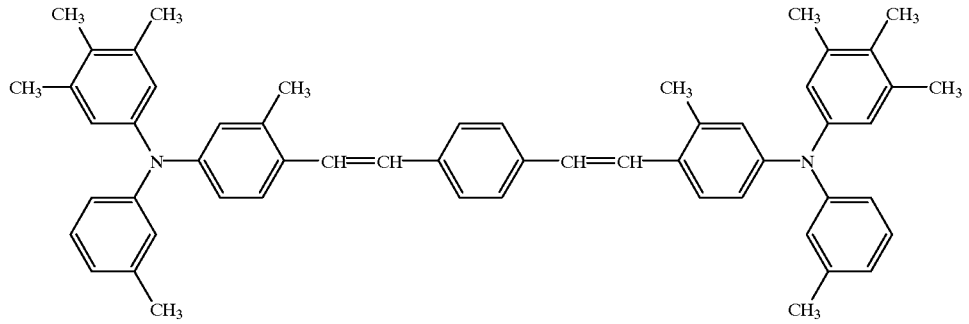
(HT1-32)
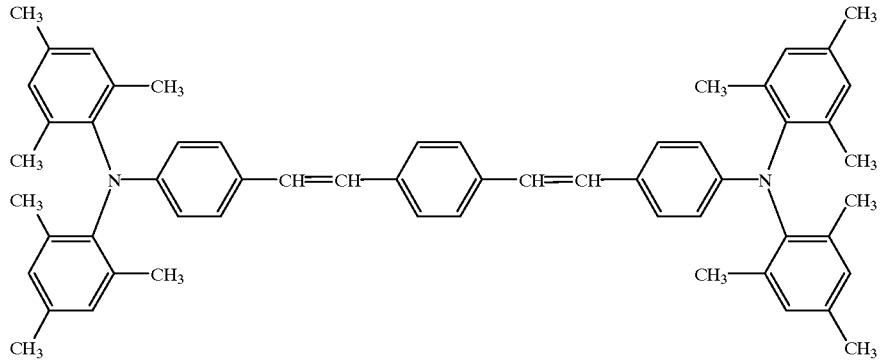
(HT1-33)
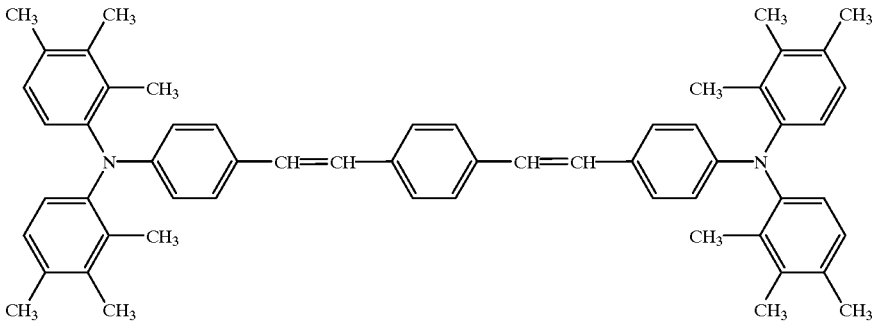

-continued
(HT1-34)
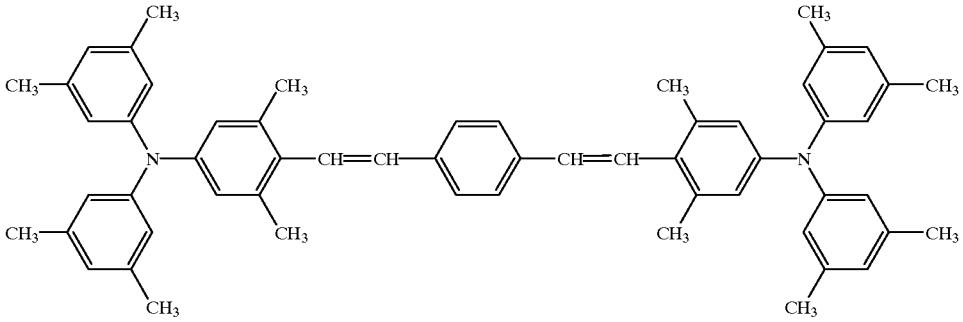
(HT1-35)
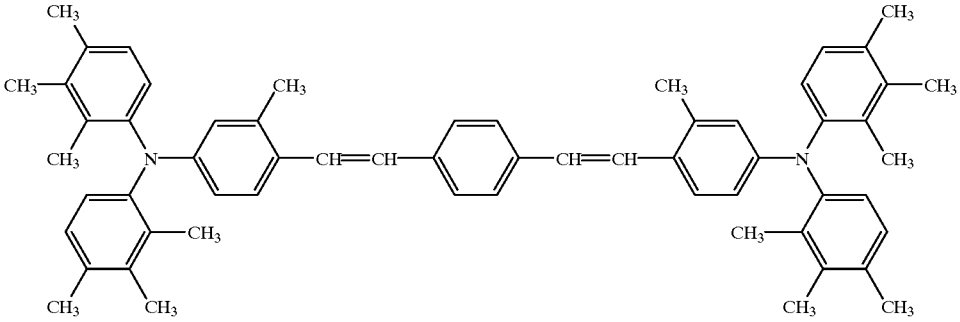
(HT1-36)
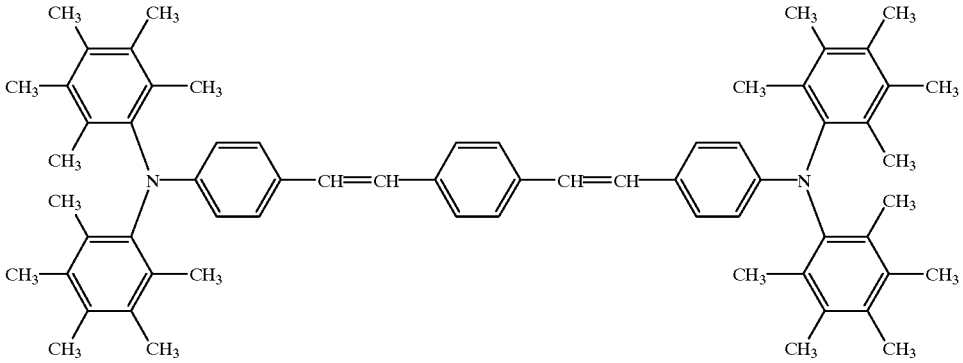
(HT1-37)
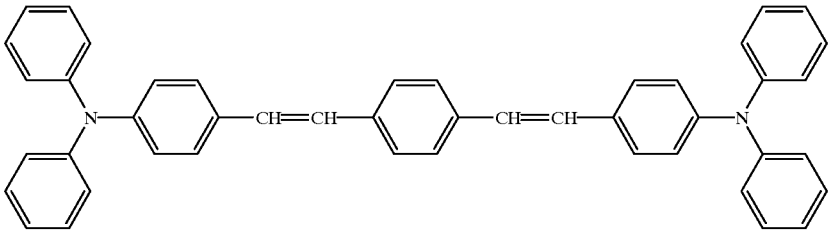

-continued
(HT1-38)
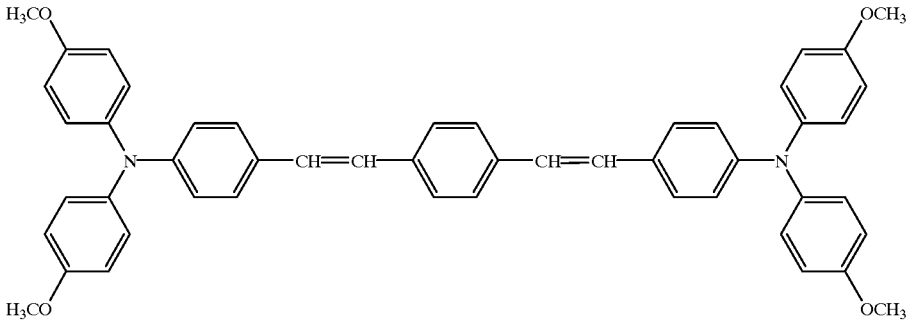
(HT1-39)
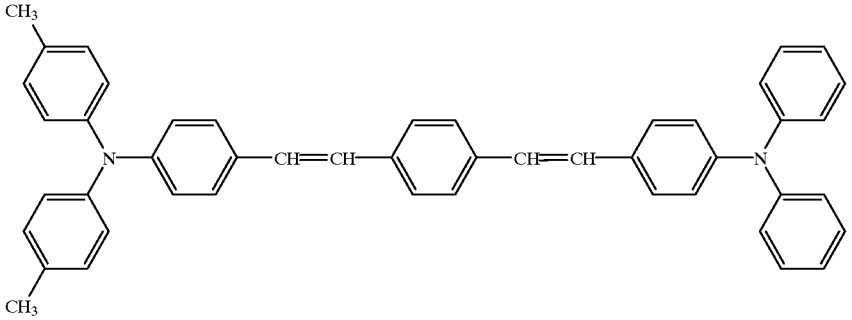
(HT1-40)
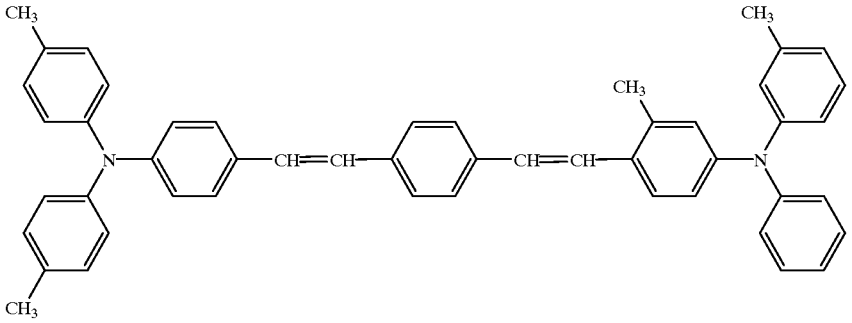
(HT1-41)
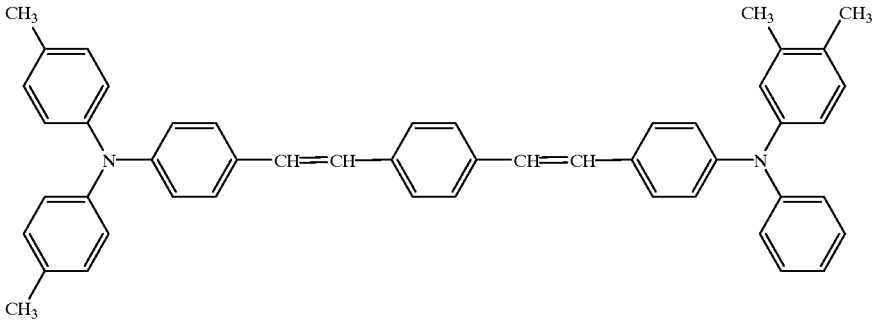

-continued
(HT1-42)
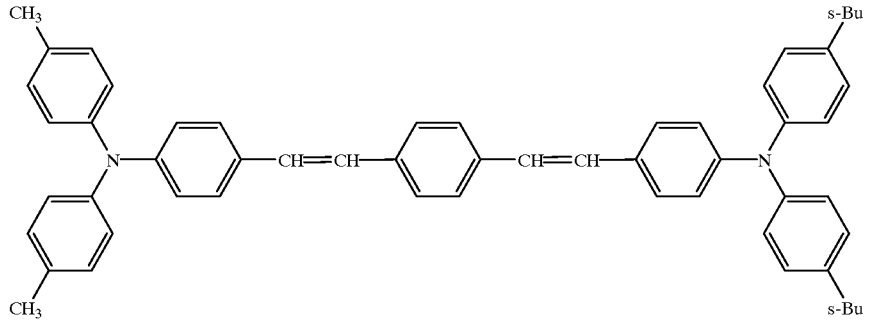
(HT1-43)
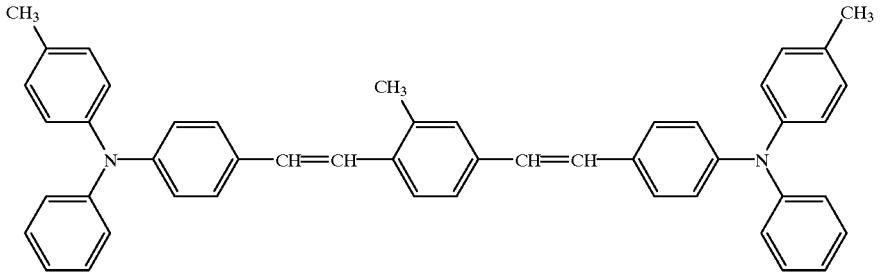
(HT1-44)
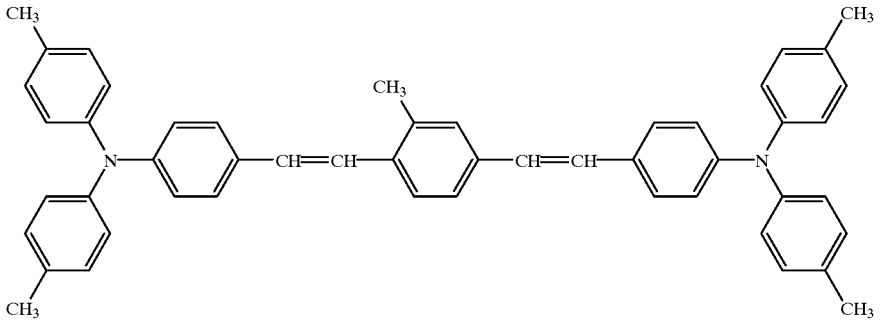
(HT1-45)
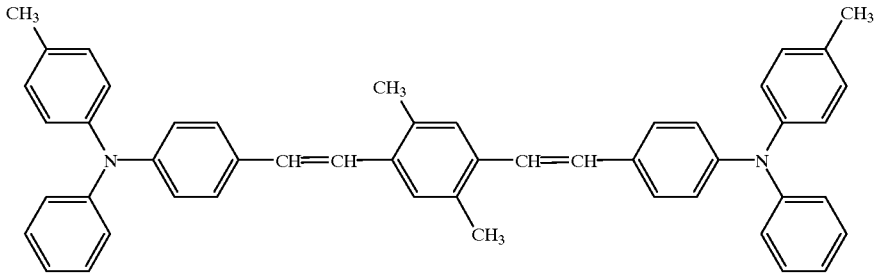
(HT1-46)
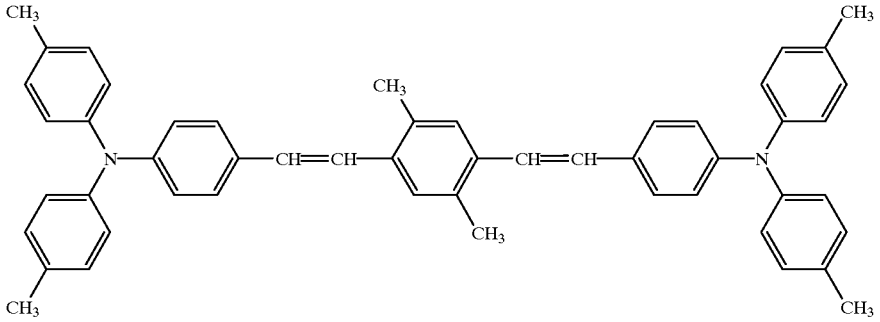

-continued
(HT1-47)
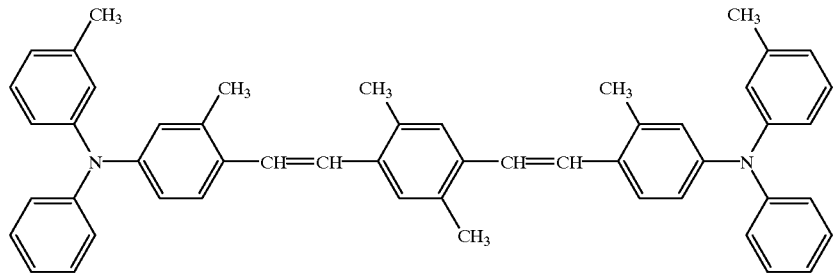
(HT1-48)
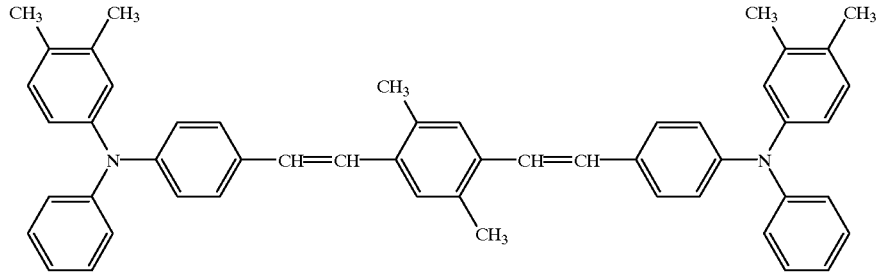
(HT1-49)
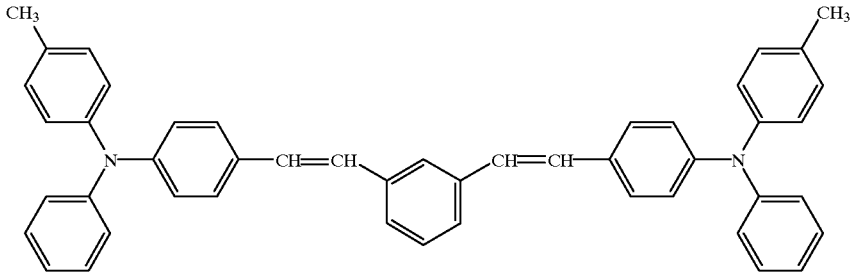
(HT1-50)
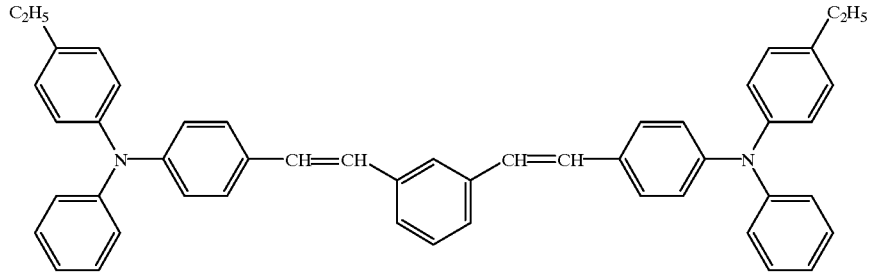
(HT1-51)
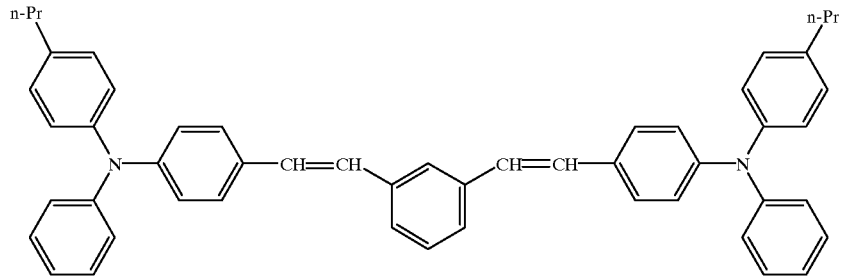

-continued
(HT1-52)
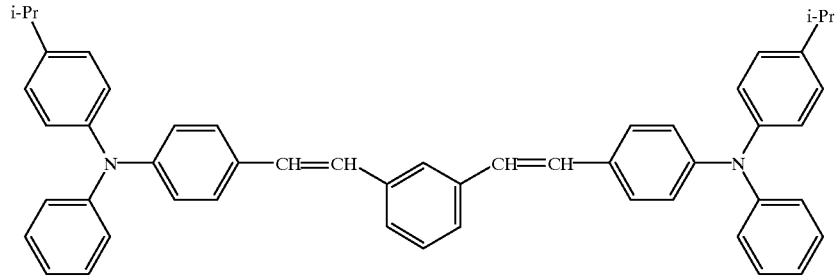
(HT1-53)
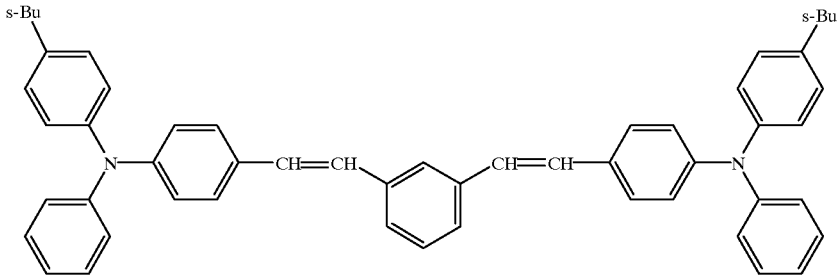
(HT1-54)
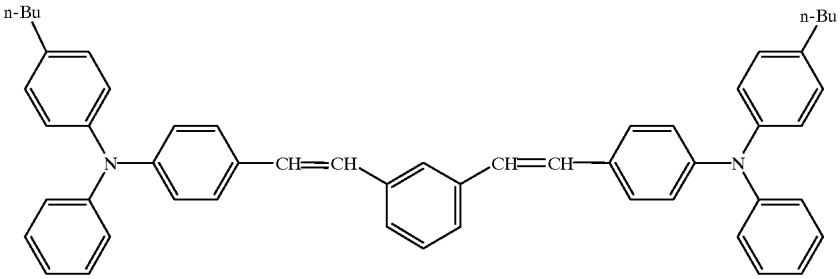
(HT1-55)
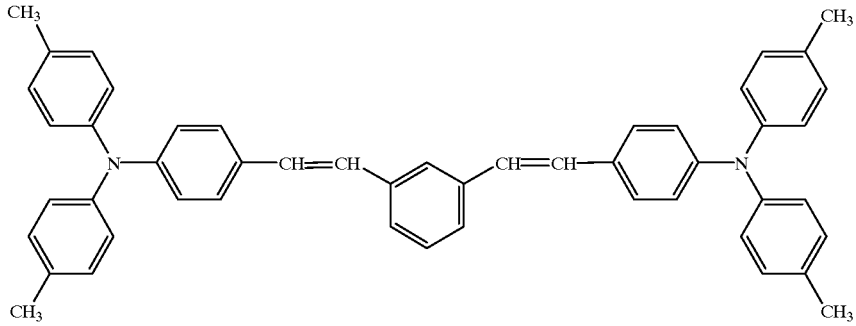
(HT1-56)
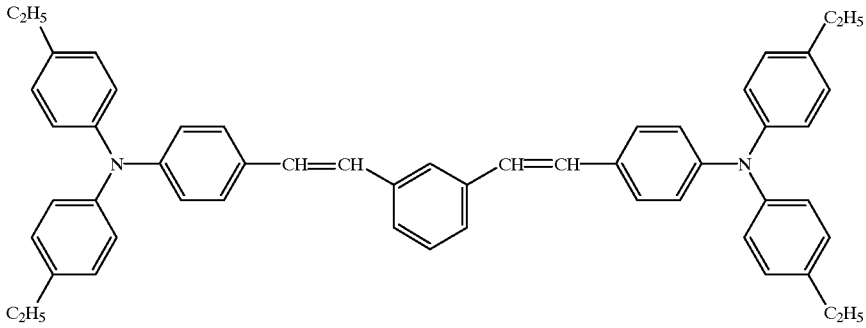

-continued
(HT1-57)
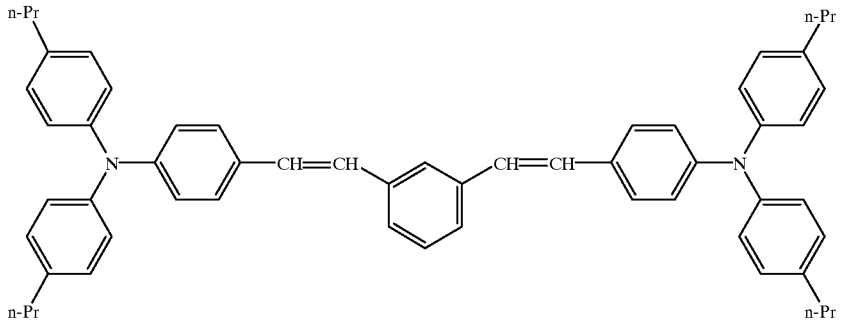
(HT1-58)
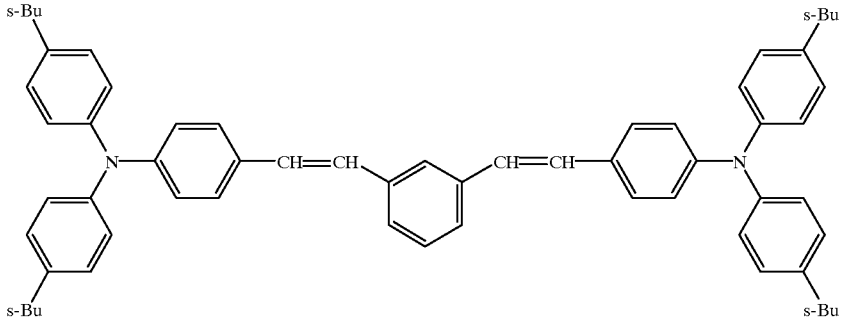
(HT1-59)
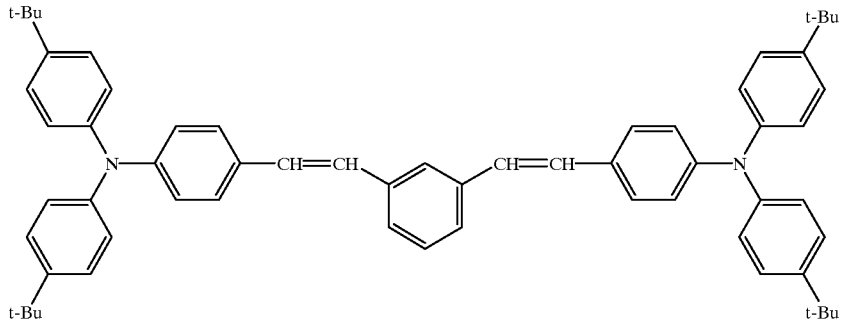
(HT1-60)
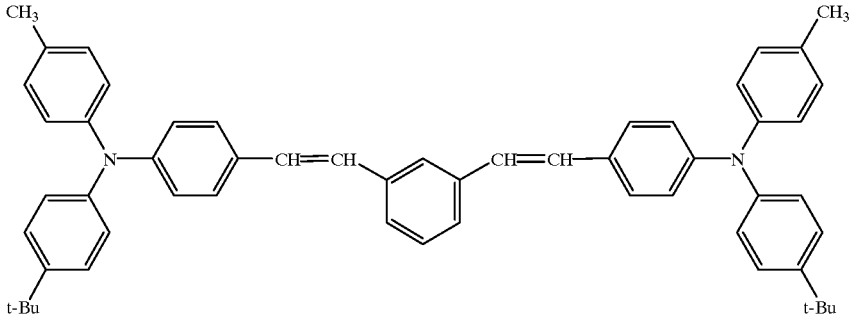
(HT1-61)
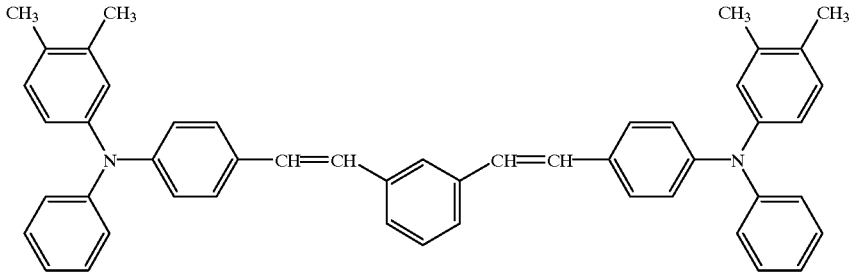

-continued
(HT1-62)
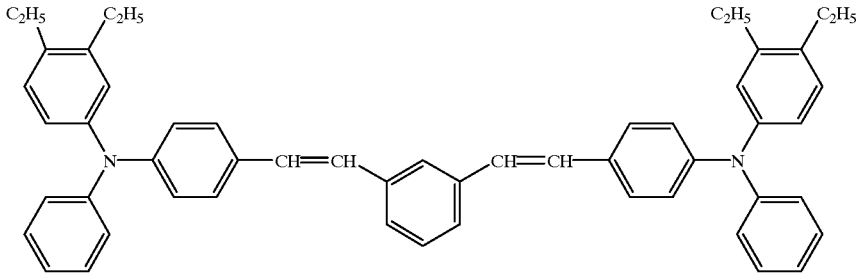
(HT1-63)
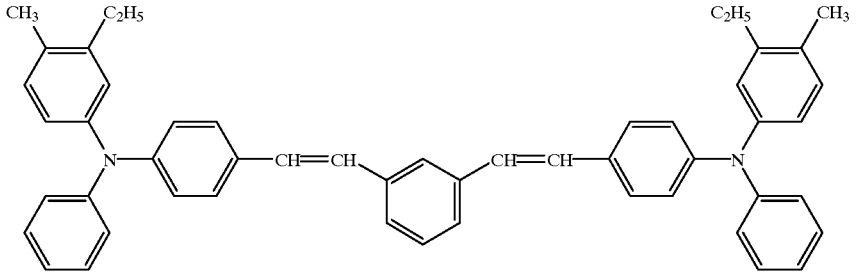
(HT1-64)
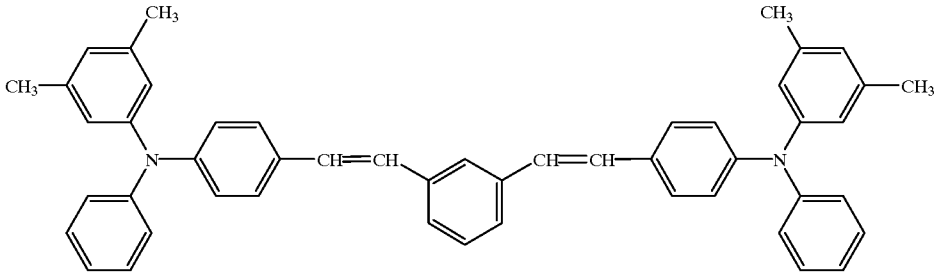
(HT1-65)
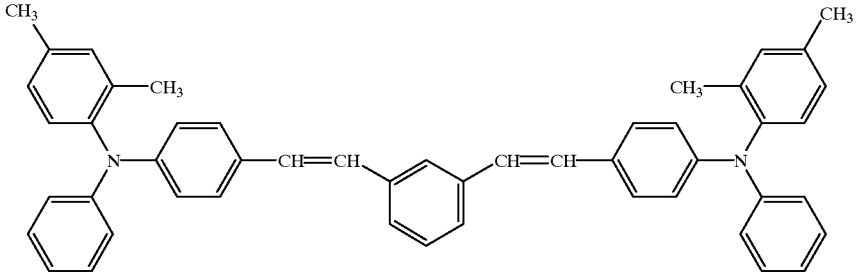
(HT1-66)
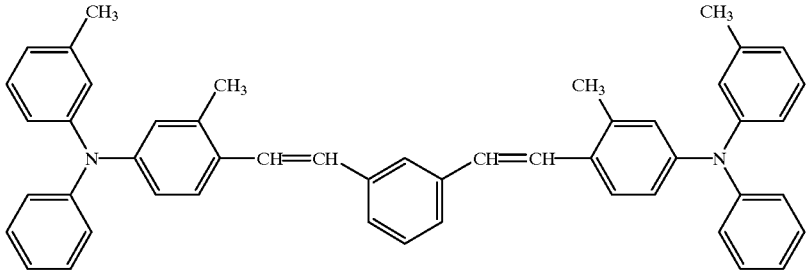

-continued
(HT1-67)
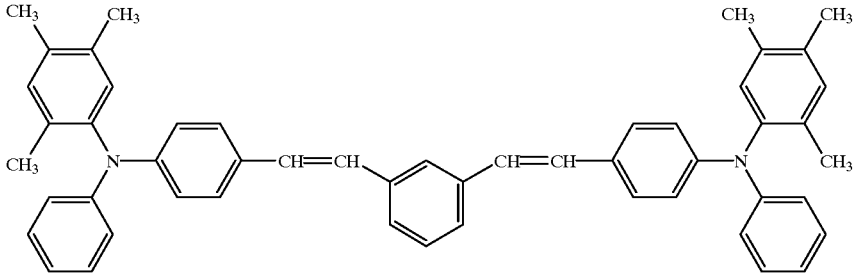
(HT1-68)
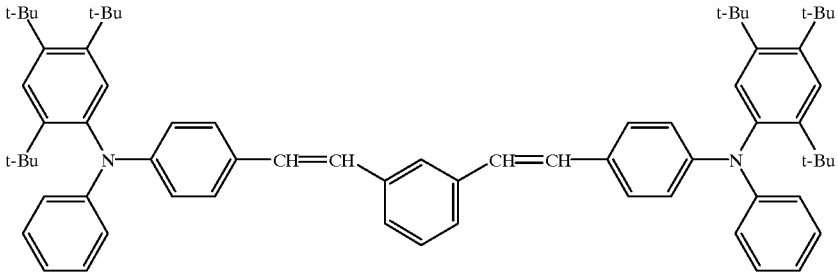
(HT1-69)
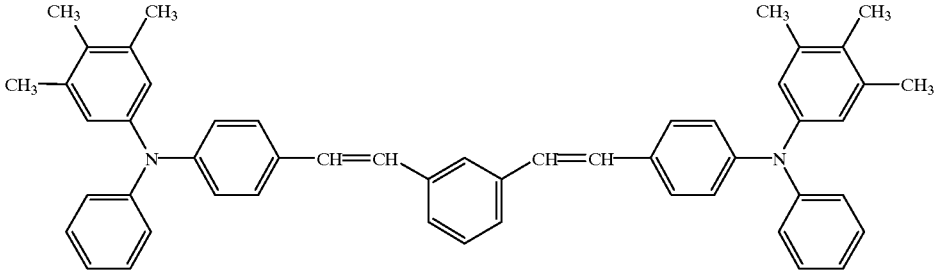
(HT1-70)
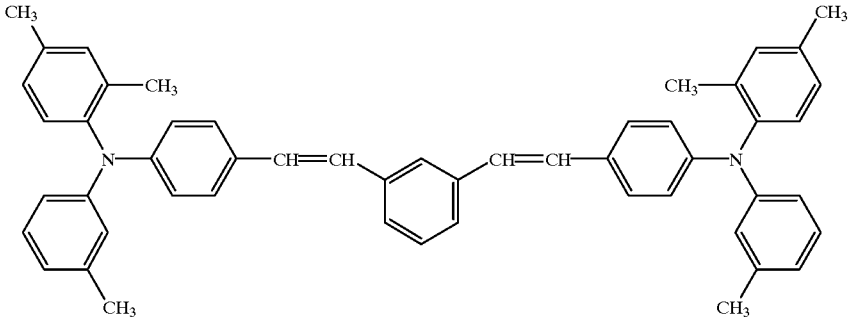
(HT1-71)
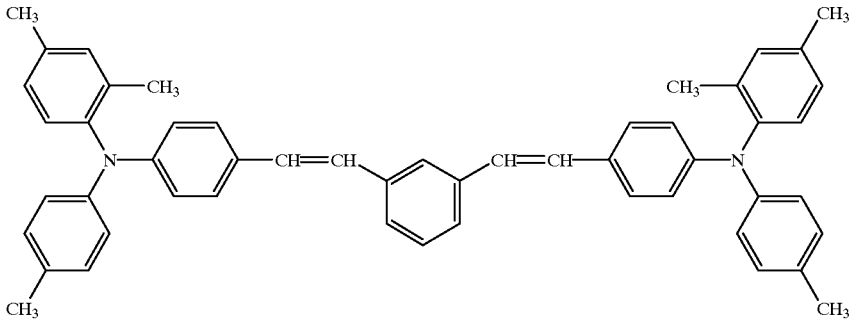

-continued
(HT1-72)
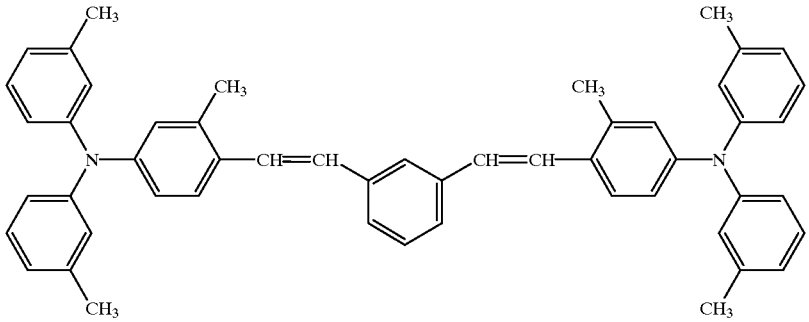
(HT1-73)
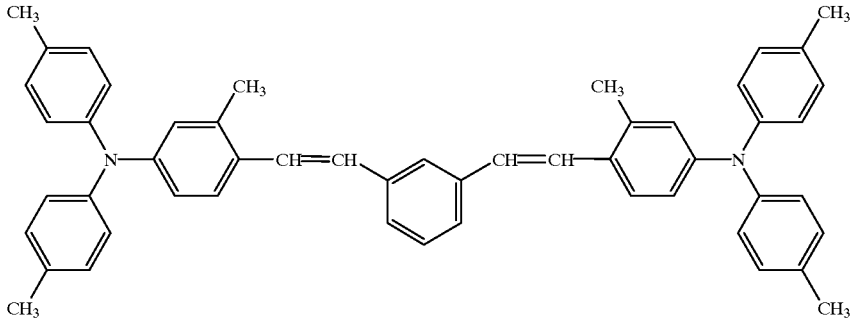
(HT1-74)
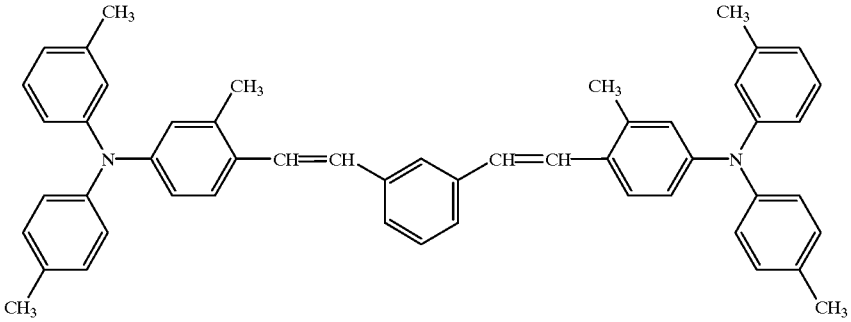
(HT1-75)
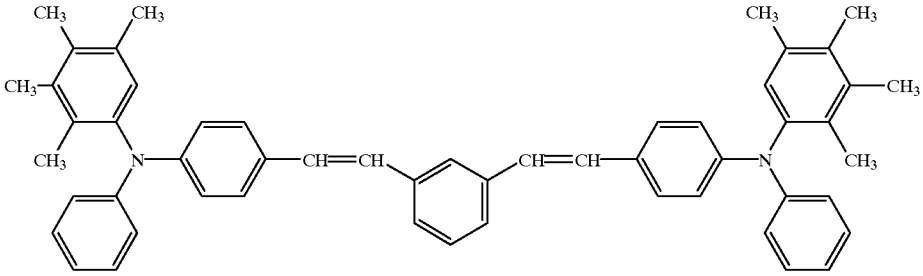
(HT1-76)
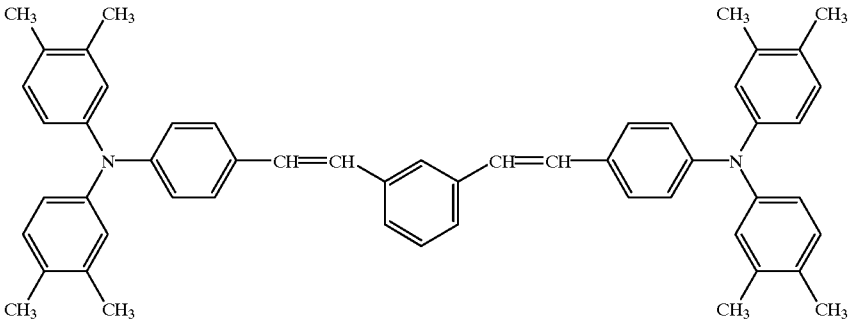

-continued
(HT1-77)
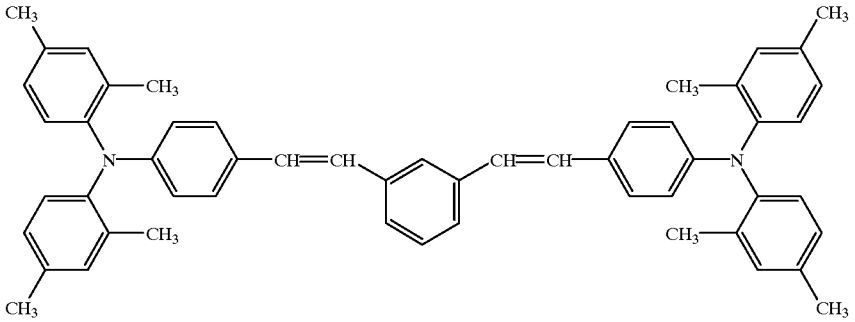
(HT1-78)
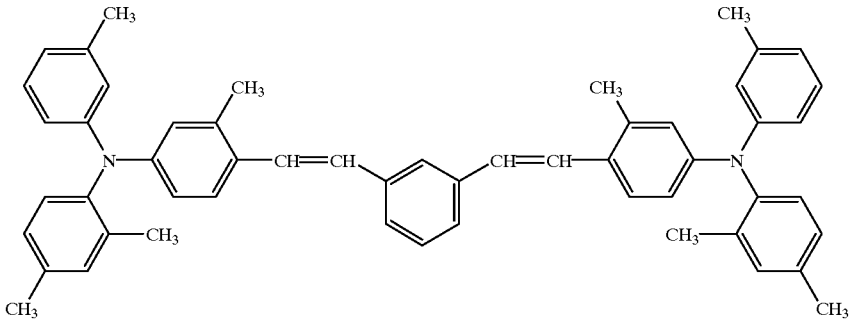
(HT1-79)
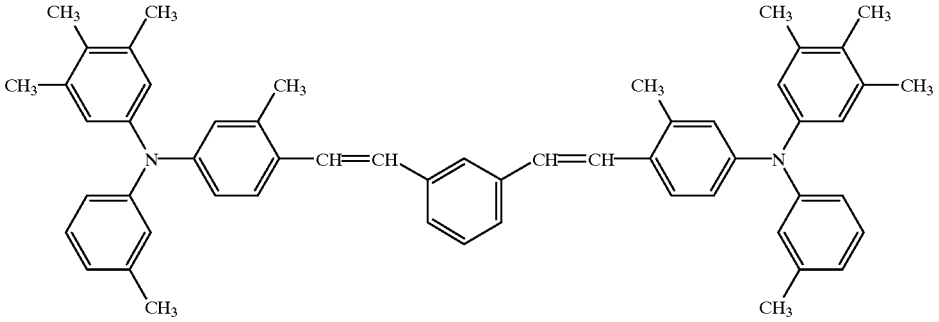
(HT1-80)
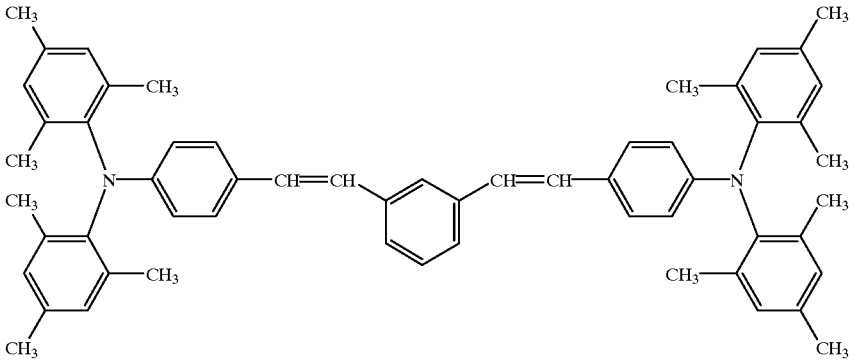

-continued
(HT1-81)
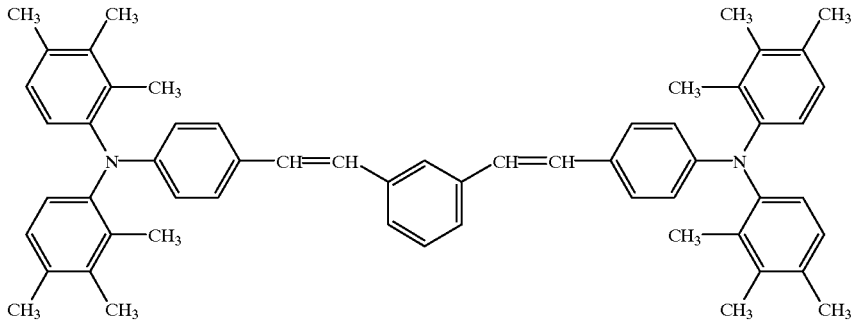
(HT1-82)
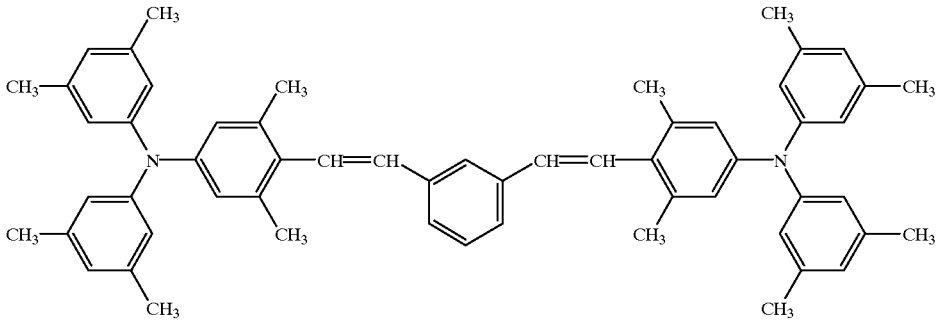
(HT1-83)
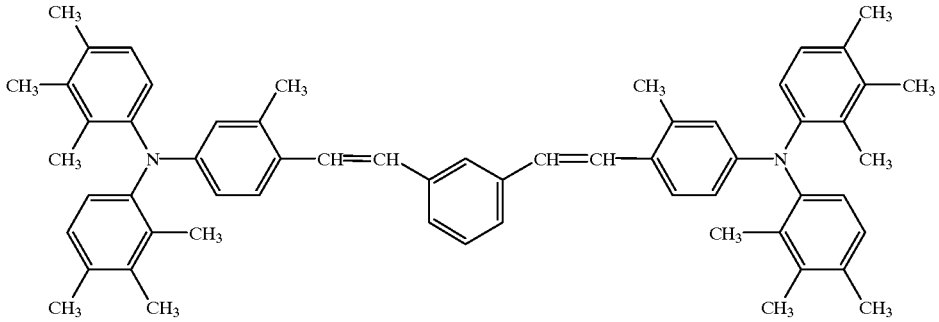
(HT1-84)
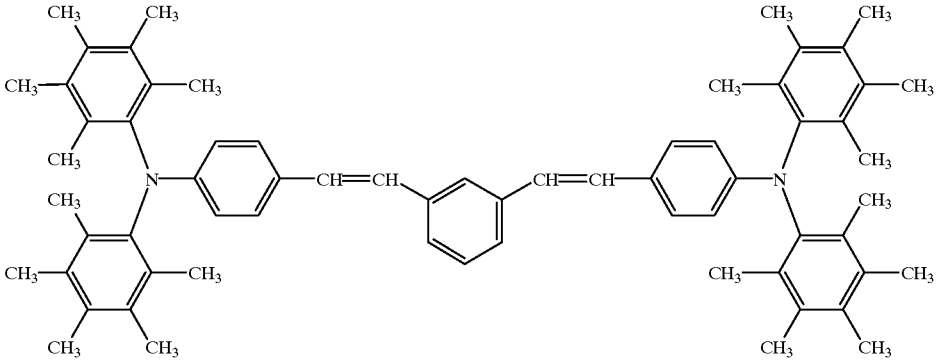
(HT1-85)
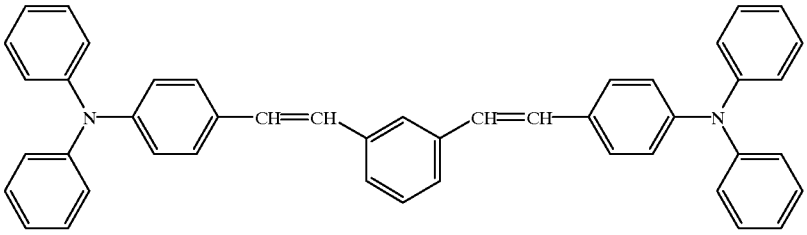

-continued
(HT1-86)
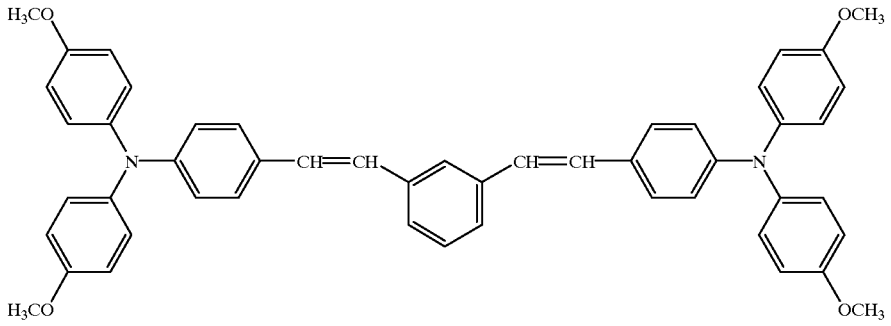
(HT1-87)
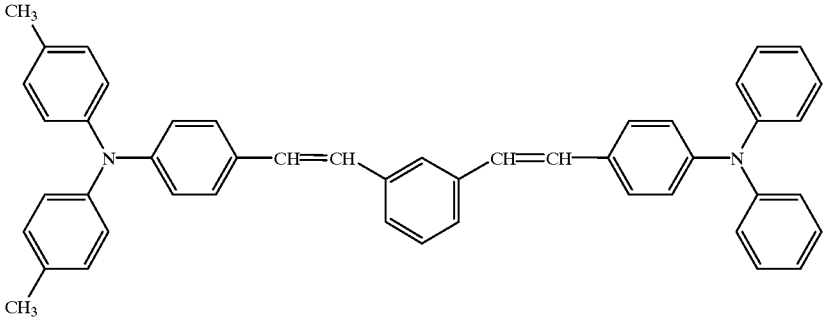
(HT1-88)
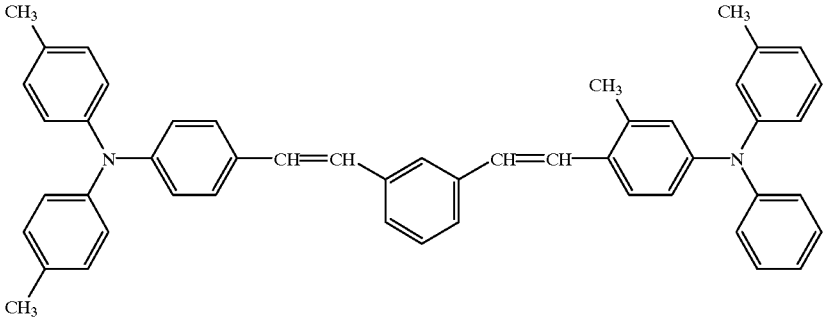
(HT1-89)
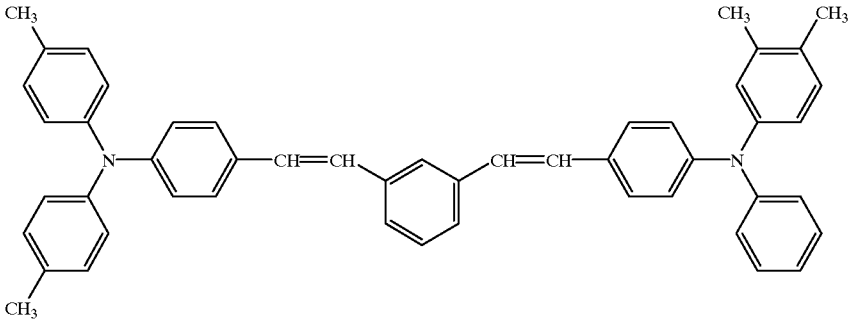

-continued
(HT1-90)
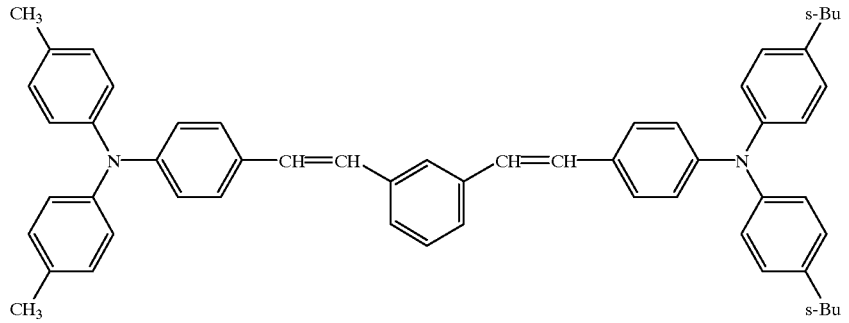
(HT1-91)
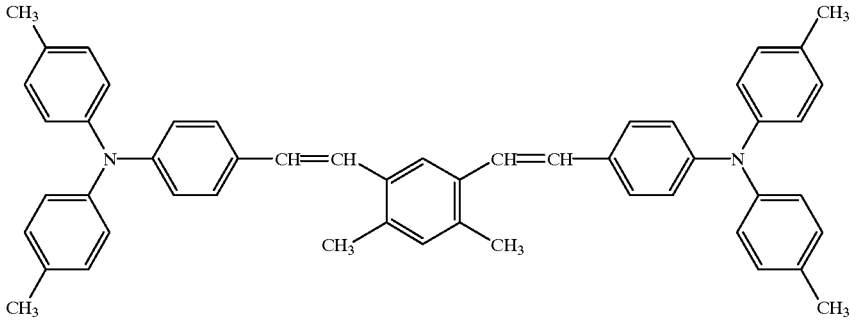
(HT1-92)
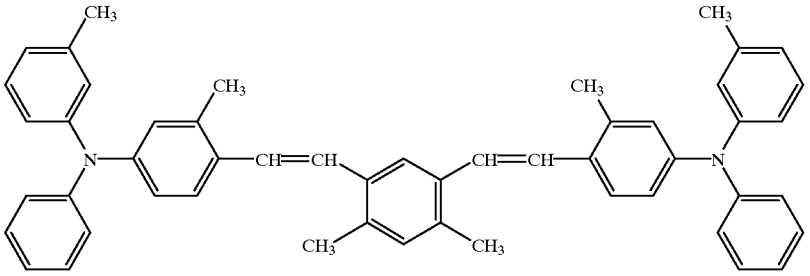
(HT1-93)
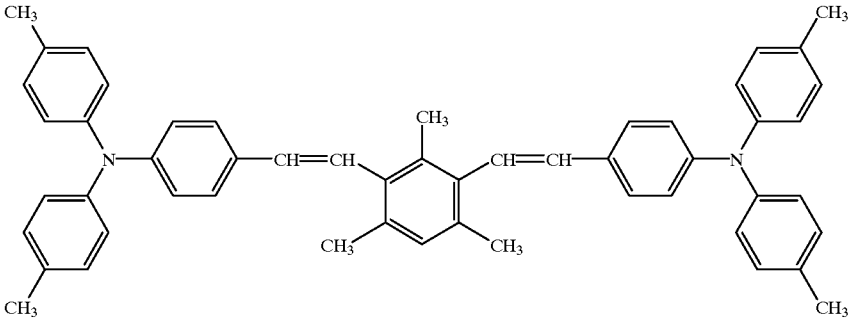
(HT1-94)
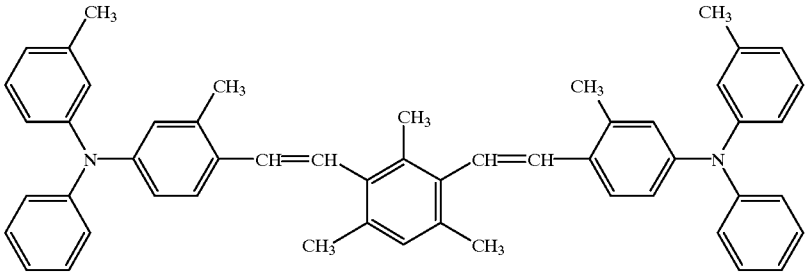

-continued
(HT1-95)
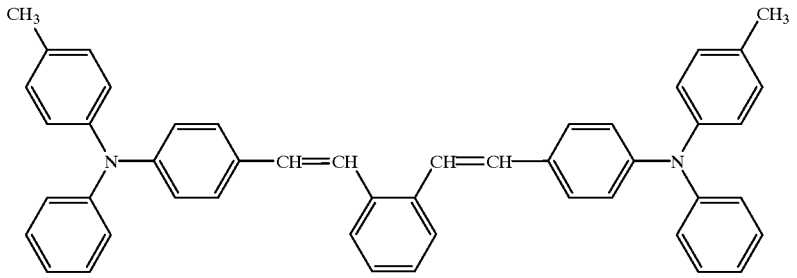
(HT1-96)
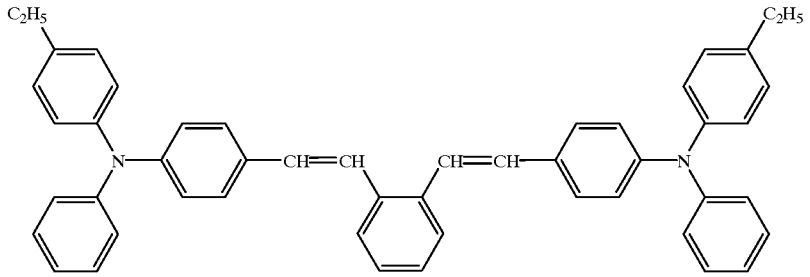
(HT1-97)
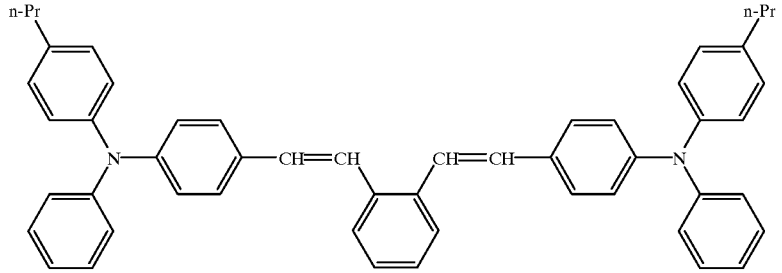
(HT1-98)
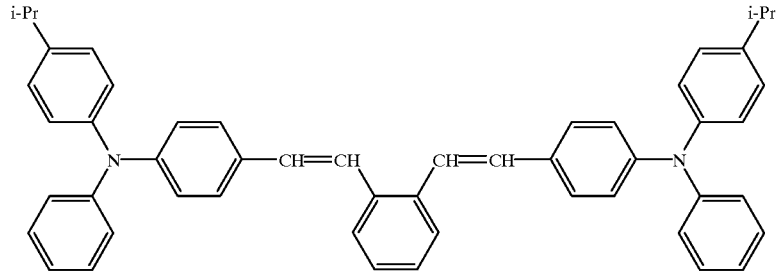
(HT1-99)
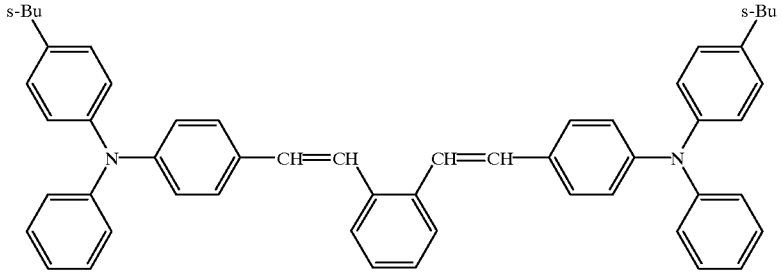

-continued
(HT1-100)
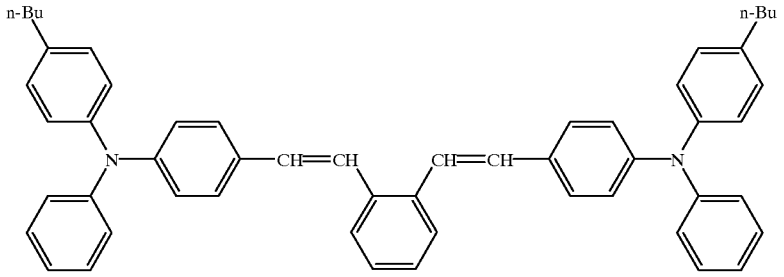
(HT1-101)
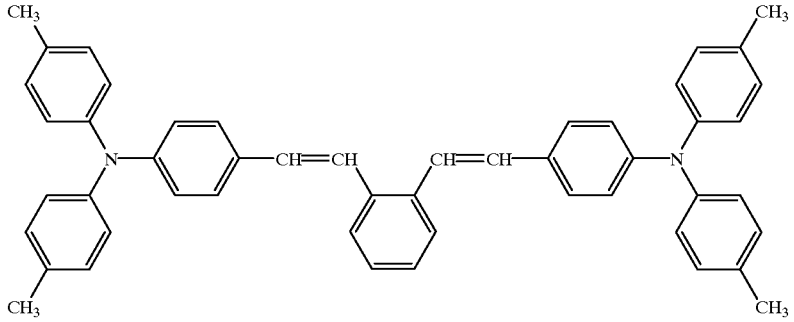
(HT1-102)
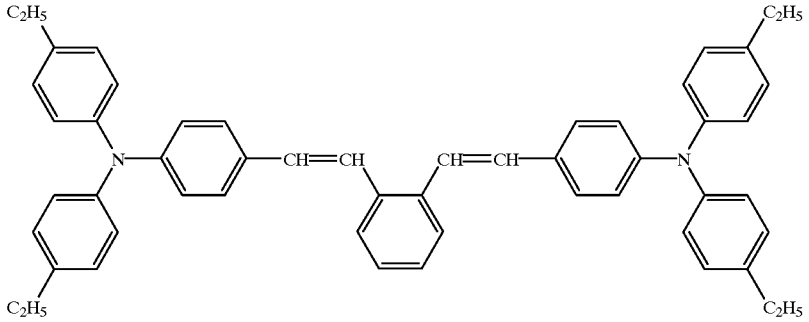
(HT1-103)
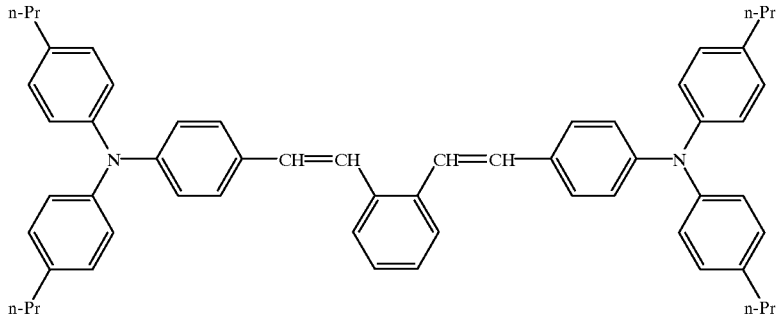
(HT1-104)
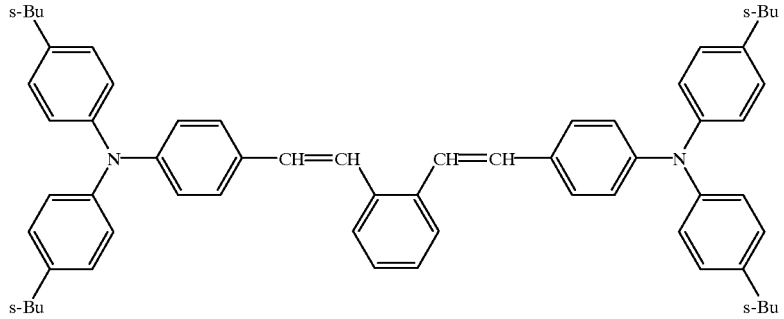

-continued
(HT1-105)
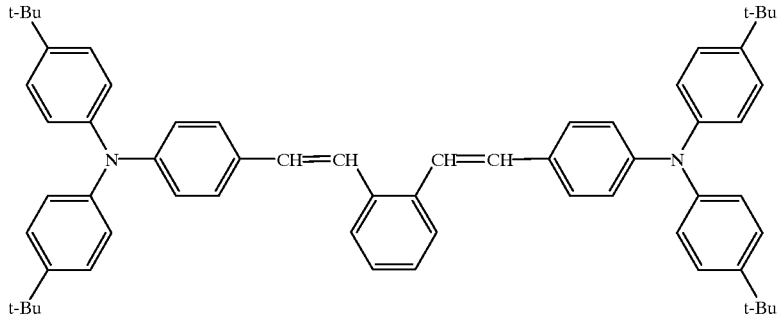
(HT1-106)
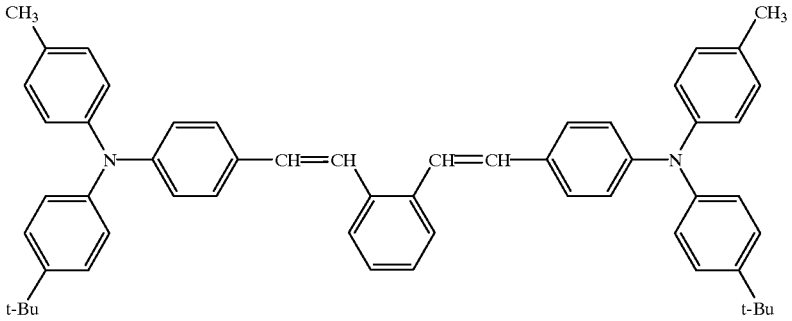
(HT1-107)
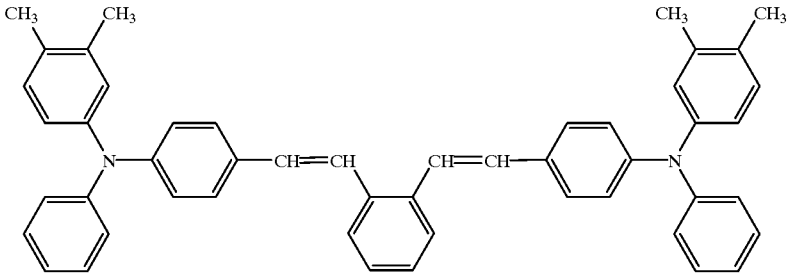
(HT1-108)
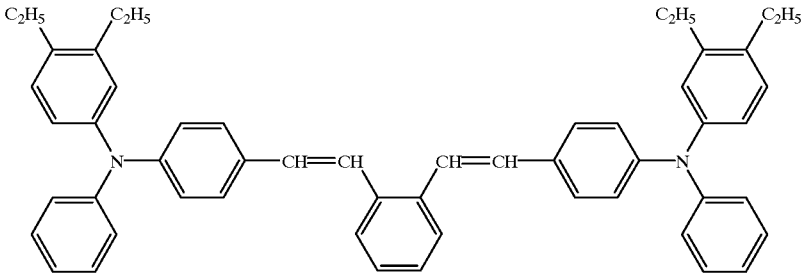
(HT1-109)
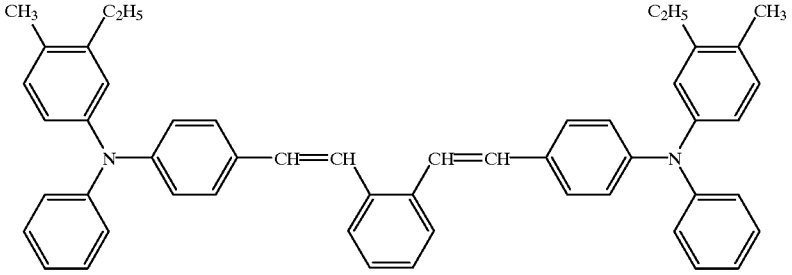

-continued
(HT1-110)
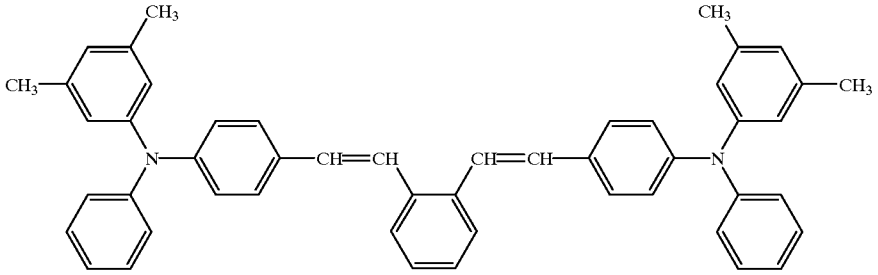
(HT1-111)
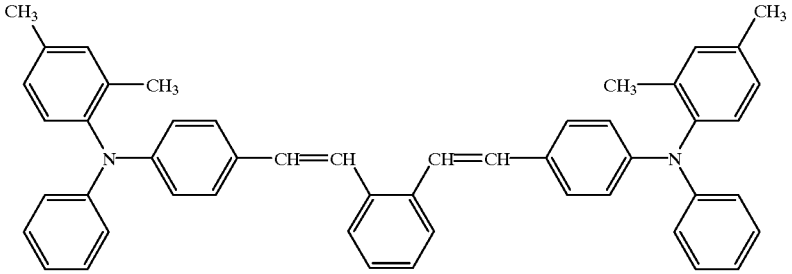
(HT1-112)
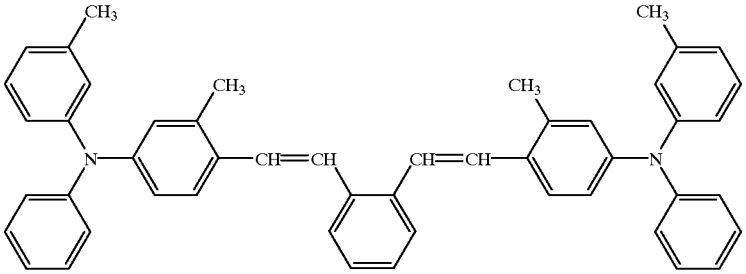
(HT1-113)
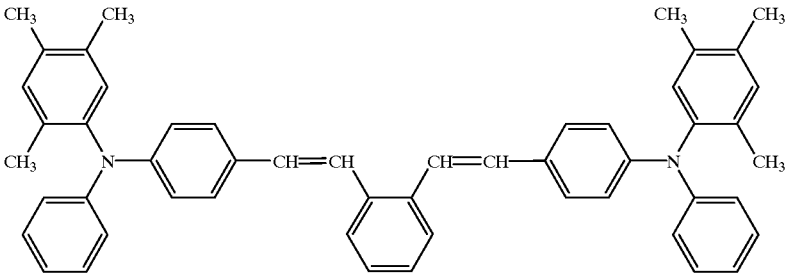
(HT1-114)
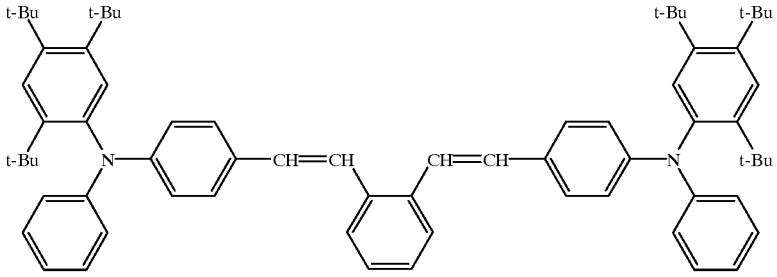

-continued
(HT1-115)
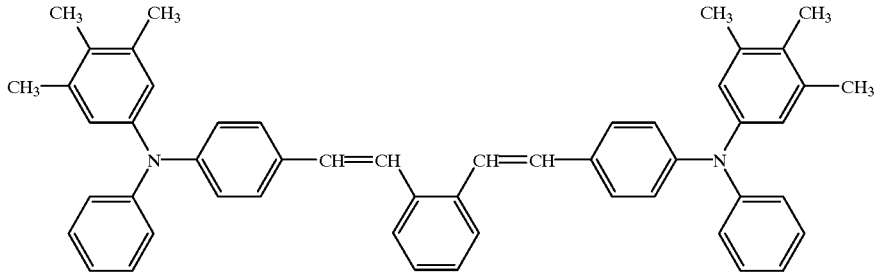
(HT1-116)
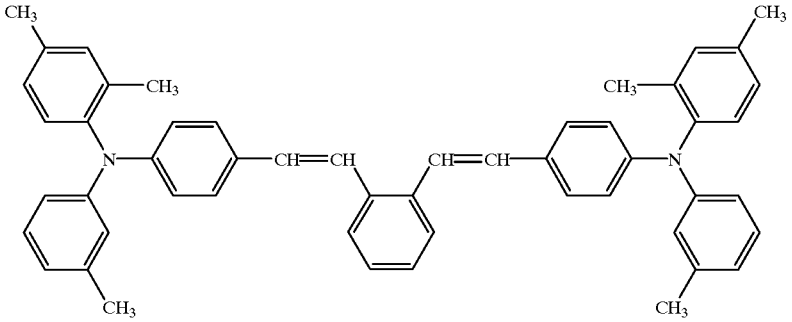
(HT1-117)
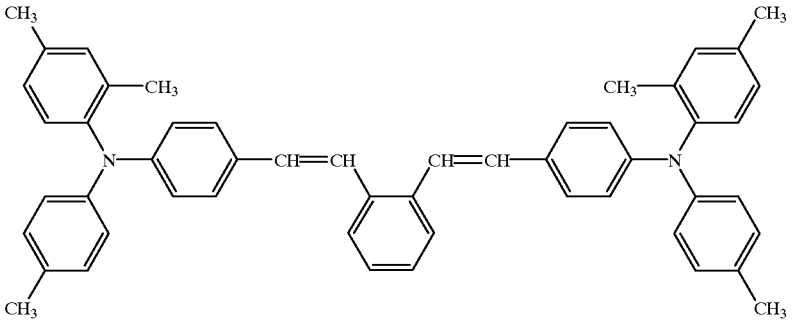
(HT1-118)
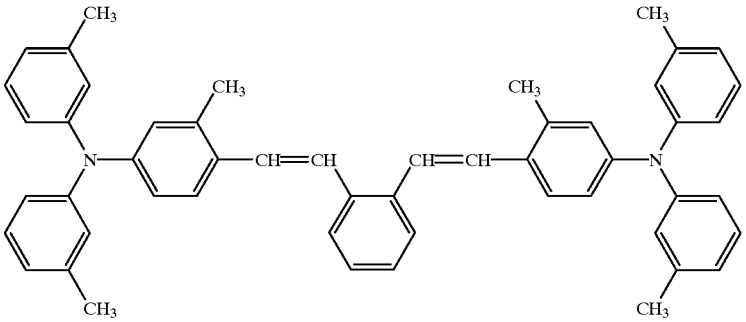
(HT1-119)
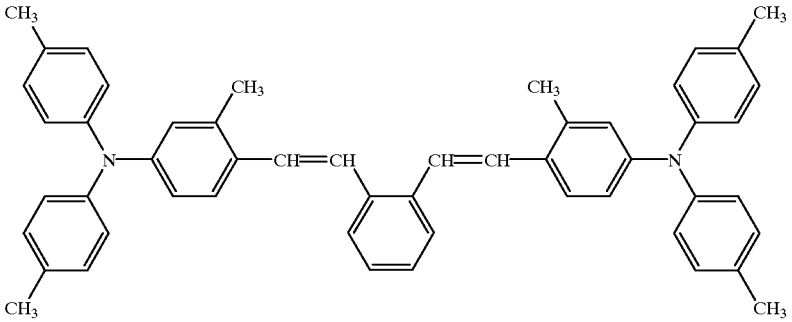

-continued
(HT1-120)
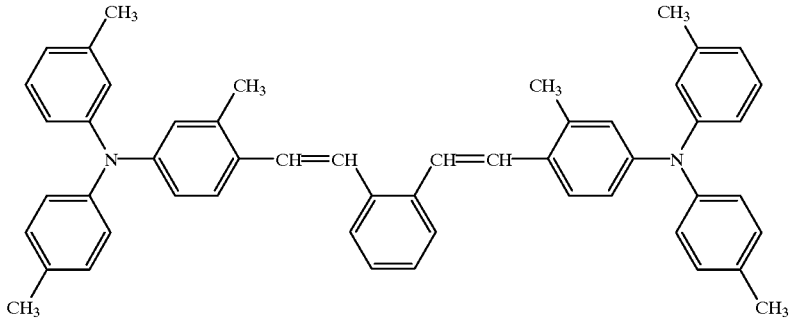
(HT1-121)
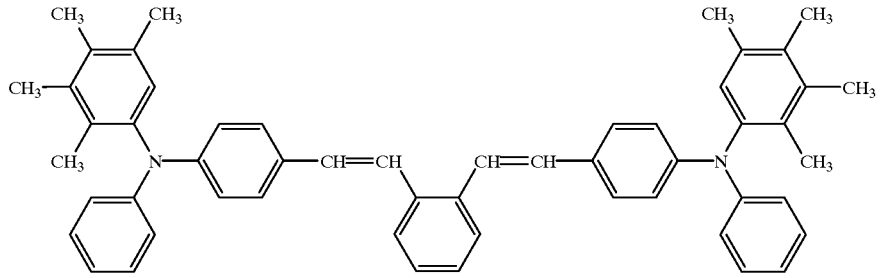
(HT1-122)
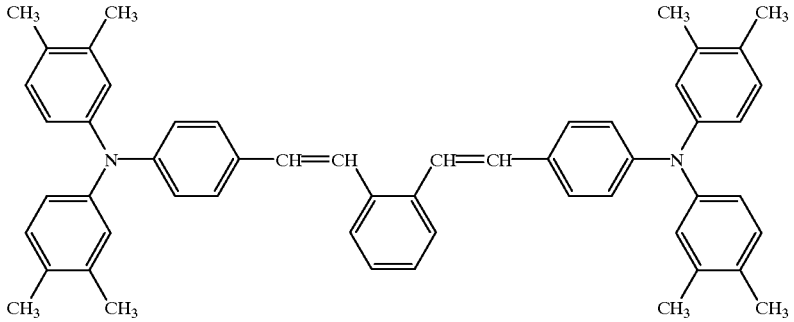
(HT1-123)
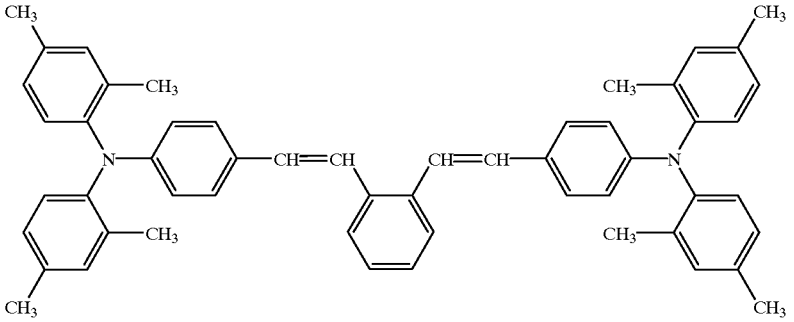

-continued
(HT1-124)
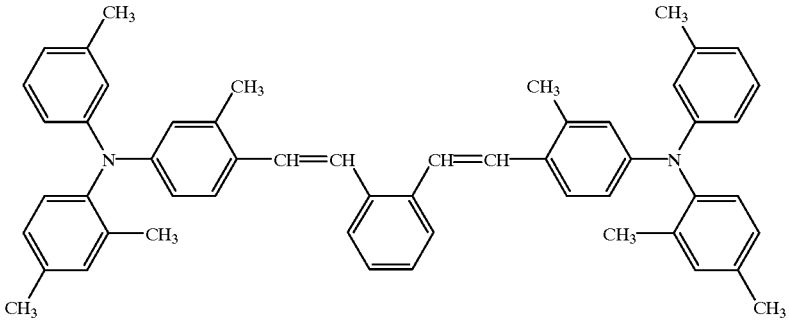
(HT1-125)
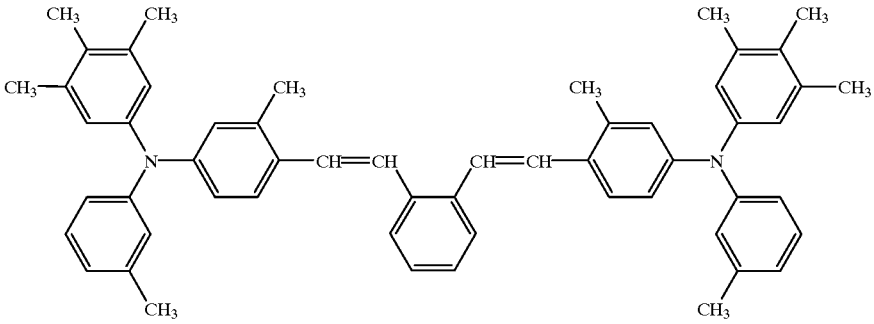
(HT1-126)
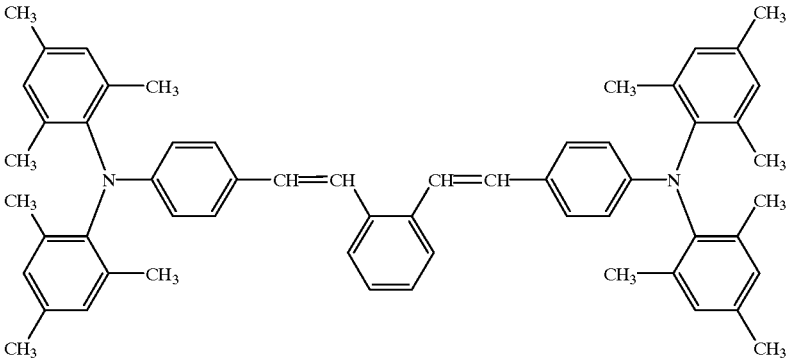
(HT1-127)
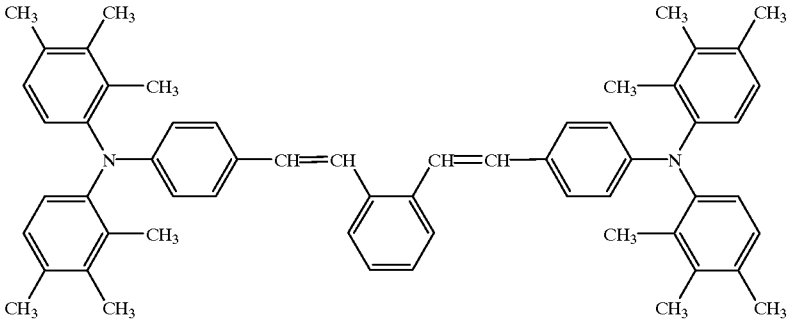

-continued
(HT1-128)
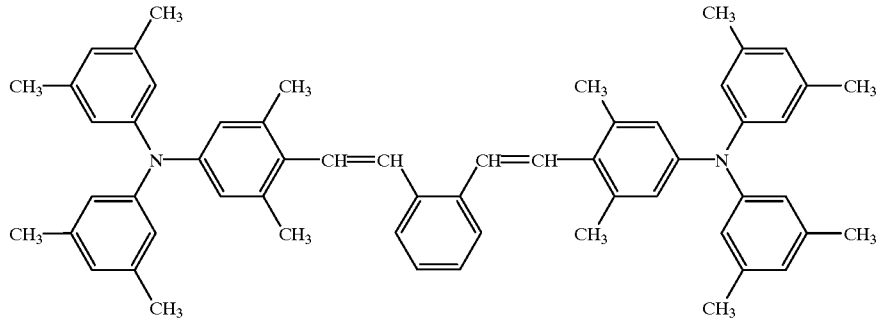
(HT1-129)
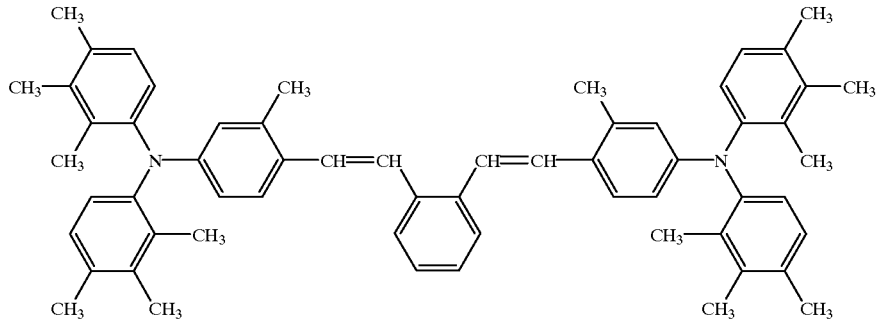
(HT1-130)
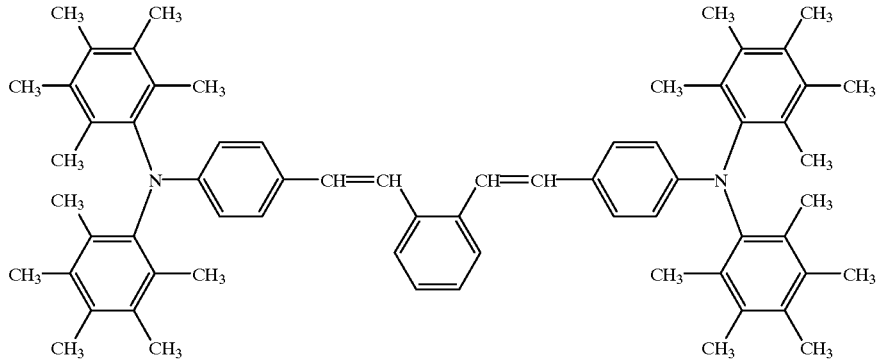
(HT1-131)
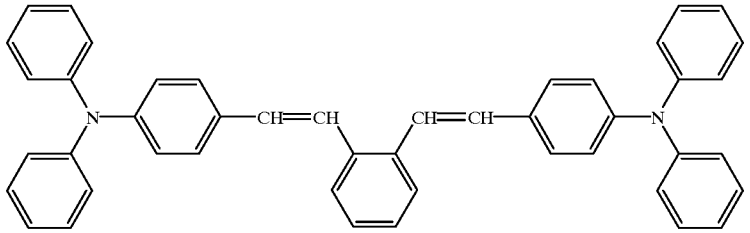
(HT1-132)
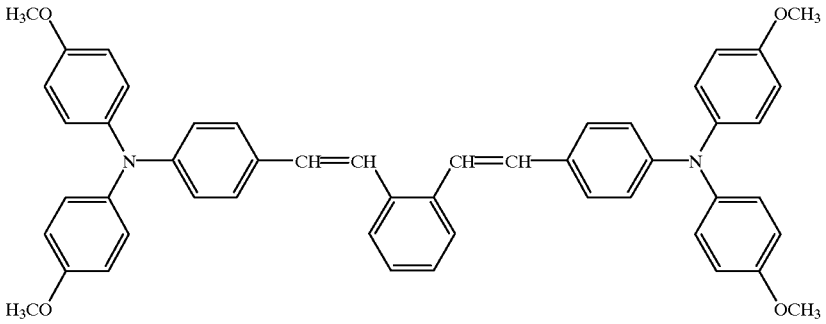

-continued
(HT1-133)
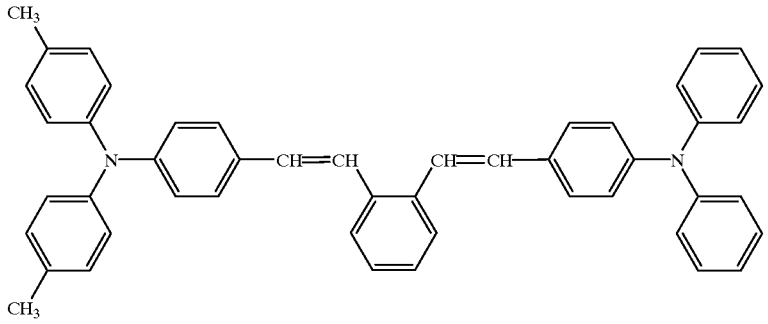
(HT1-134)
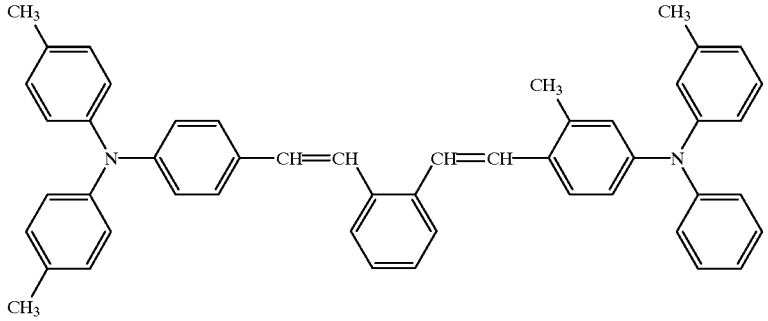
(HT1-135)
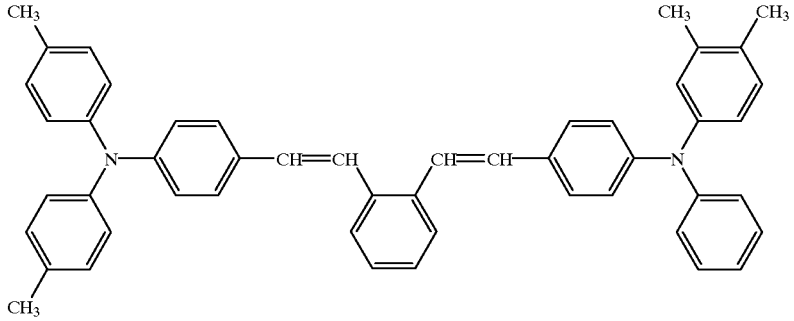
(HT1-136)
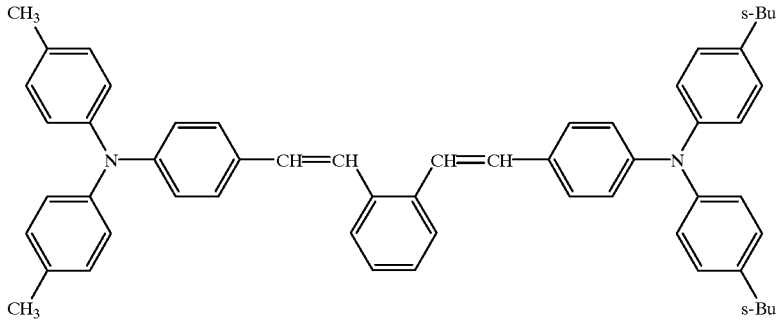

-continued
(HT2-1)
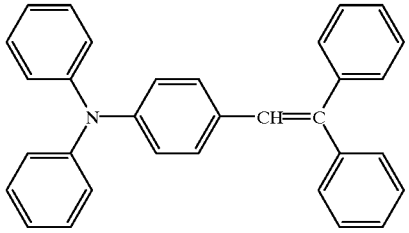
(HT2-2)
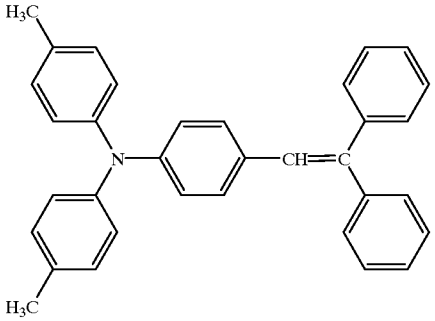
(HT2-3)
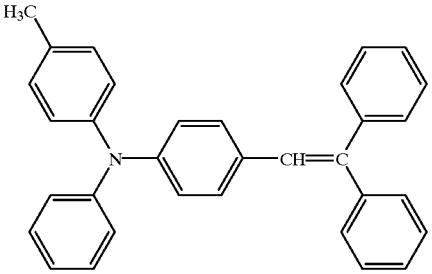
(HT2-4)
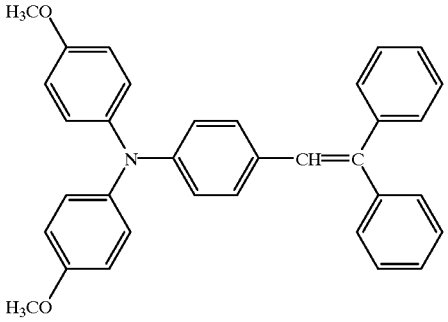
(HT2-5)
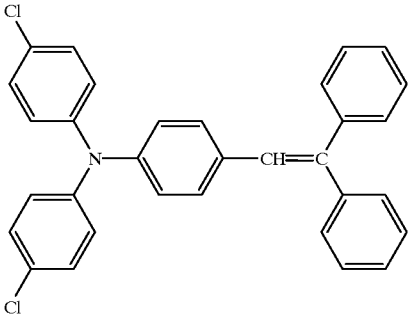
(HT2-6)
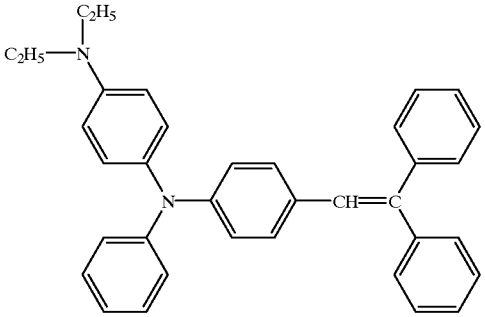
(HT2-7)
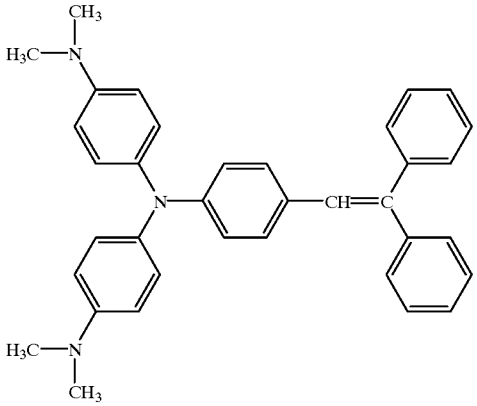
(HT2-8)
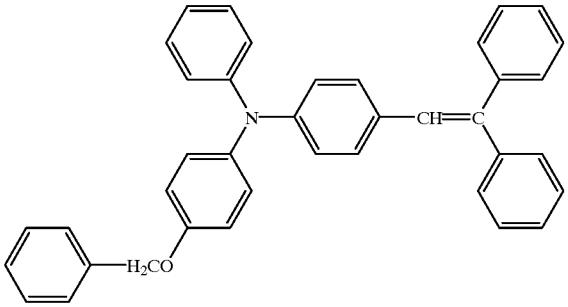

-continued
(HT2-9)
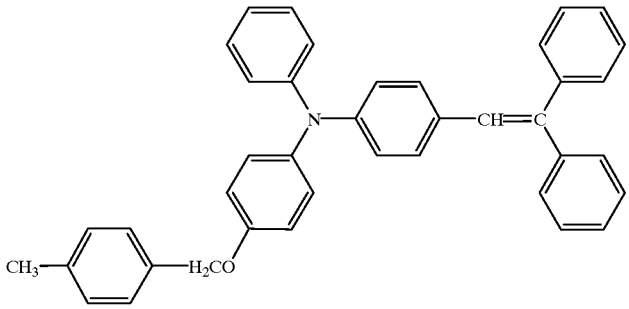
(HT2-10)
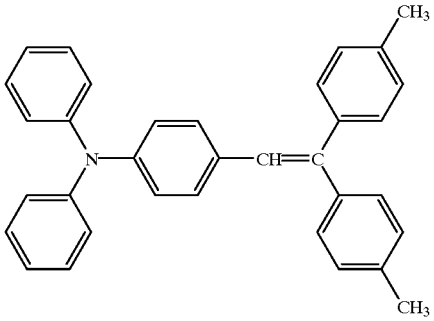
(HT2-11)
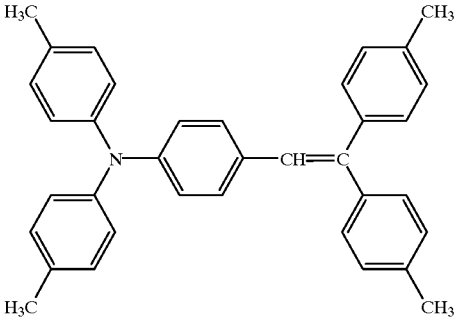
(HT2-12)
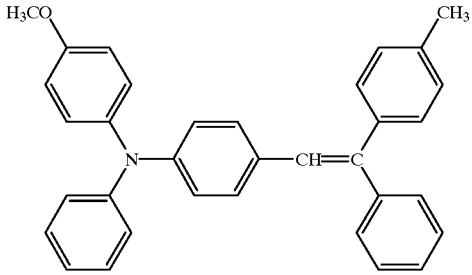
(HT2-13)
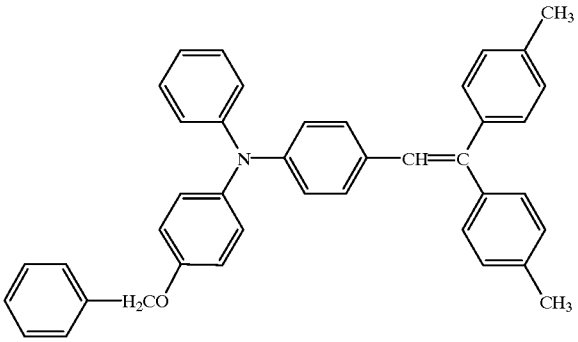
(HT2-14)
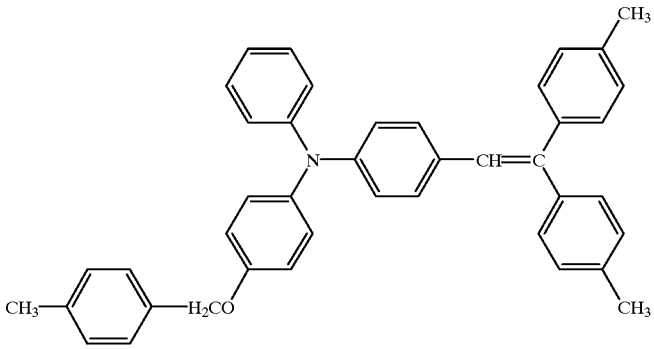

-continued
(HT2-15)
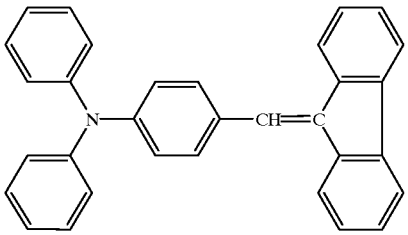
(HT2-16)
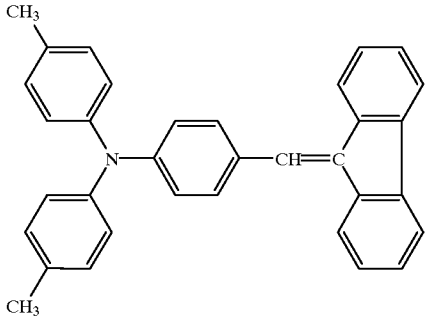
(HT2-17)
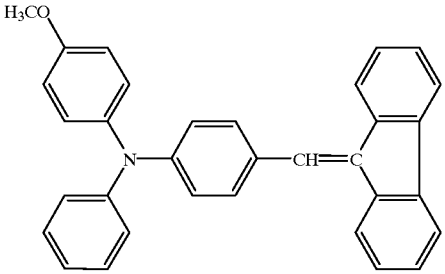
(HT2-18)
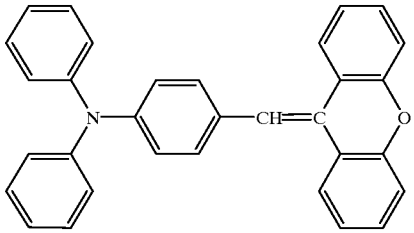
(HT2-19)
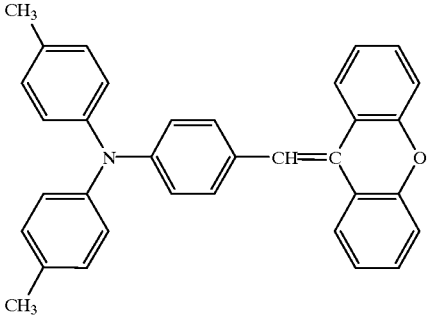
(HT2-20)
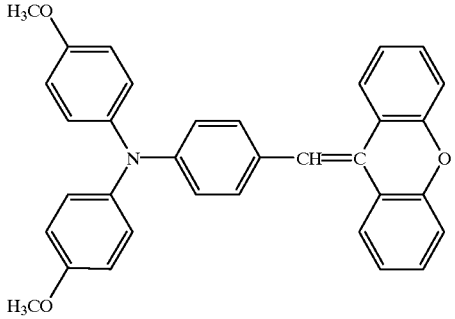
(HT2-21)
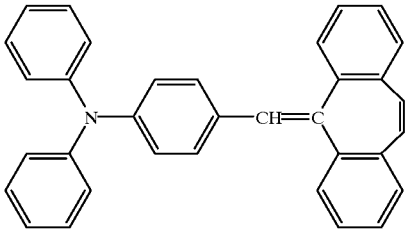
(HT2-22)
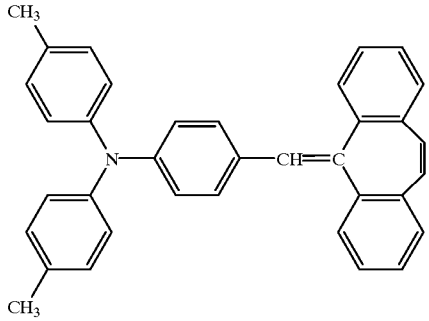
(HT2-23)
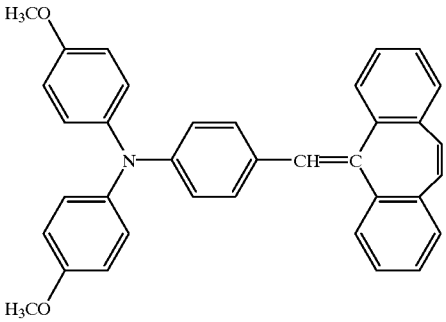
(HT2-24)
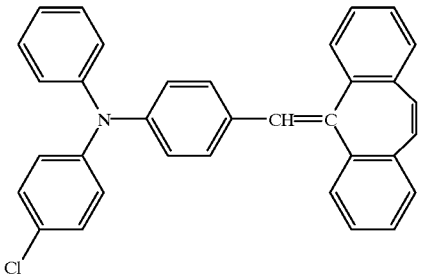

-continued
(HT2-25)
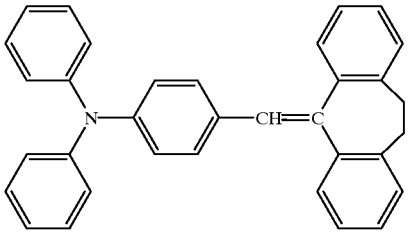
(HT2-26)
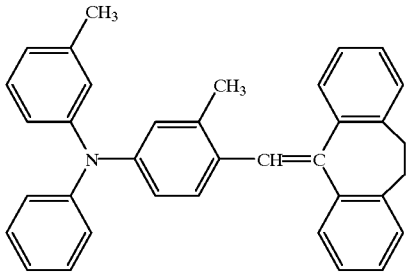
(HT2-27)
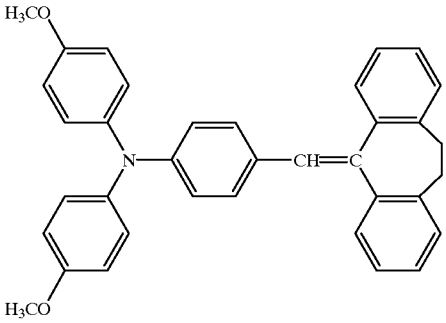
(HT2-28)
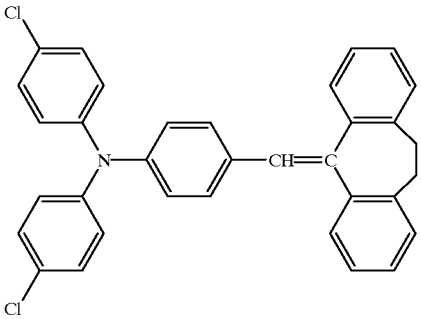
(HT2-29)
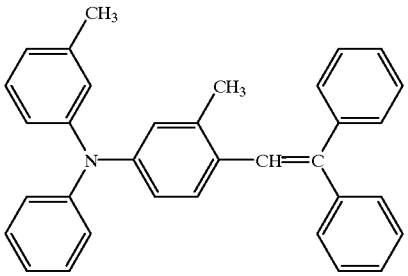
(HT2-30)
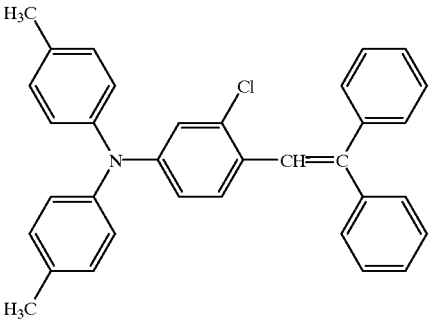
(HT2-31)
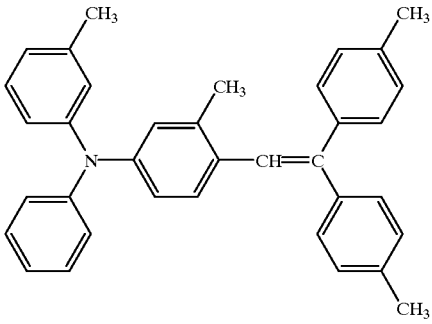
(HT2-32)
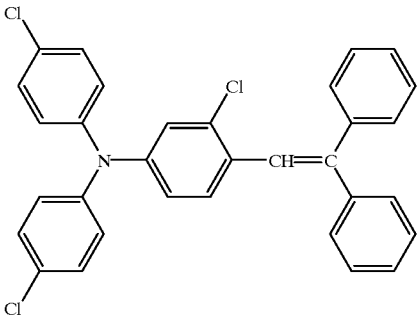

-continued
(HT2-33)
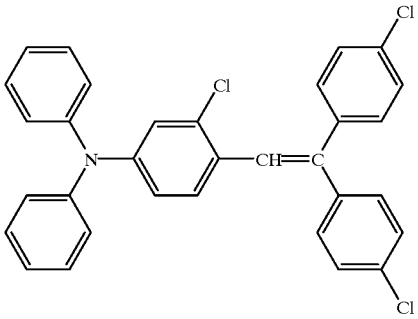
(HT2-34)
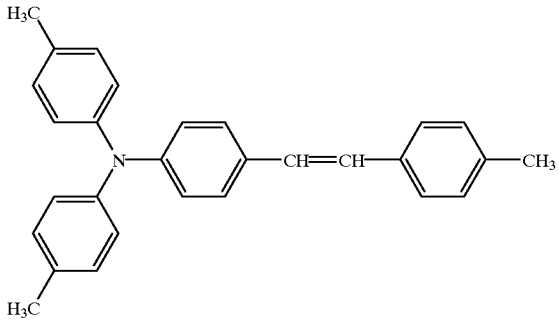
(HT2-35)
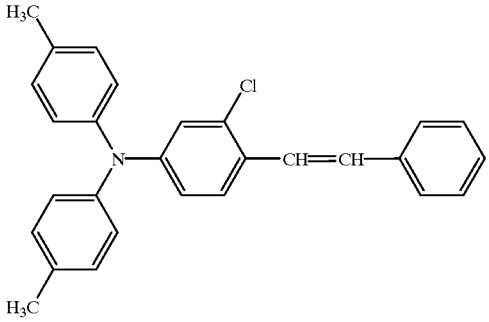
(HT2-36)
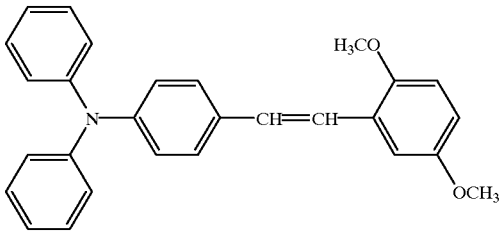
(HT2-37)
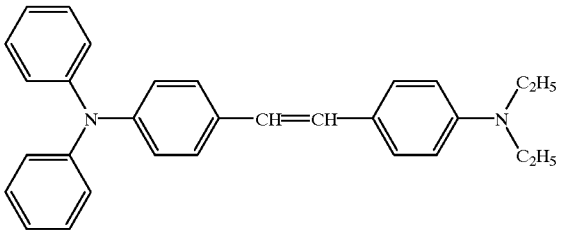
(HT2-38)
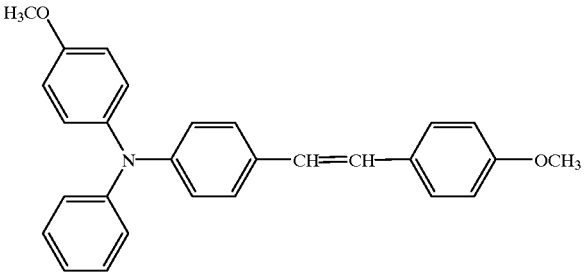
(HT2-39)
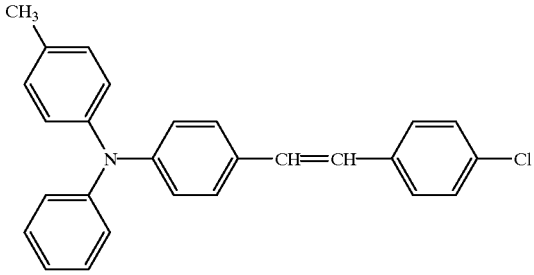
(HT2-40)
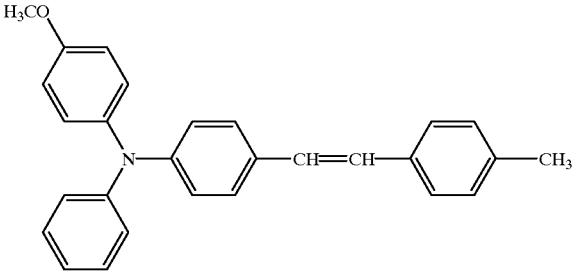
(HT2-41)
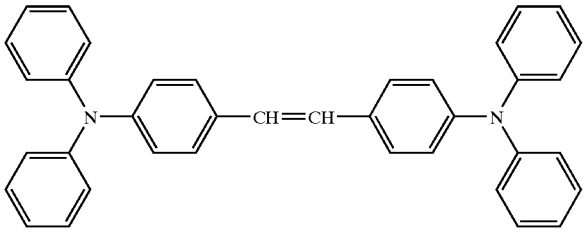
(HT2-42)
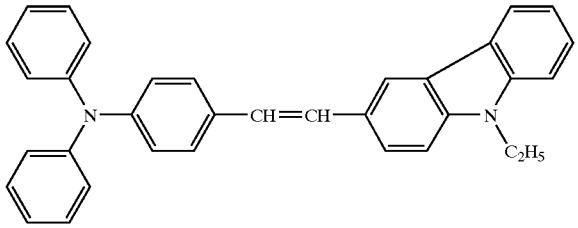

-continued
(HT2-43)
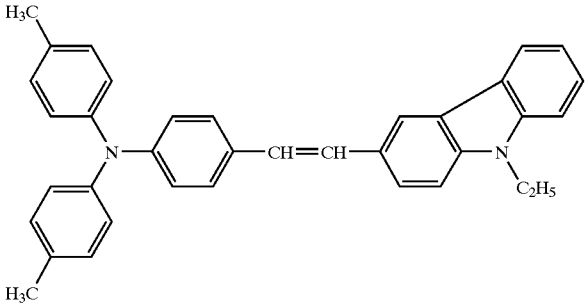
(HT2-44)
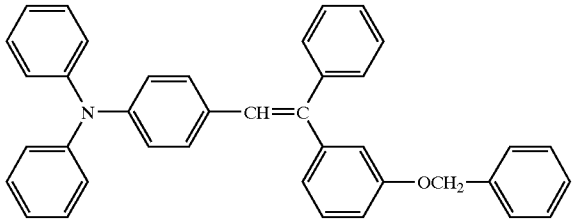
(HT2-45)
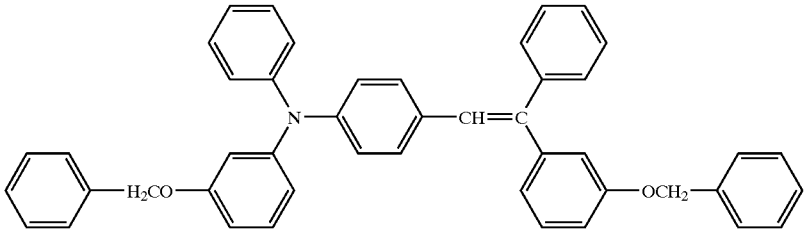
(HT2-46)
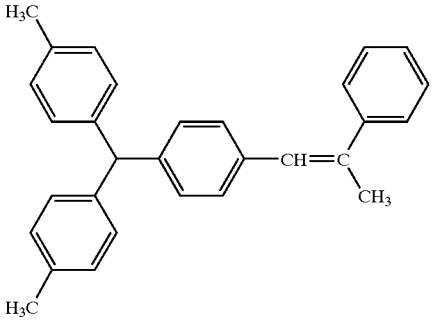
(HT2-47)
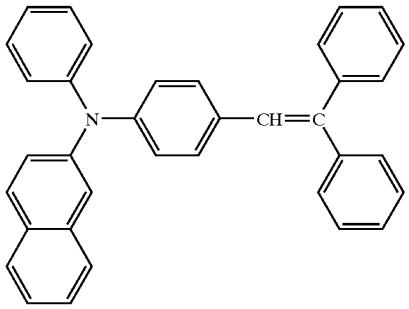
(HT2-48)
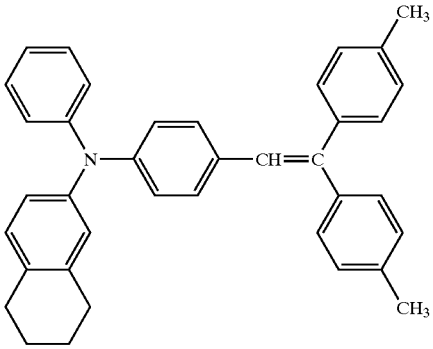
(HT2-49)
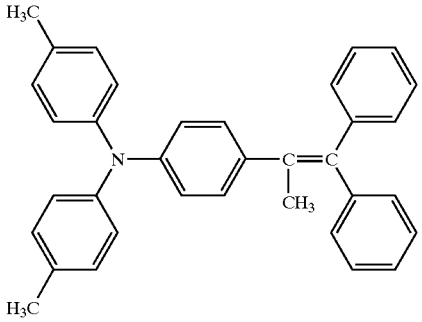
(HT2-50)
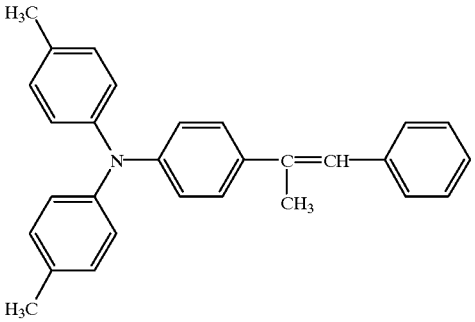
(HT2-51)
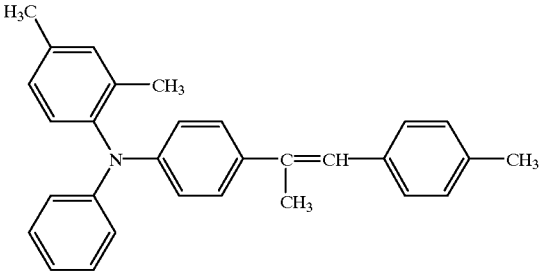

-continued
(HT2-52)
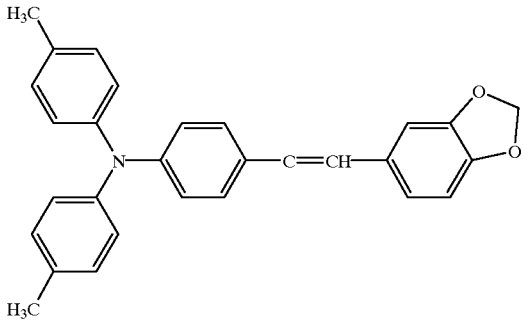
(HT2-53)
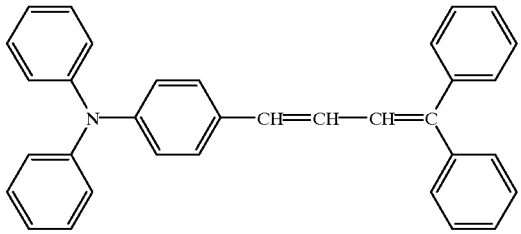
(HT2-54)
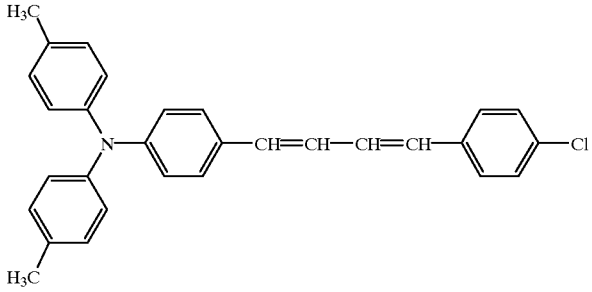
(HT2-55)
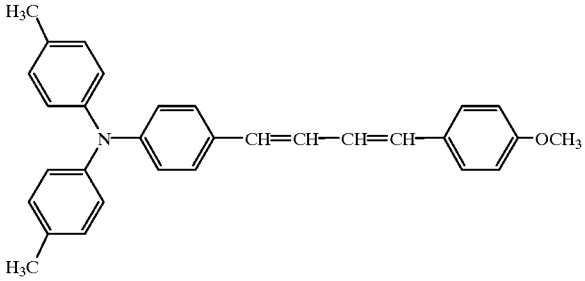
(HT2-56)
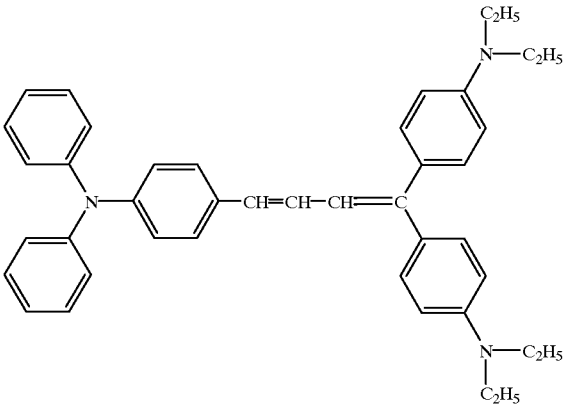
(HT2-57)
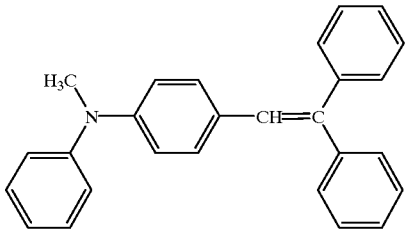
(HT2-58)
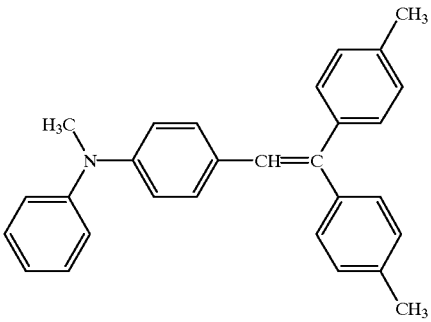
(HT2-59)
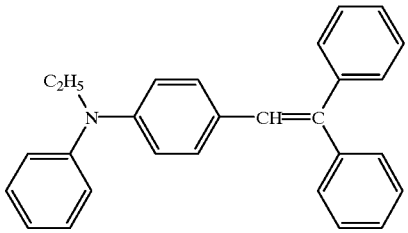

-continued
(HT2-60)
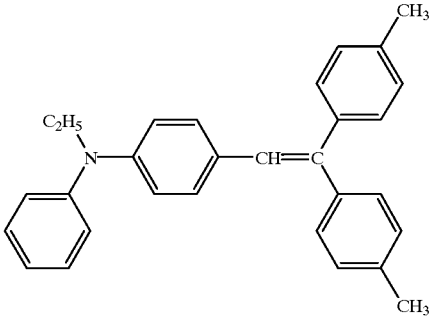
(HT2-61)
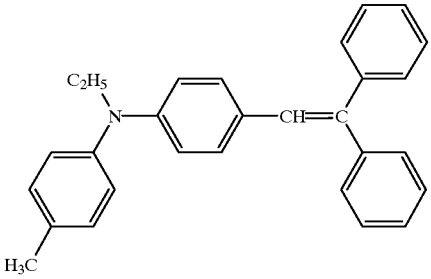
(HT2-62)
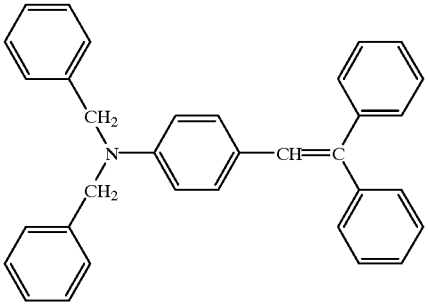
(HT2-63)
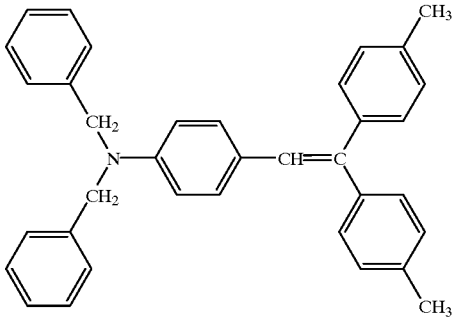
(HT2-64)
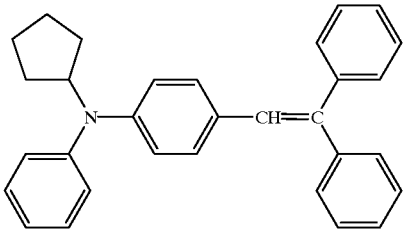
(HT2-65)
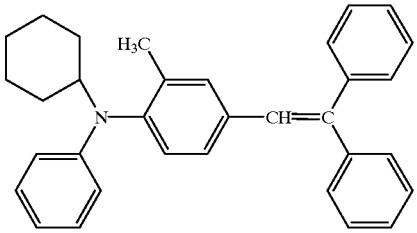
(HT2-66)
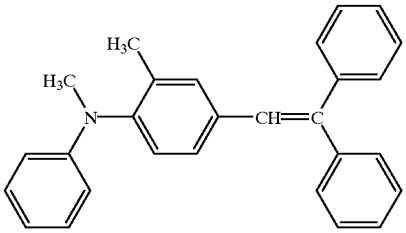
(HT2-67)
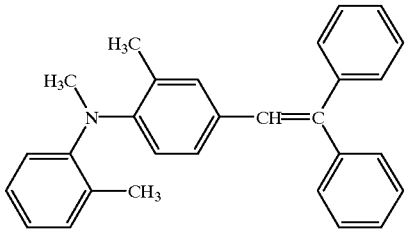
(HT2-68)
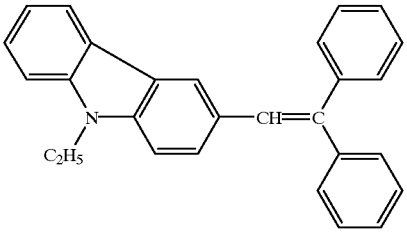
(HT2-69)
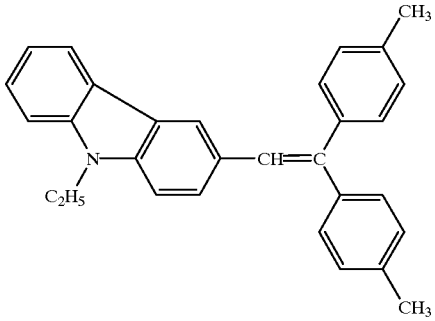

-continued
(HT2-70)
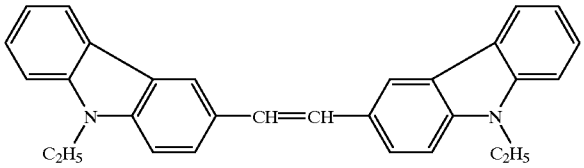
(HT3-1)
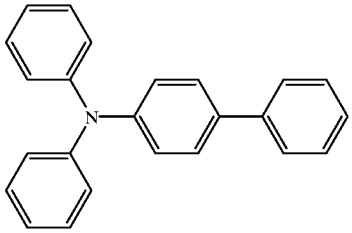
(HT3-2)
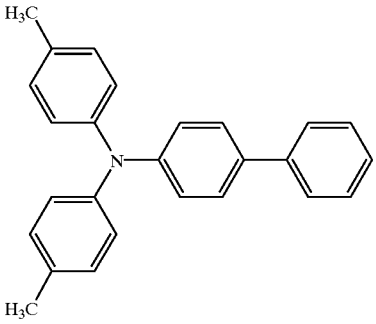
(HT3-3)
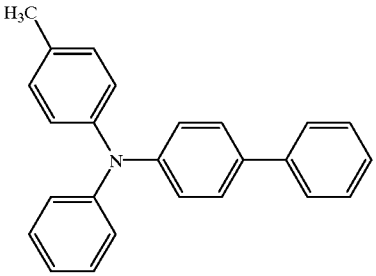
(HT3-4)
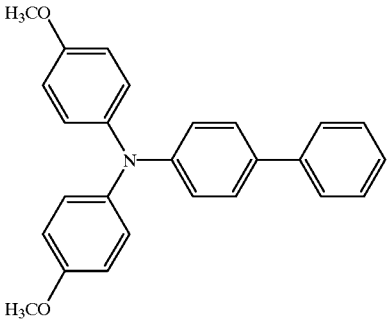
(HT3-5)
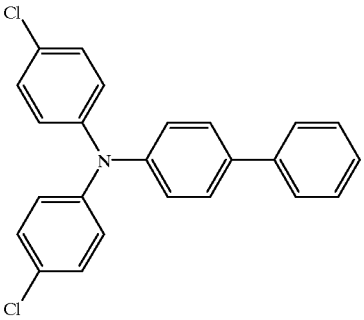
(HT3-6)
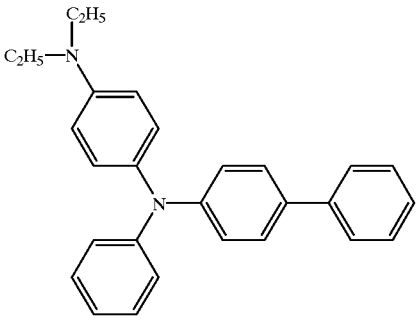
(HT3-7)
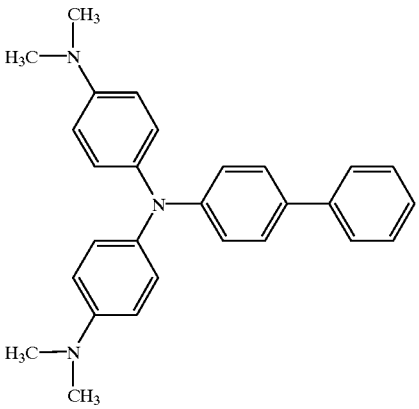

-continued
(HT3-8)
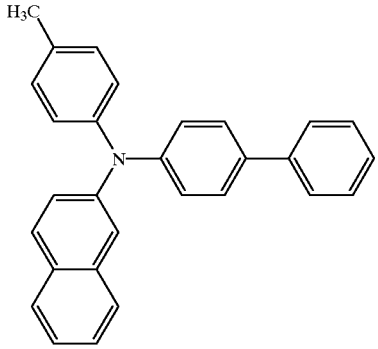
(HT3-9)
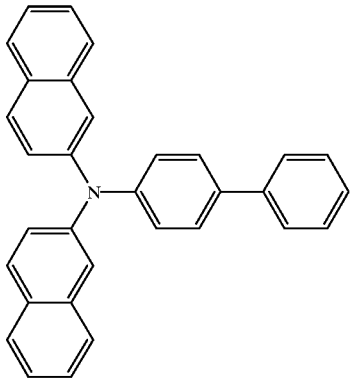
(HT3-10)
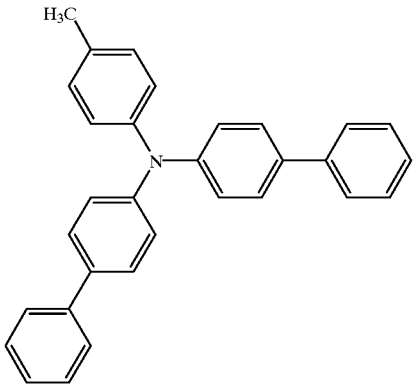
(HT3-11)
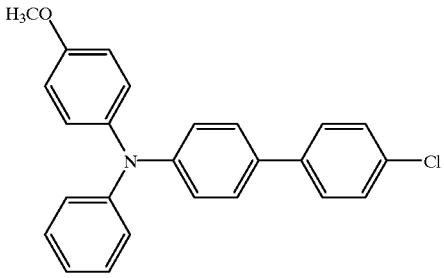
(HT3-12)
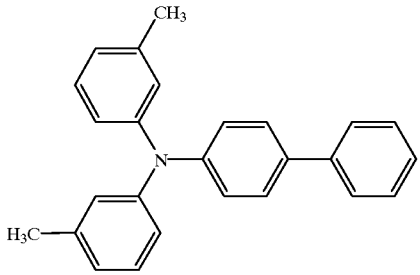
(HT3-13)
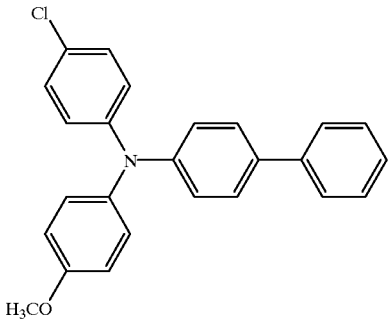
(HT3-14)
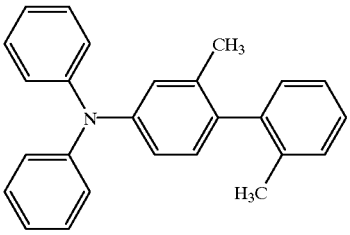
(HT3-15)
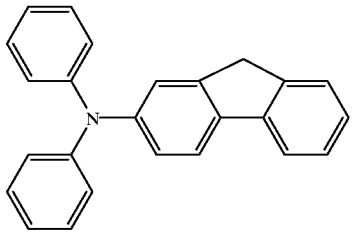

-continued
(HT3-16)
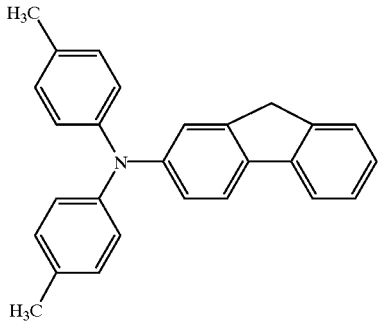
(HT3-17)
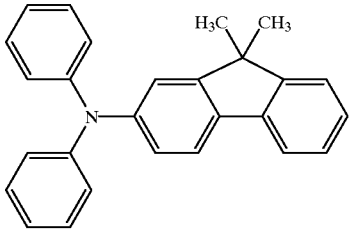
(HT3-18)
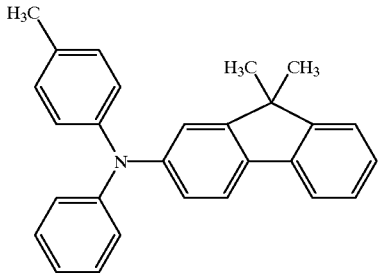
(HT3-19)
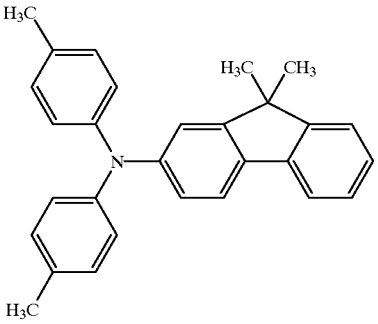
(HT3-20)
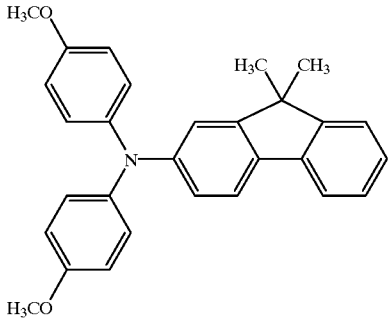
(HT3-21)
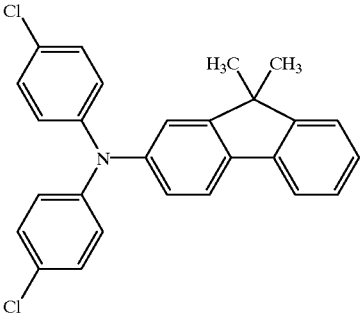
(HT3-22)
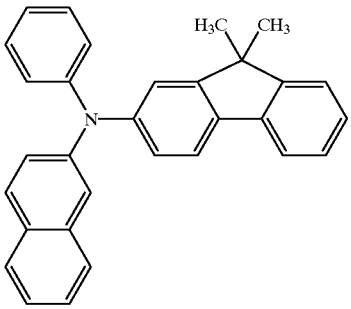
(HT3-23)
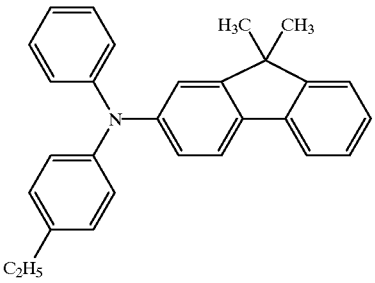

-continued
(HT3-24)
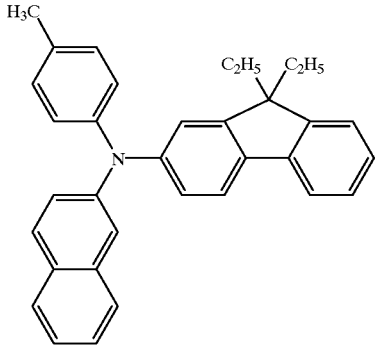
(HT3-25)
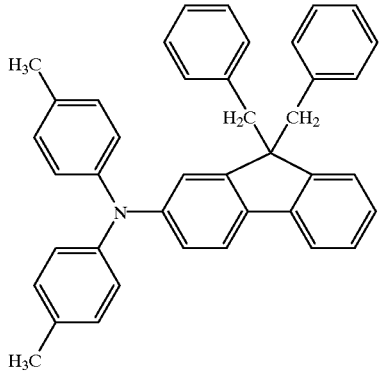
(HT3-26)
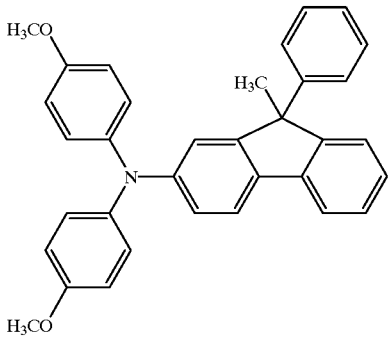
(HT3-27)
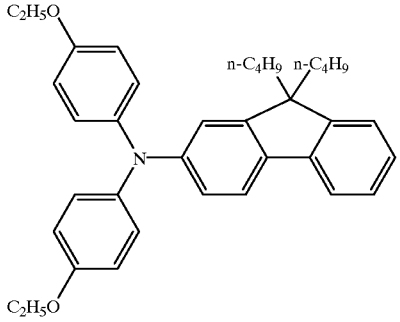
(HT3-28)
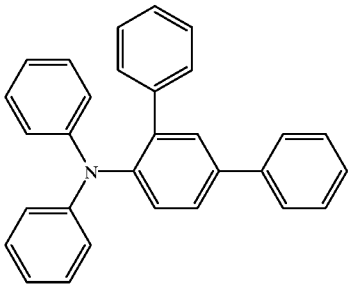
(HT3-29)
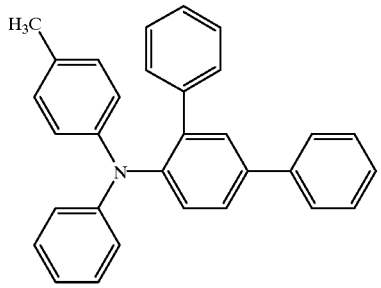
(HT3-30)
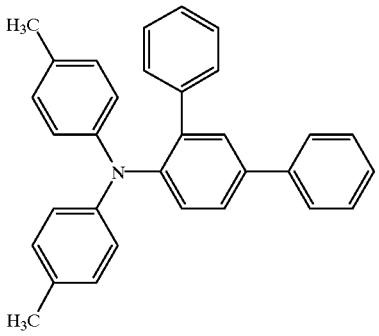
(HT3-31)
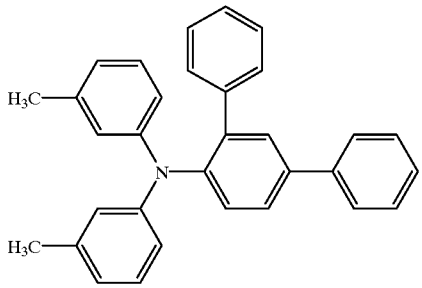

-continued
(HT3-32)
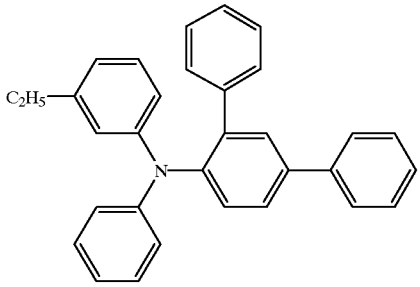
(HT3-33)
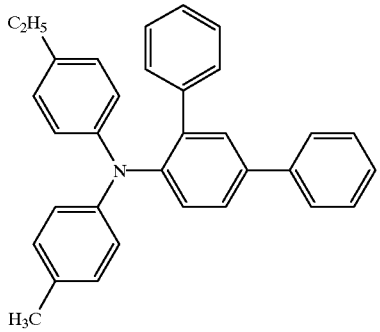
(HT3-34)
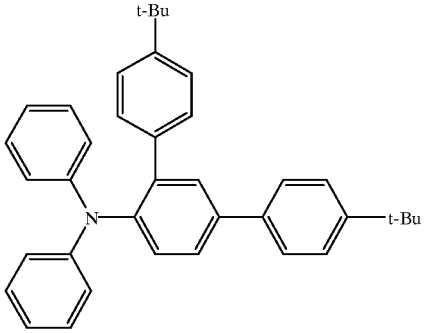
(HT3-35)
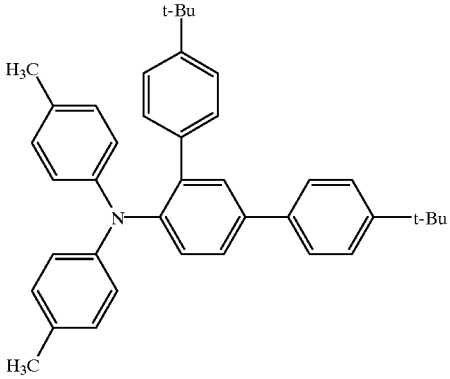
(HT3-36)
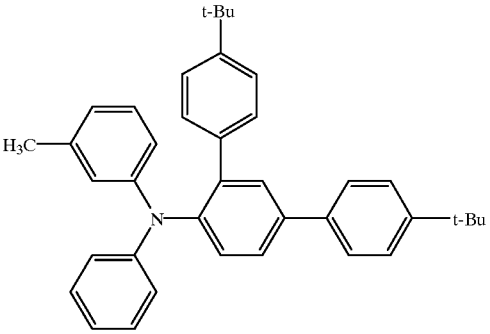
(HT3-37)
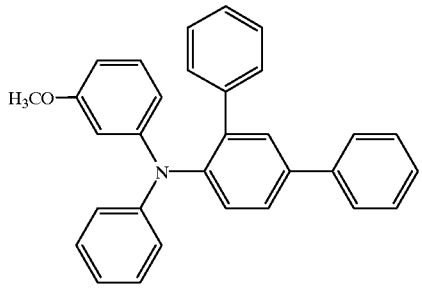
(HT3-38)
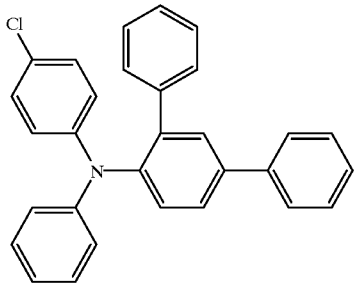
(HT3-39)
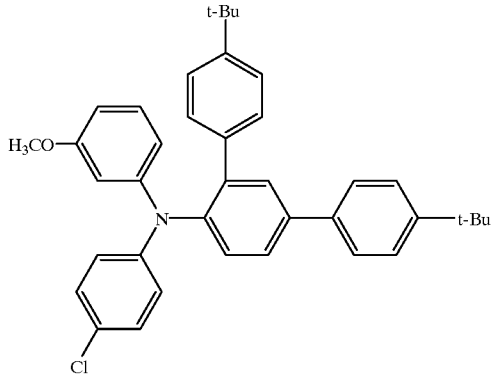

-continued
(HT4-1)
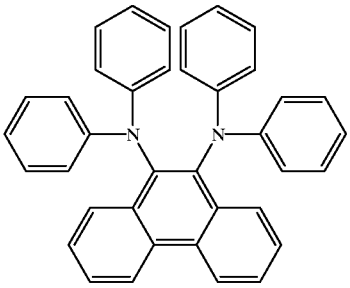
(HT4-2)
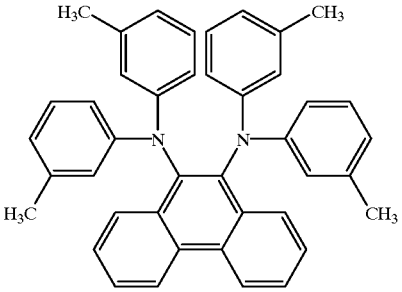
(HT4-3)
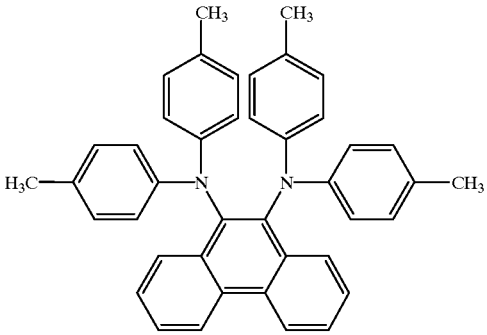
(HT4-4)
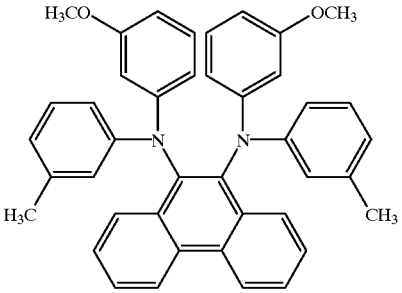
(HT4-5)
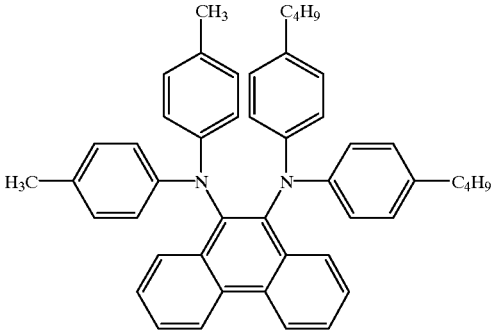
(HT4-6)
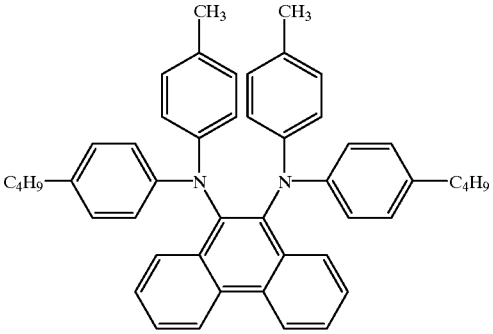
(HT4-7)
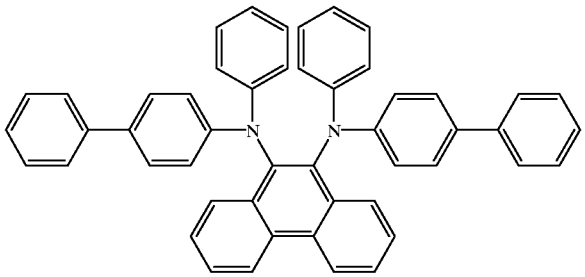

-continued
(HT4-8)
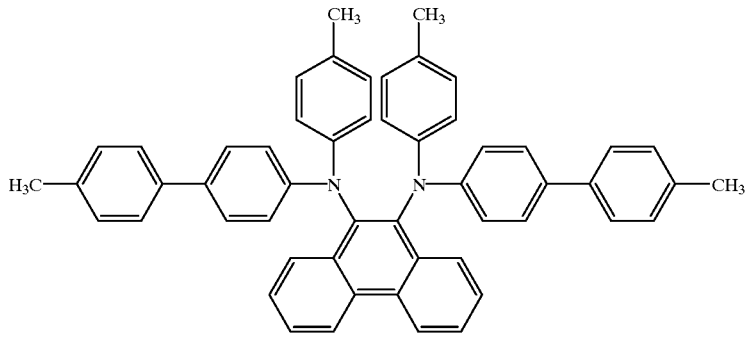
(HT4-9)
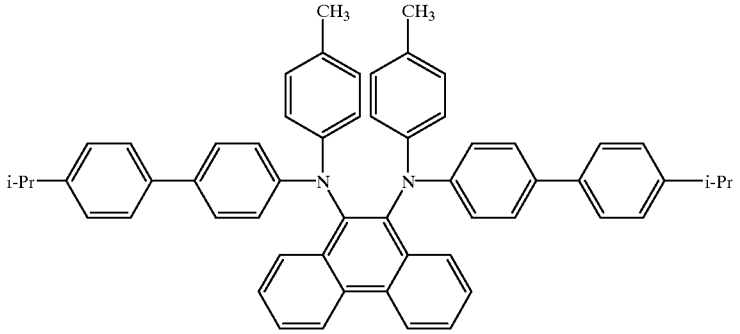
(HT4-10)
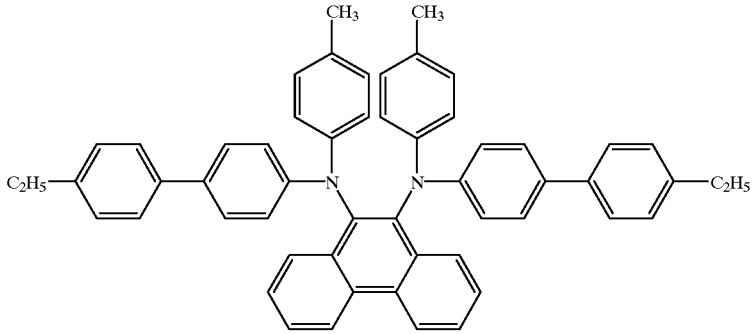
(HT4-11)
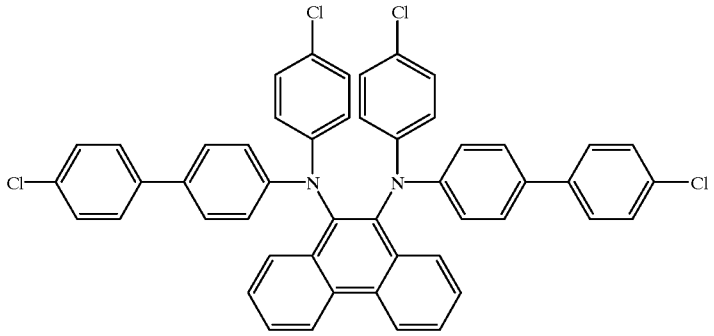

-continued
(HT4-12)
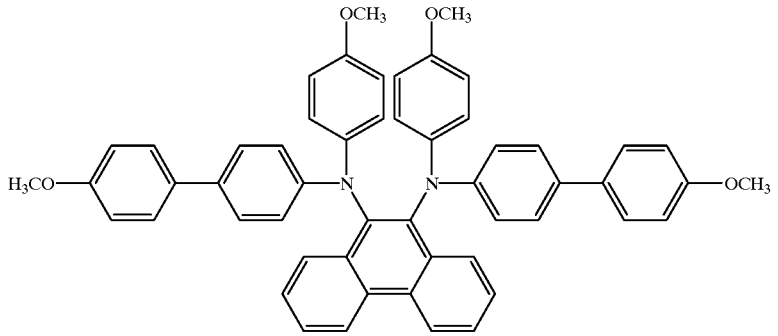
(HT4-13)
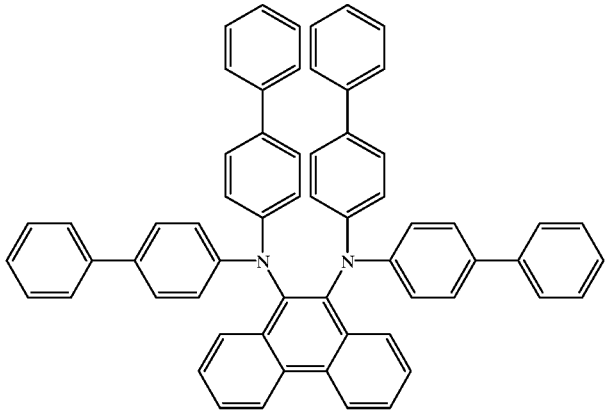
(HT4-14)
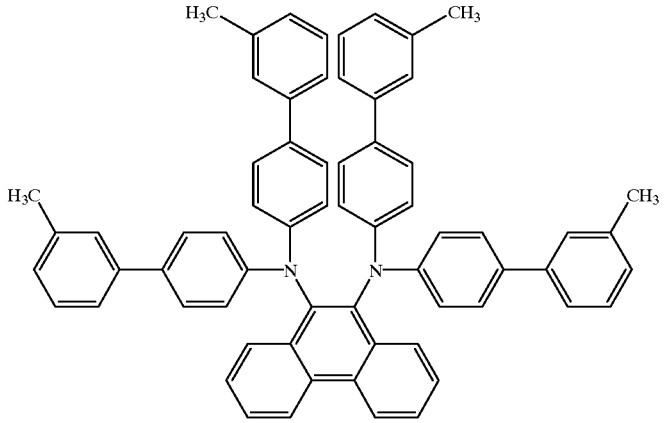

-continued
(HT4-15)
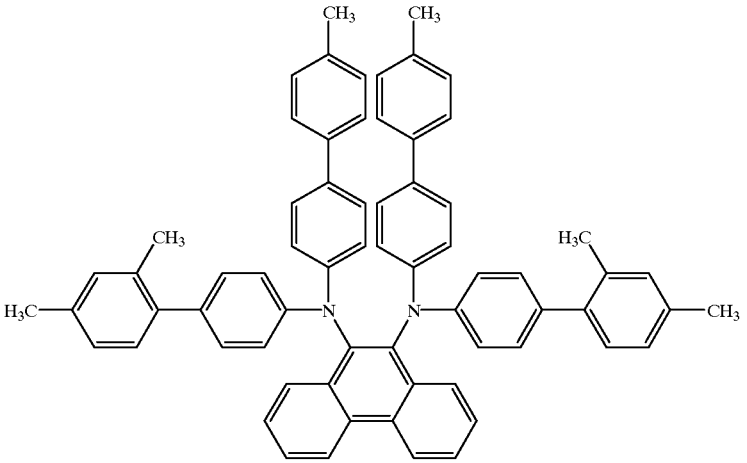
(HT4-16)
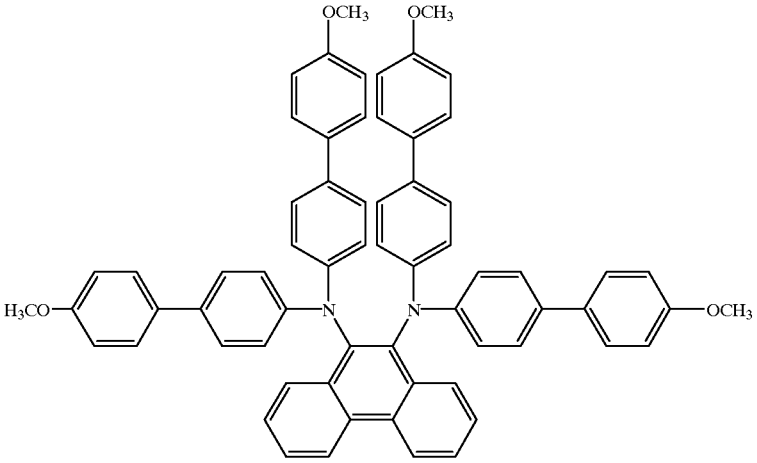
(HT4-17)
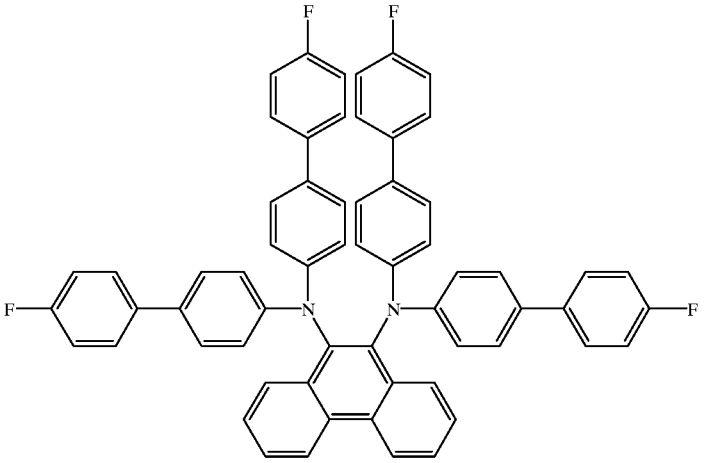

-continued
(HT4-18)
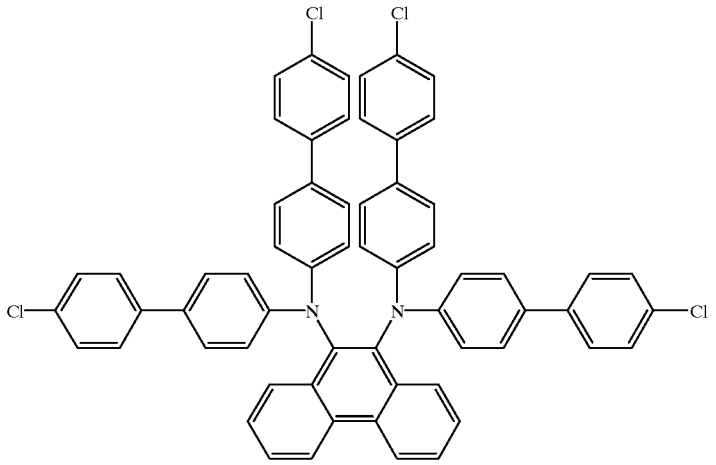
(HT4-19)
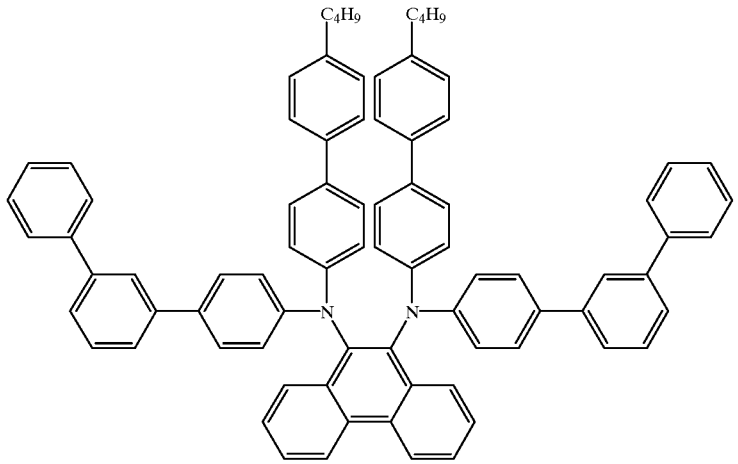
(HT4-20)
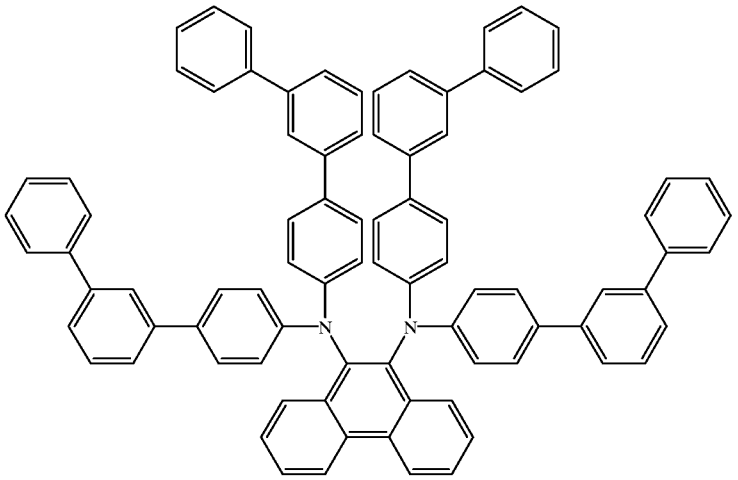

-continued
(HT-1)
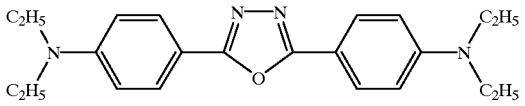
(HT-2)
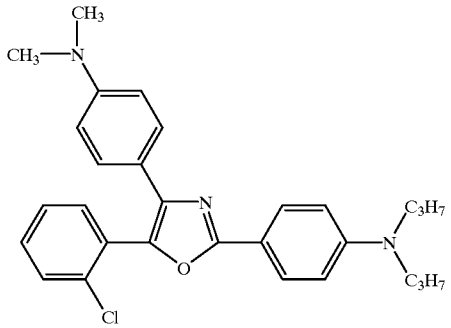
(HT-3)
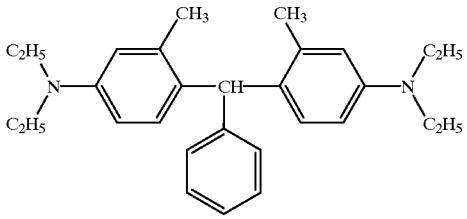
(HT-4)
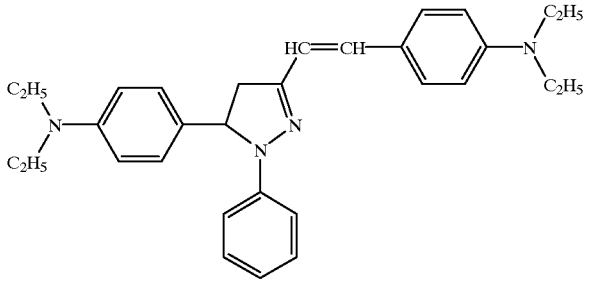
(HT-5)
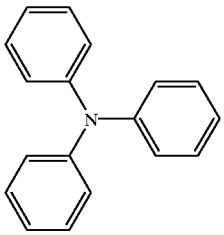
(HT-6)
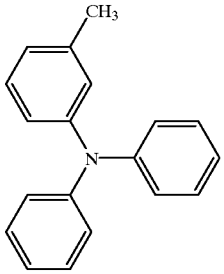
(HT-7)
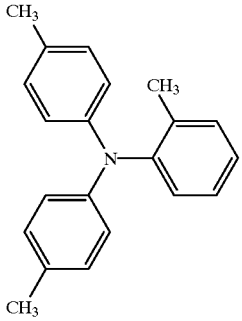
(HT-8)
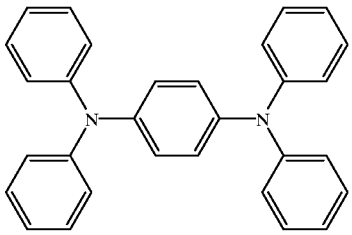
(HT-9)
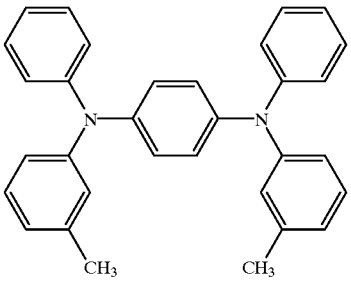
(HT-10)
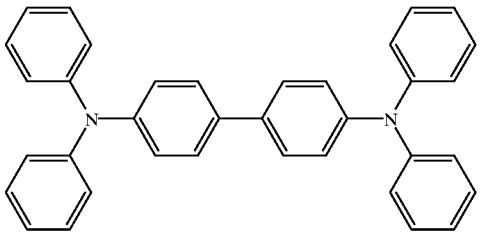

-continued
(HT-11)
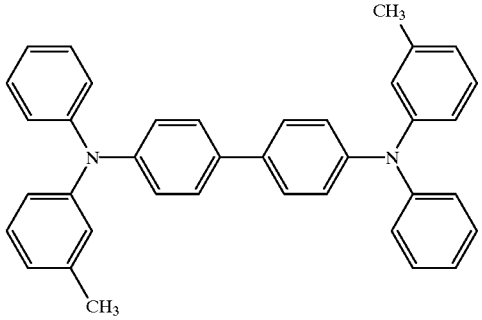
(HT-12)
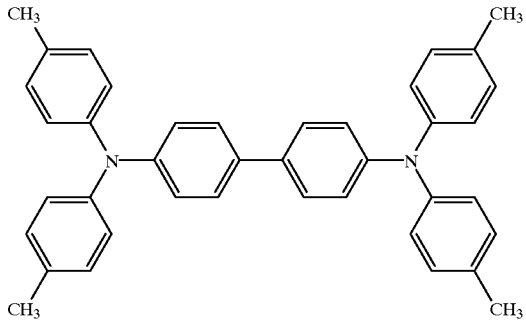
(HT-13)
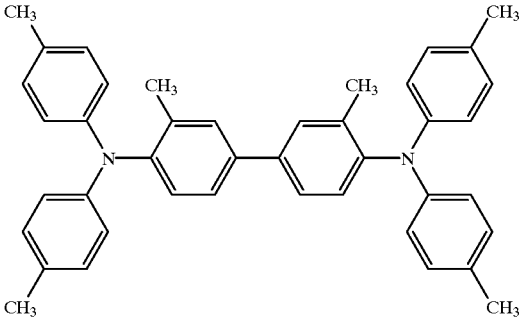
(HT-14)
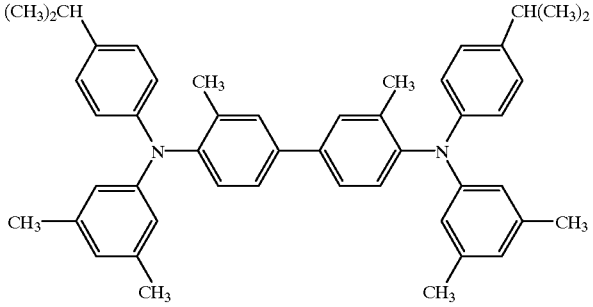
(HT-15)
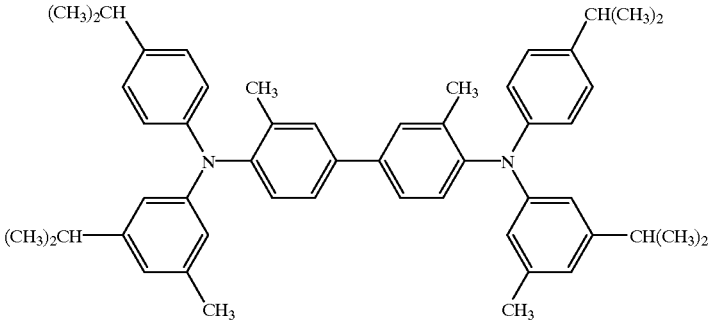
(HT-16)
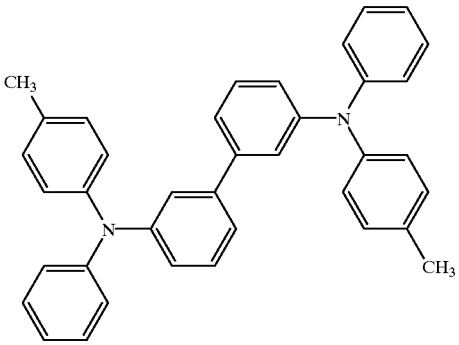
(HT-17)
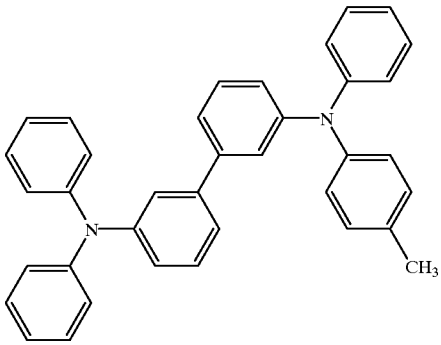

-continued
(HT-18)
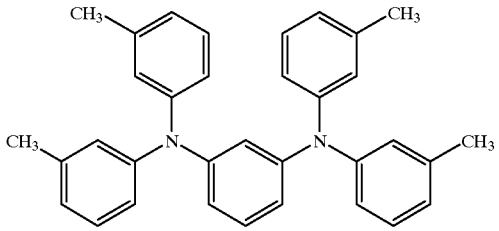
(HT-19)
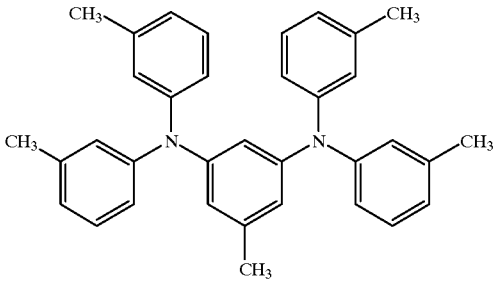
(HT-20)
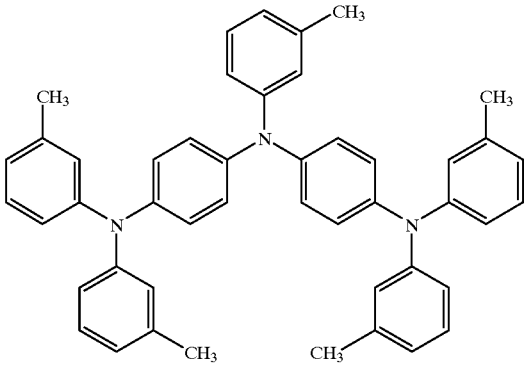
(HT-21)
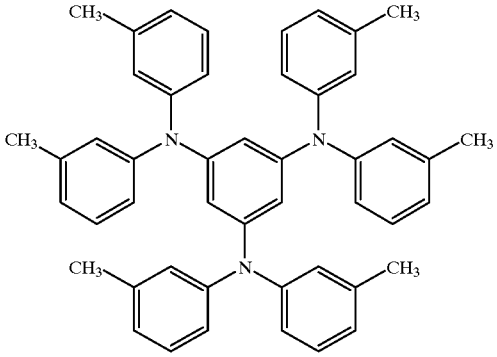
(HT-22)
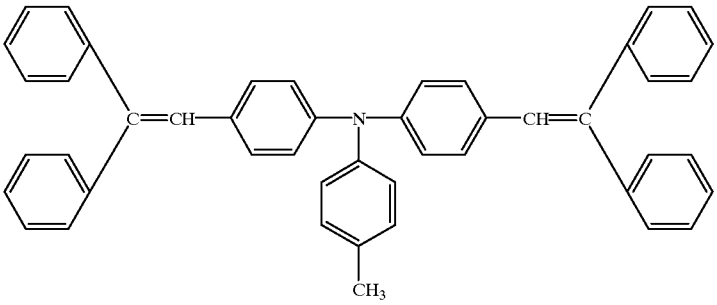
(HT-23)
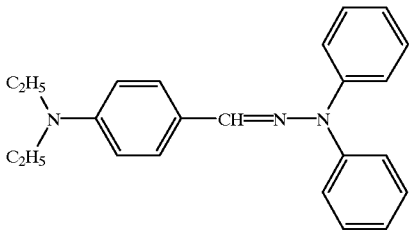
(HT-24)
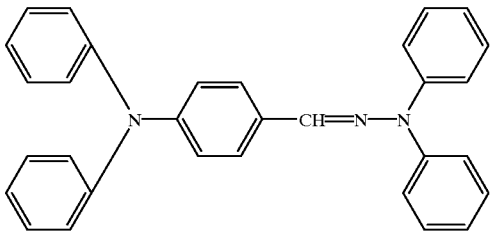
(HT-25)
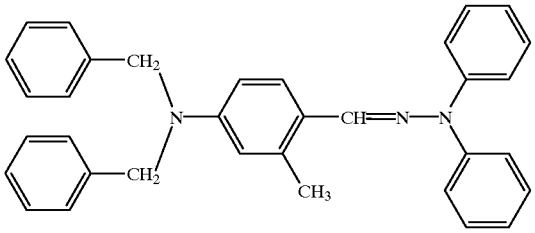
(HT-26)
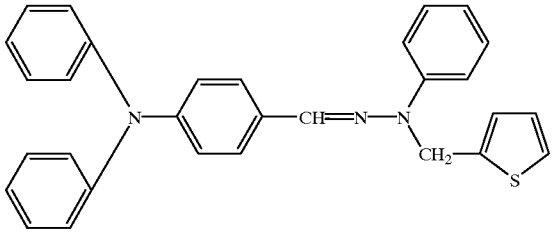

-continued
(HT-27)
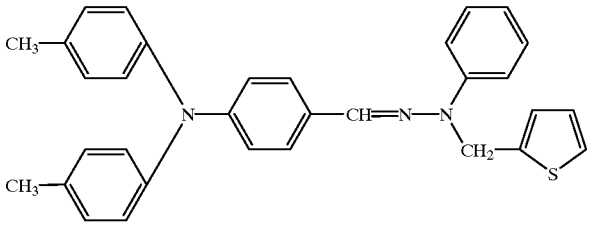
(HT-28)
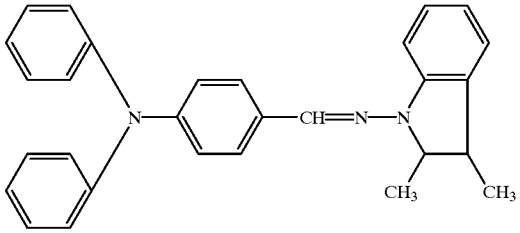
(HT-29)
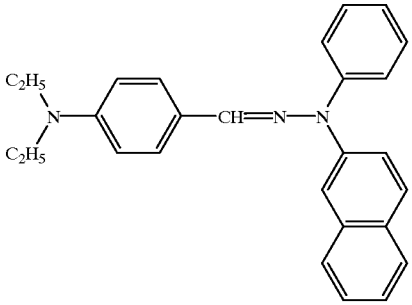
(HT-30)
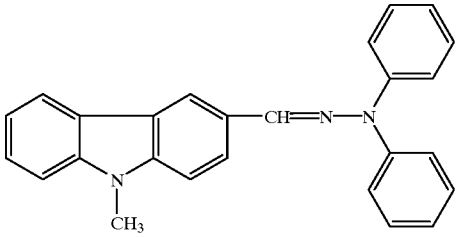
(HT-31)
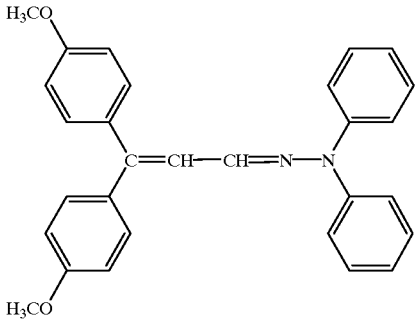
(HT-32)
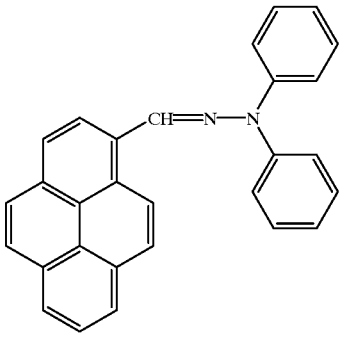
(HT-33)
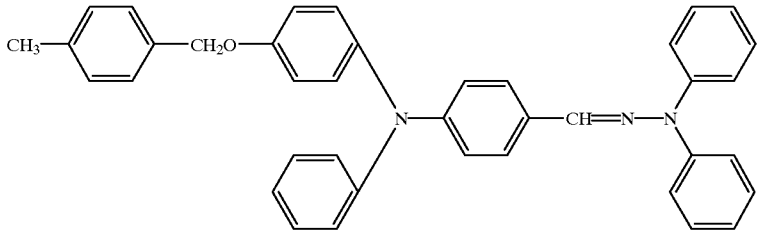
(HT-34)
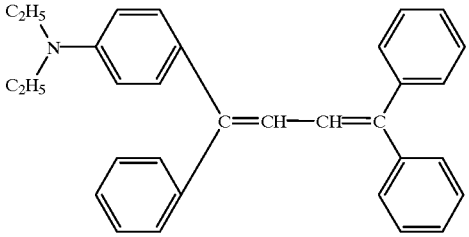
(HT-35)
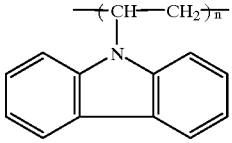

-continued (HT-36)

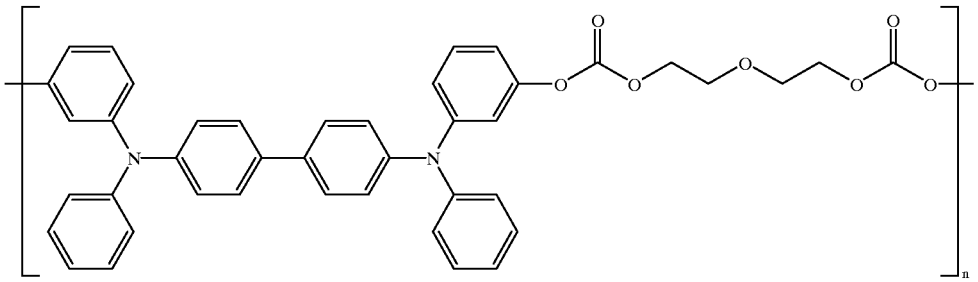

(HT-37)

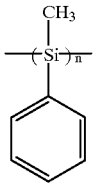

Furthermore, for the electron transport substance (acceptor compound), the compounds represented by the previous general formulas (ET1)~(ET4) are suitable. Additionally, succinic anhydride, maleic anhydride, dibromosuccinate anhydride, phthalic anhydride, 3-nitrophthalate anhydride, 4-nitrophthalate anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compound, quinone compound, benzoquinone compound, diphenoquinone compound, naphthoquinone compound, anthraquinone compound, duiminoquinone compound, stilbenequinone compound, and the like can be used. Furthermore, one type or two or more types of these electron transport substances can be combined and used. Concrete examples of the compounds represented by the previous general formula (ET1)~(ET4) include compounds with structural formulas shown in the following formulas (ET1-1)~(ET4-14). Furthermore, concrete examples of other electron transport substances include compounds with structural formulas represented by the following (ET-1)~(ET-42). However, the present invention is not limited to these. The content of the electron transport substance is 1~50 weight % with respect to the solid part of the photosensitive layer and is preferably 5~40 weight %.

(ET1-1)

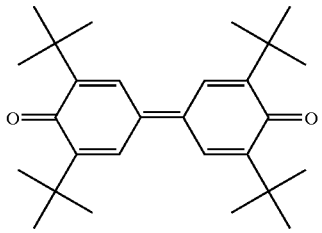

-continued (ET1-2)

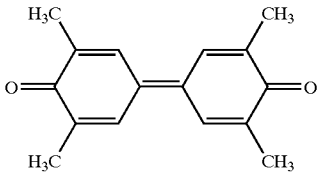

(ET1-3)

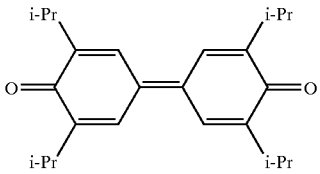

(ET1-4)

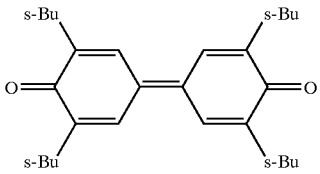

(ET1-5)

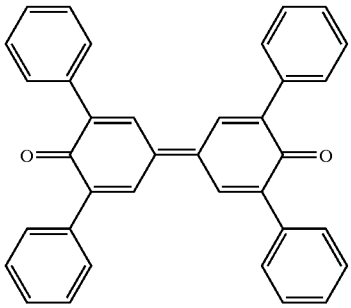

-continued
(ET1-6)
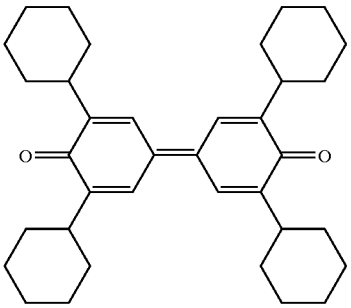
(ET1-7)
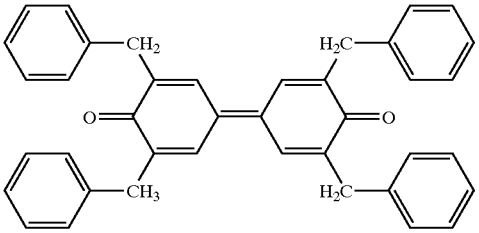
(ET1-8)
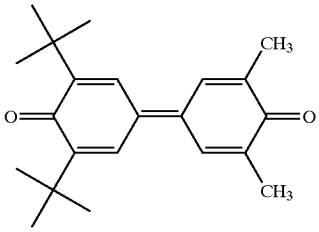
(ET1-9)
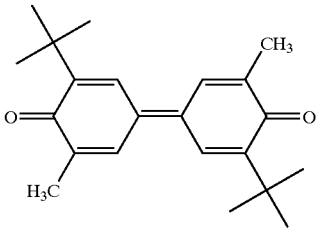
(ET1-10)
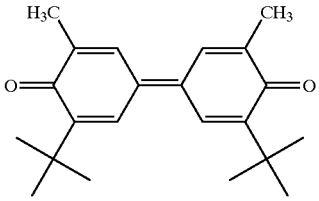
(ET1-11)
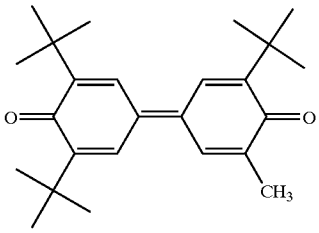
-continued
(ET1-12)
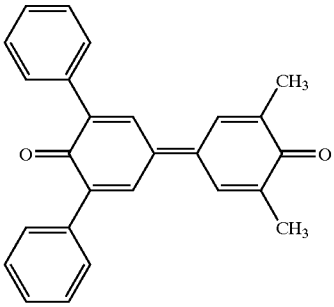
(ET1-13)
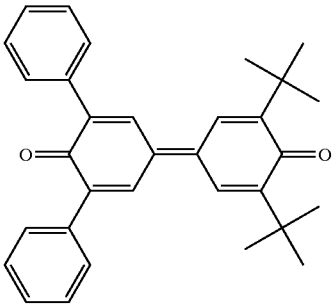
(ET1-14)
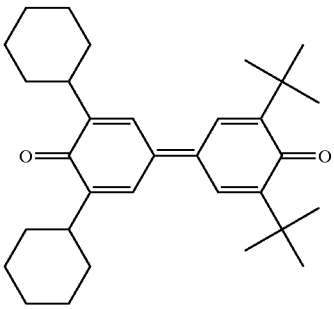
(ET1-15)
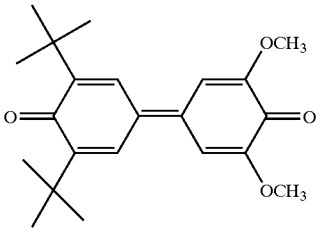
(ET1-16)
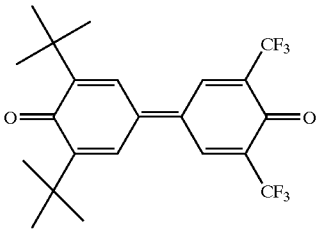
(ET2-1)
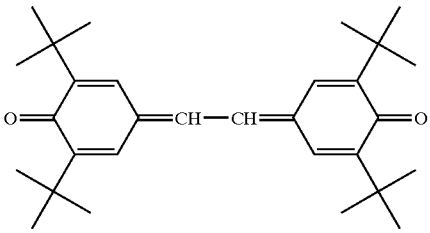

-continued
(ET2-2)
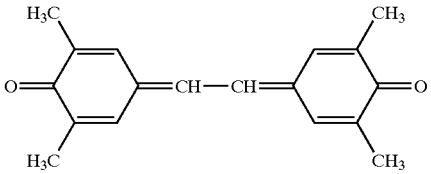
(ET2-3)
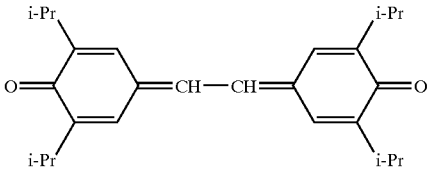
(ET2-4)
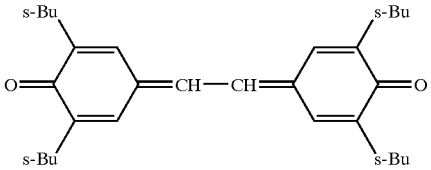
(ET2-5)
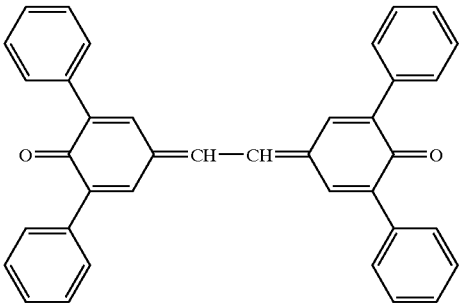
(ET2-6)
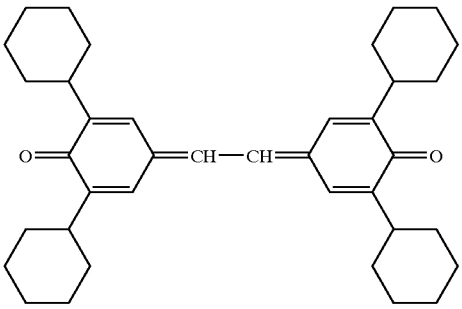
(ET2-7)
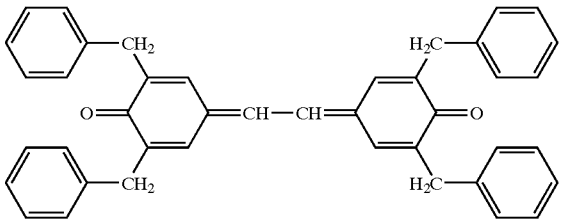
-continued
(ET2-8)
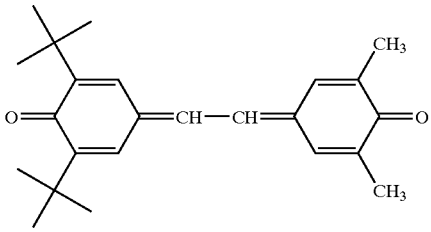
(ET2-9)
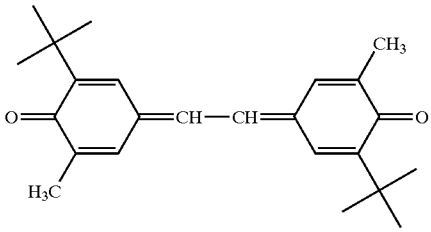
(ET2-10)
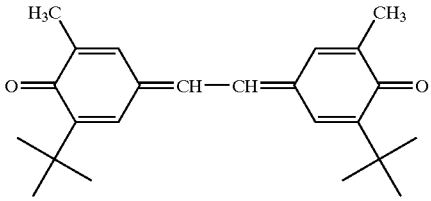
(ET2-11)
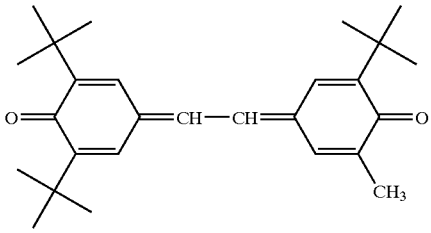
(ET2-12)
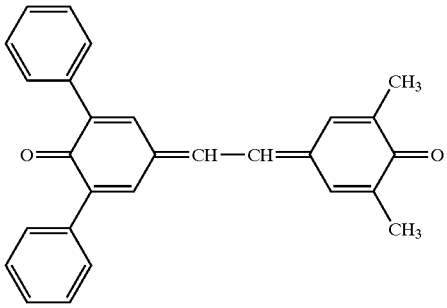
(ET2-13)
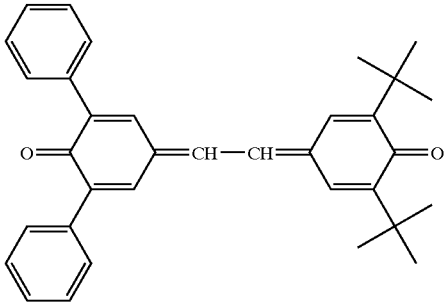

-continued
(ET2-14)
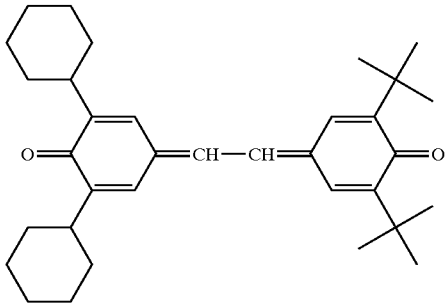
(ET2-15)
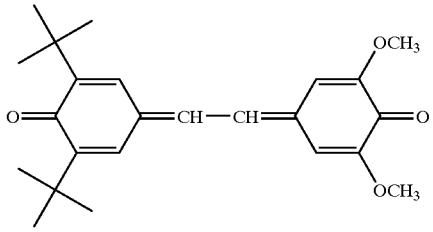
(ET2-16)
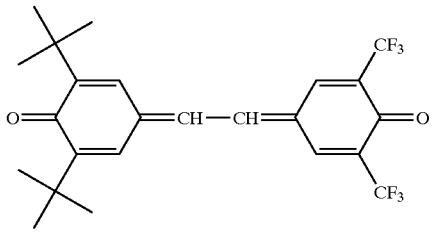
(ET3-1)
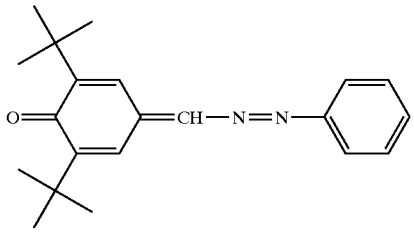
(ET3-2)
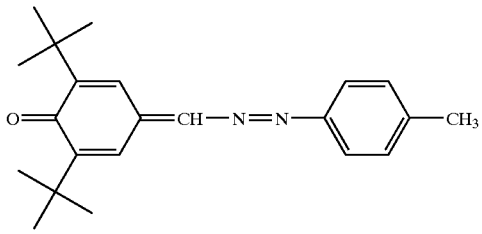
(ET3-3)
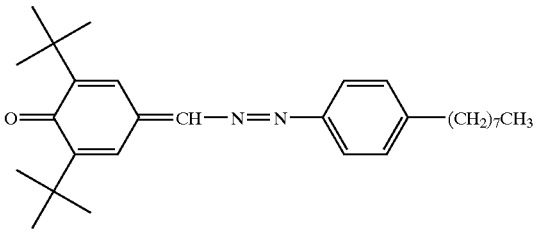
-continued
(ET3-4)
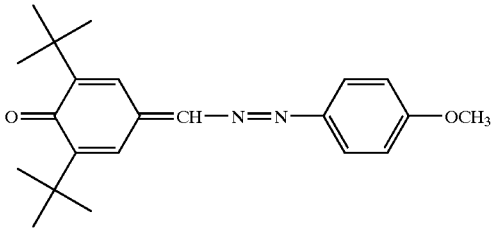
(ET3-5)
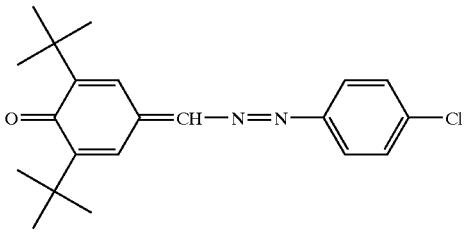
(ET3-6)
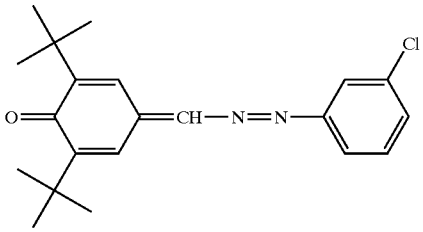
(ET3-7)
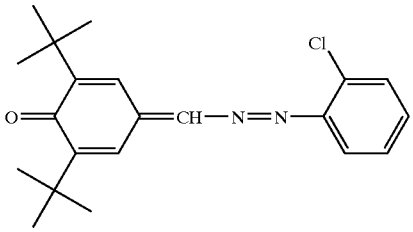
(ET3-8)
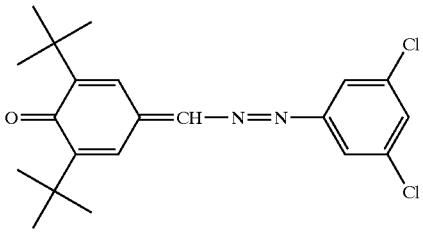
(ET3-9)
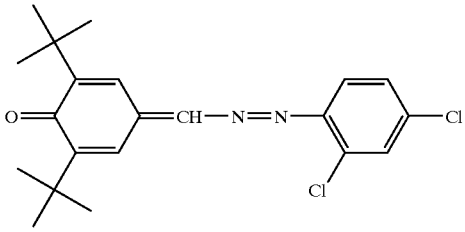

-continued
(ET3-10)
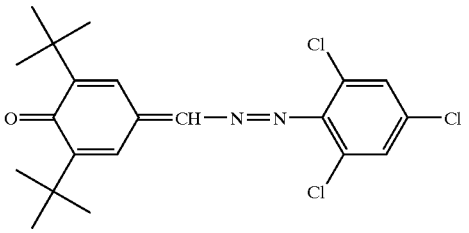
(ET3-11)
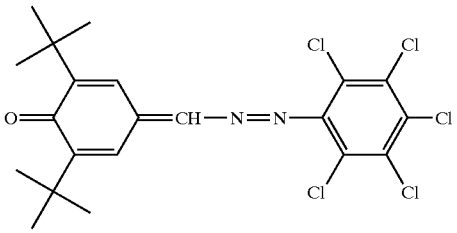
(ET3-12)
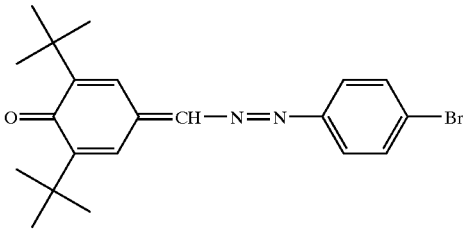
(ET3-13)
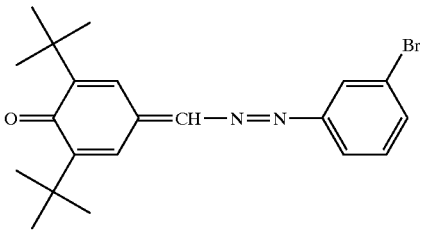
(ET3-14)
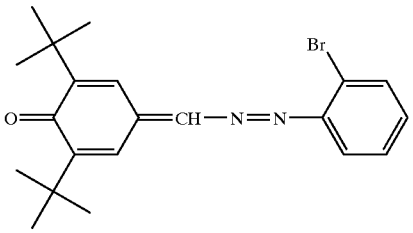
(ET3-15)
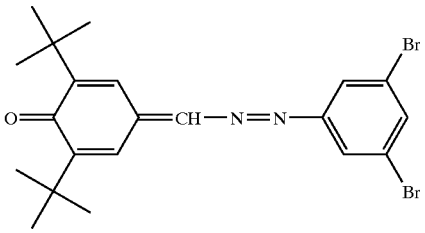
-continued
(ET3-16)
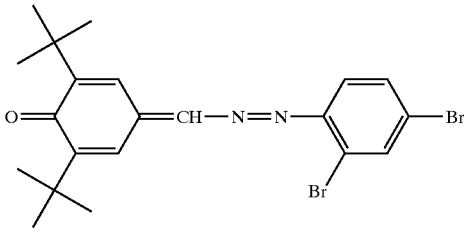
(ET3-17)
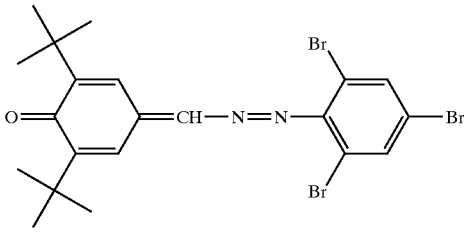
(ET3-18)
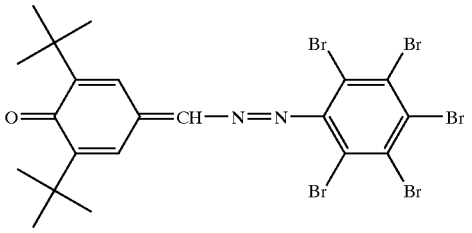
(ET3-19)
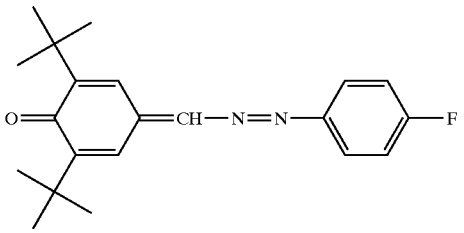
(ET3-20)
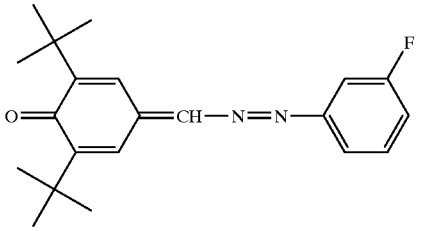
(ET3-21)
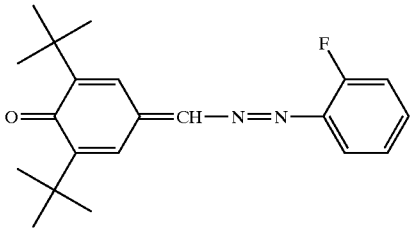

-continued
(ET3-22)
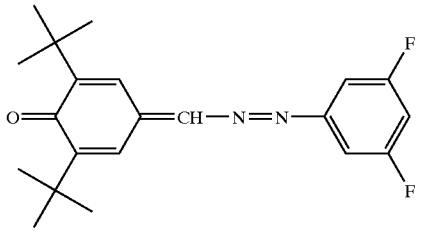
(ET3-23)
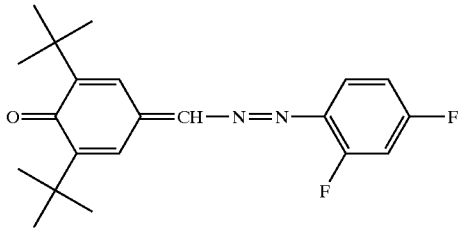
(ET3-24)
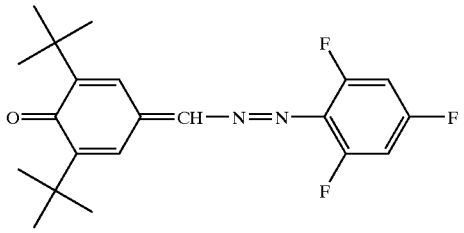
(ET3-25)
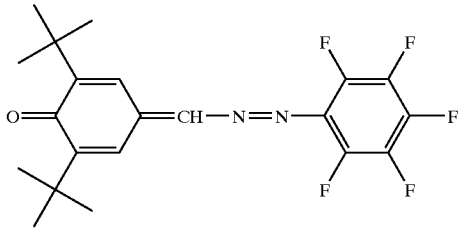
(ET3-26)
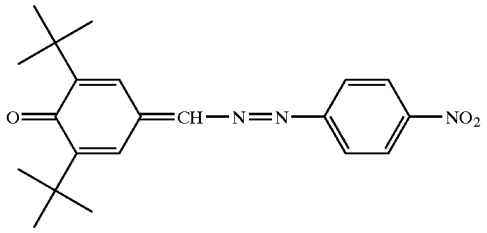
(ET3-27)
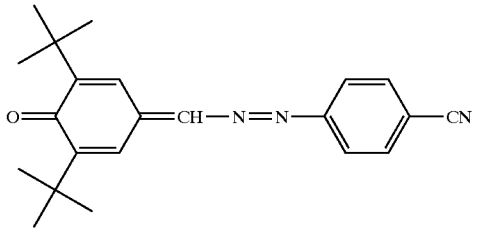
-continued
(ET3-28)
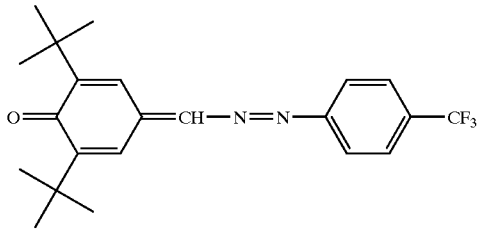
(ET3-29)
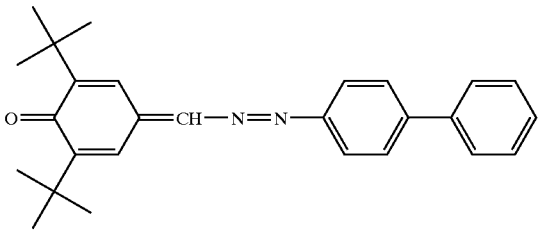
(ET3-30)
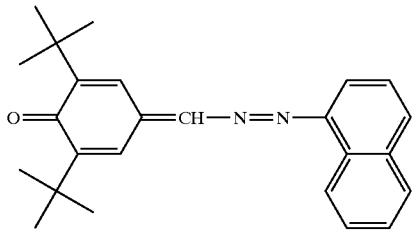
(ET3-31)
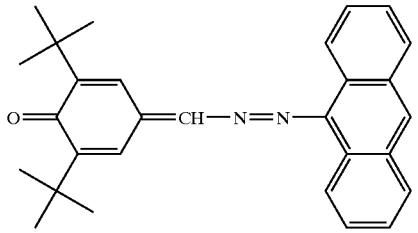
(ET3-32)
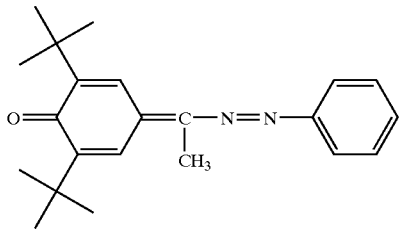
(ET3-33)
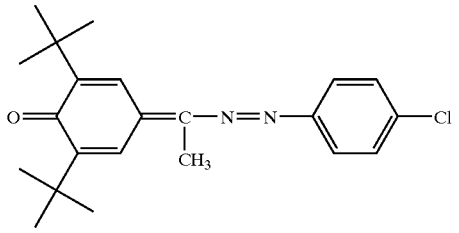

(ET3-34)
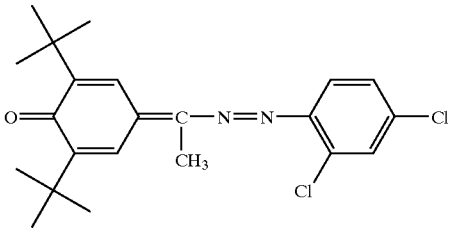
(ET3-35)
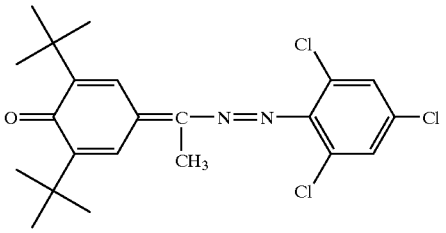
(ET3-36)
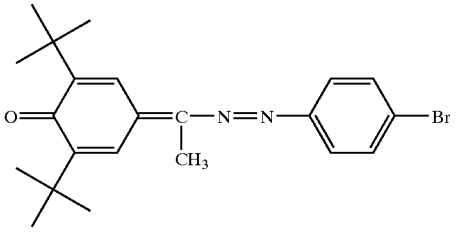
(ET3-37)
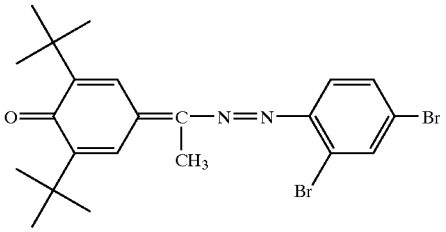
(ET3-38)
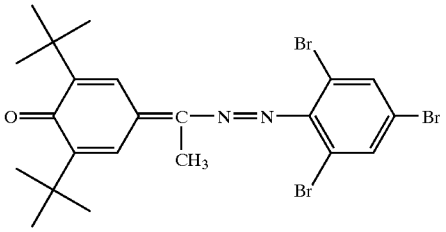
(ET3-39)
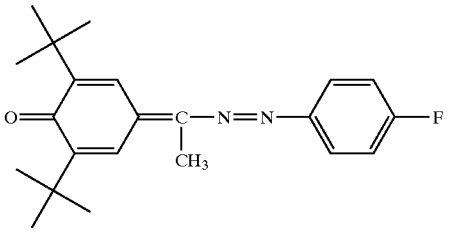
(ET3-40)
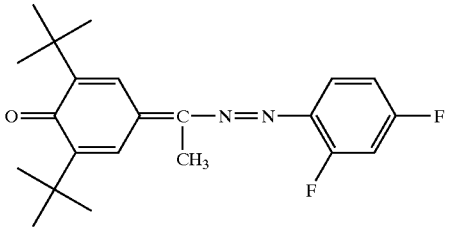
(ET3-41)
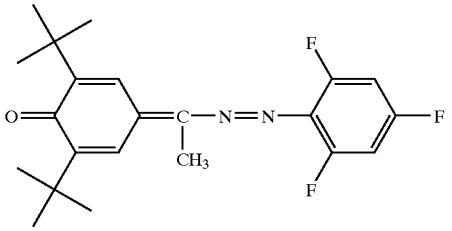
(ET3-42)
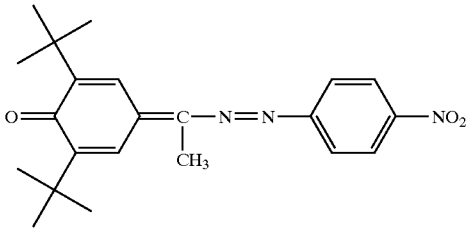
(ET3-43)
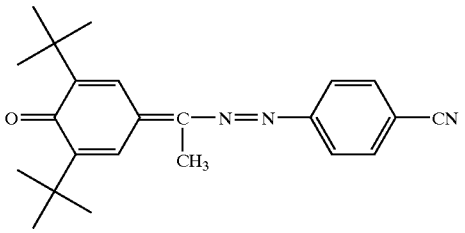
(ET3-44)
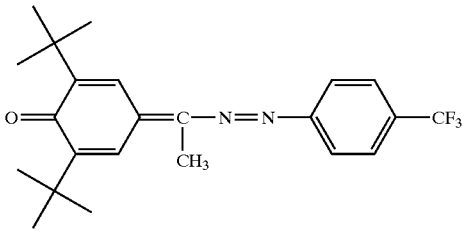
(ET3-45)
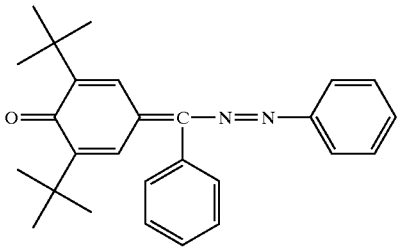

-continued
(ET3-46)
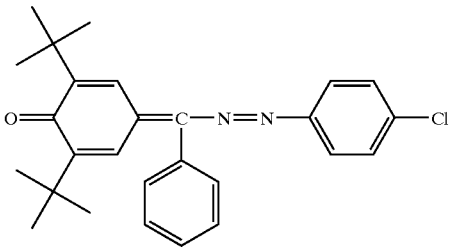
(ET3-47)
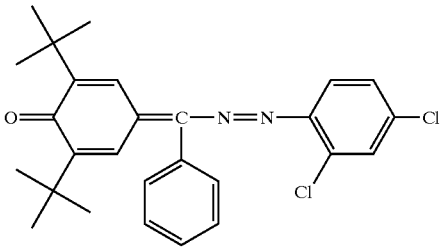
(ET3-48)
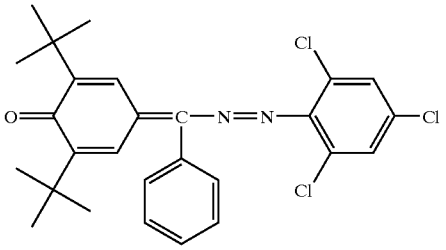
(ET3-49)
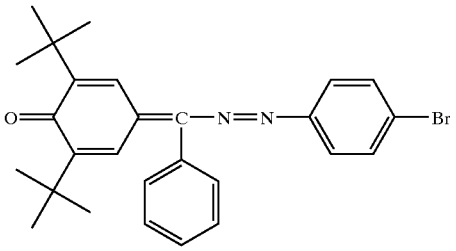
(ET3-50)
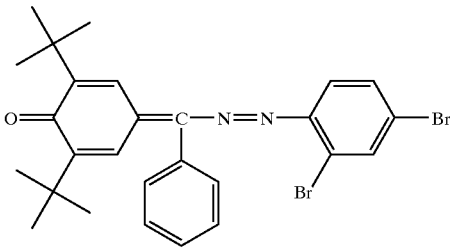
(ET3-51)
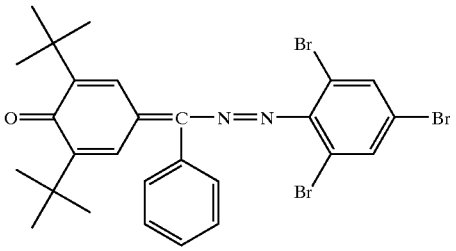
-continued
(ET3-52)
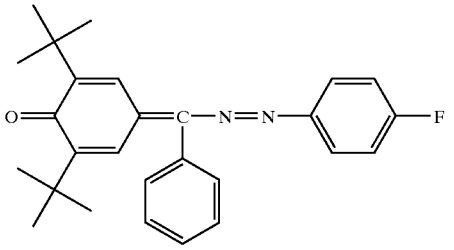
(ET3-53)
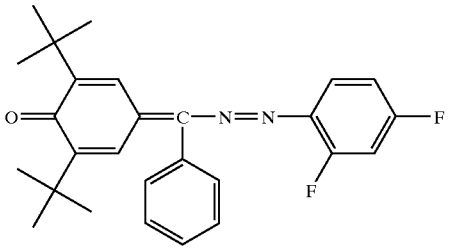
(ET3-54)
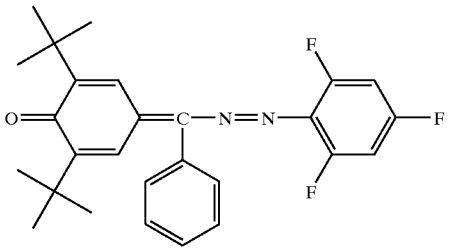
(ET3-55)
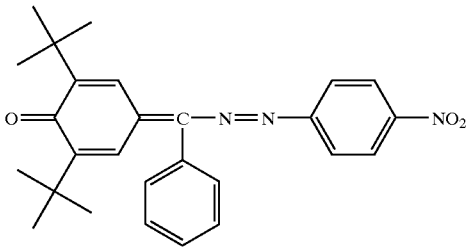
(ET3-56)
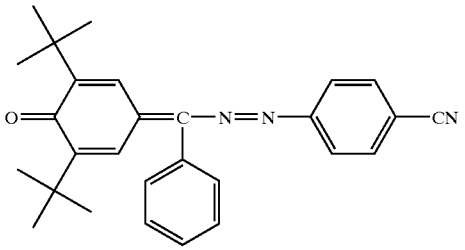
(ET3-57)
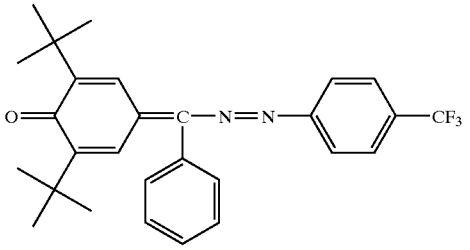

(ET3-58)
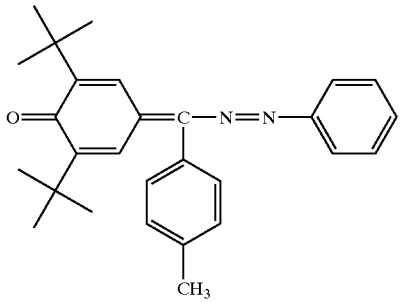
(ET3-59)
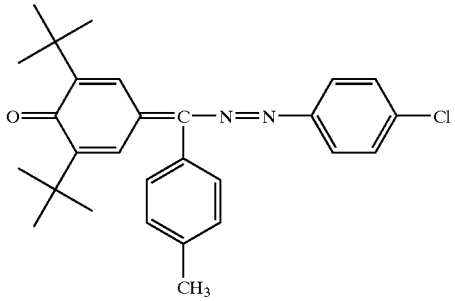
(ET3-60)
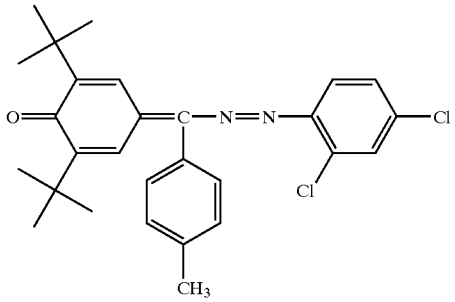
(ET3-61)
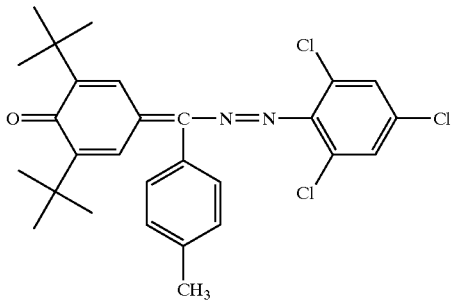
(ET3-62)
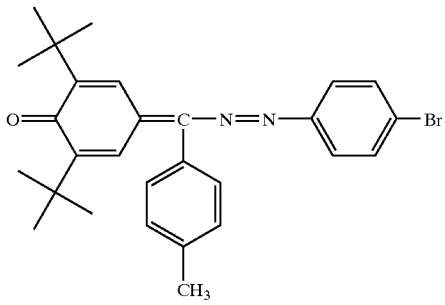
(ET3-63)
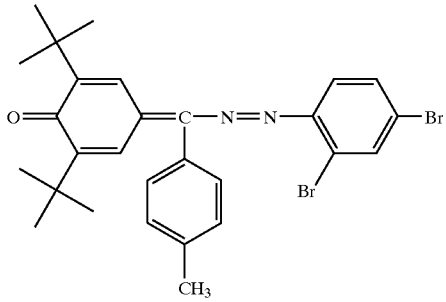
(ET3-64)
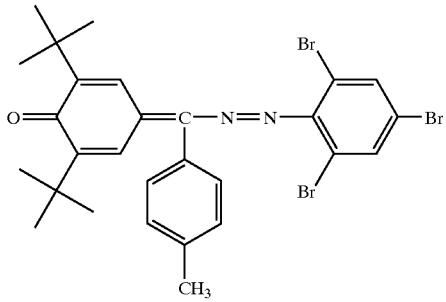
(ET3-65)
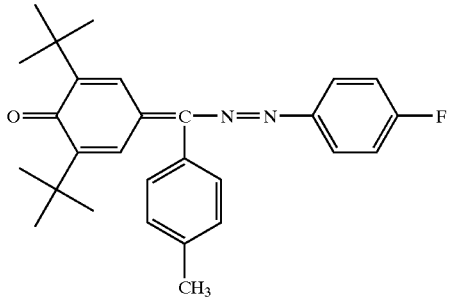
(ET3-66)
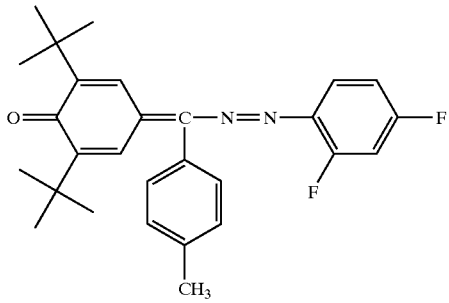
(ET3-67)
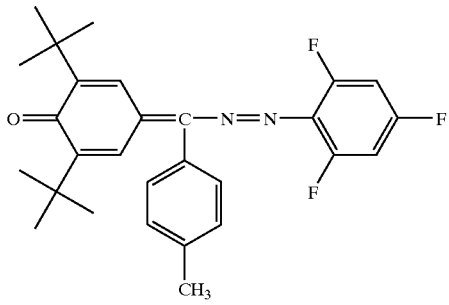

(ET3-68)
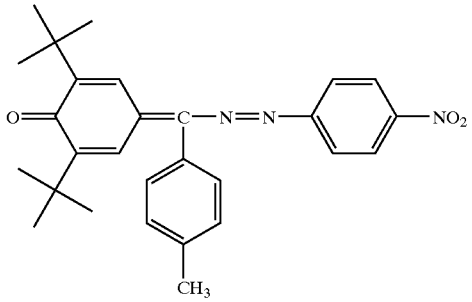
(ET3-69)
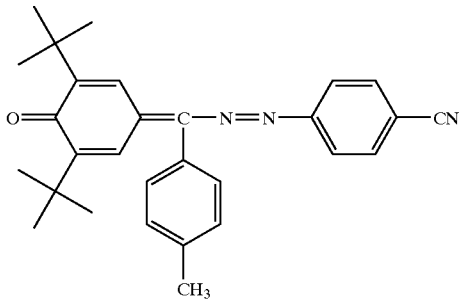
(ET3-70)
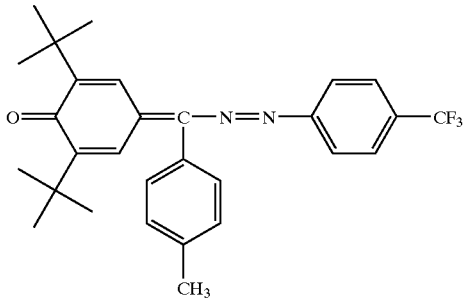
(ET3-71)
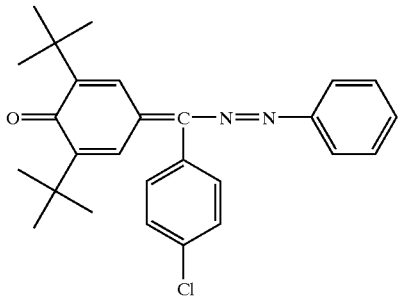
(ET3-72)
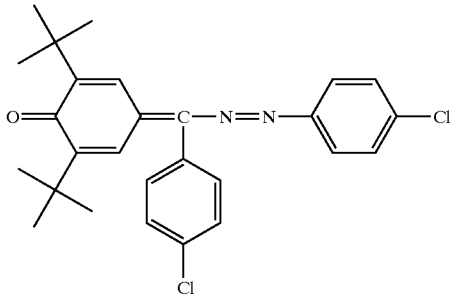
(ET3-73)
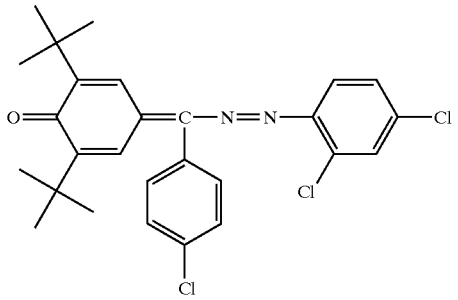
(ET3-74)
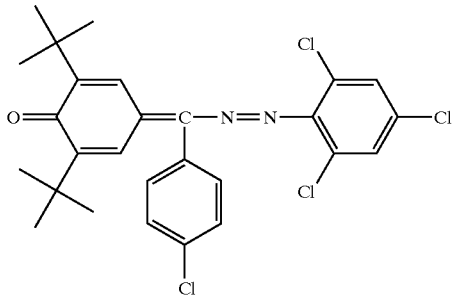
(ET3-75)
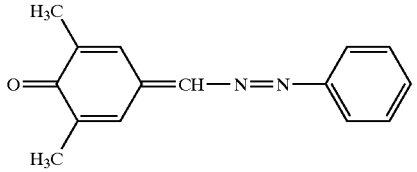
(ET3-76)
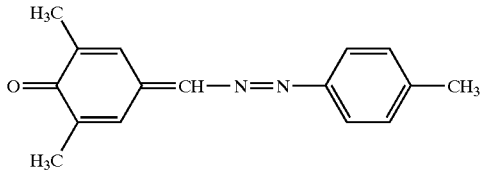
(ET3-77)
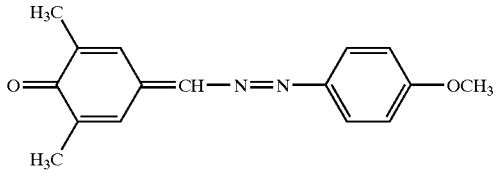
(ET3-78)
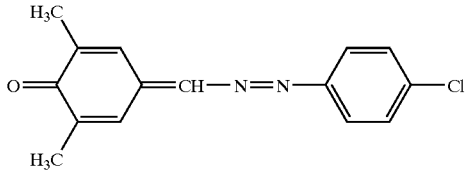
(ET3-79)
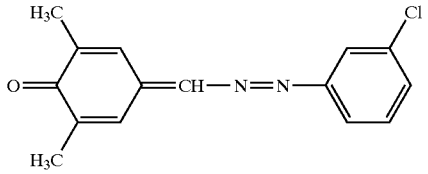

-continued
(ET3-80)
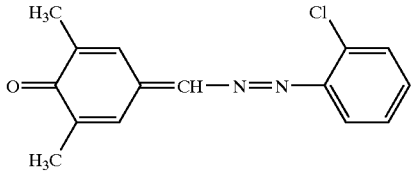
(ET3-81)
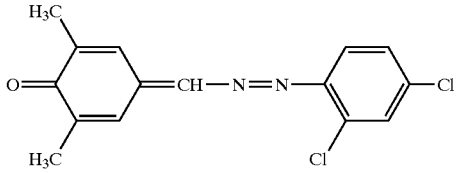
(ET3-82)
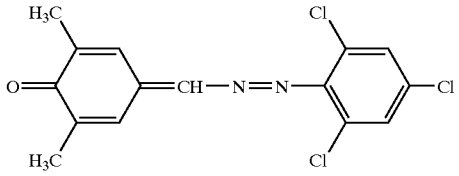
(ET3-83)
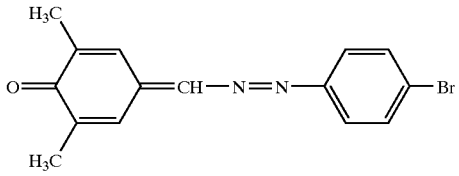
(ET3-84)
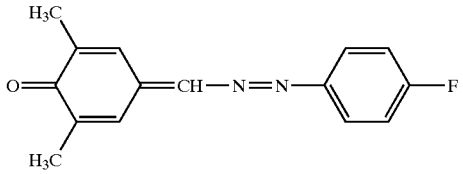
(ET3-85)
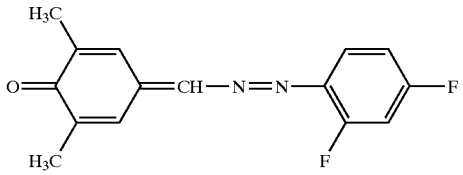
(ET3-86)
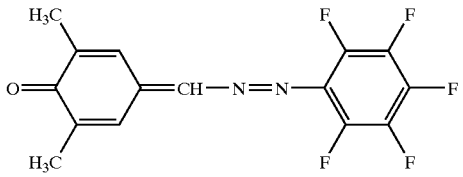
(ET3-87)
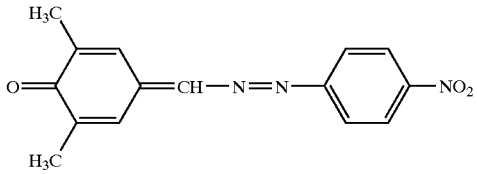
-continued
(ET3-88)
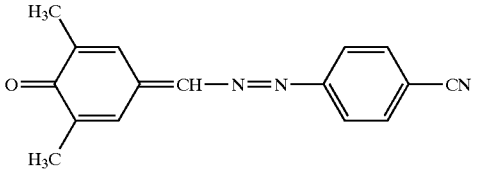
(ET3-89)
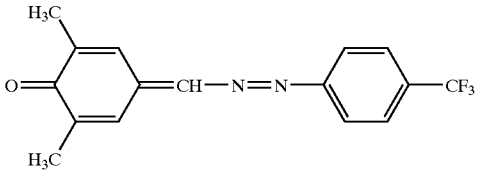
(ET3-90)
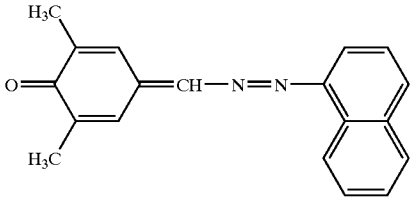
(ET3-91)
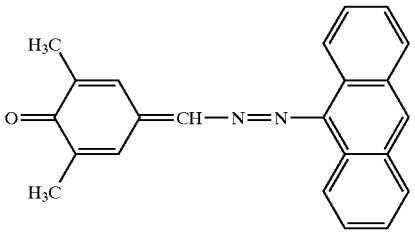
(ET3-92)
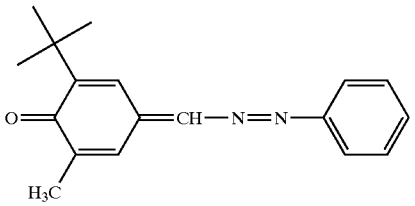
(ET3-93)
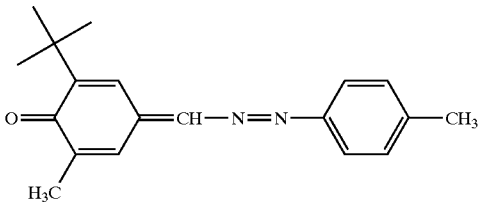
(ET3-94)
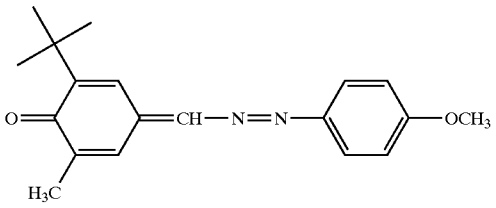

-continued
(ET3-95)
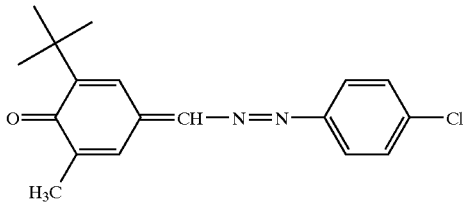
(ET3-96)
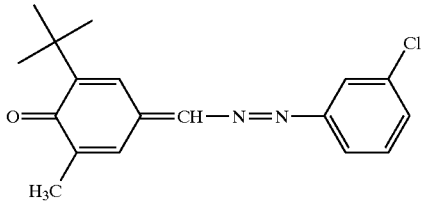
(ET3-97)
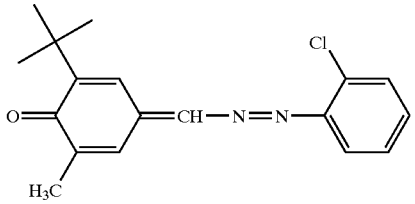
(ET3-98)
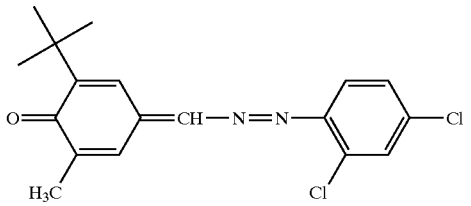
(ET3-99)
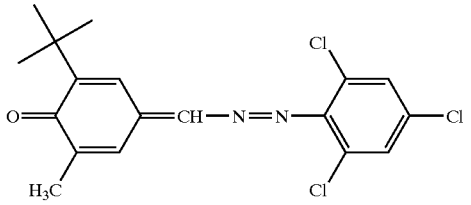
(ET3-100)
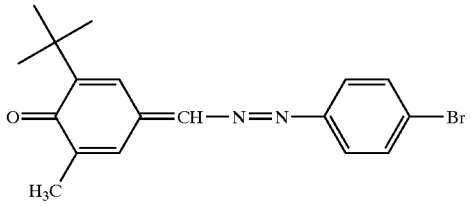
(ET3-101)
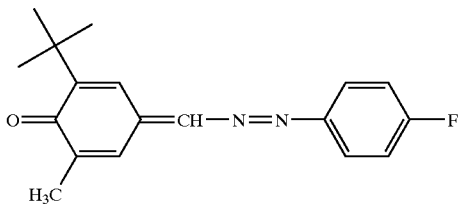
-continued
(ET3-102)
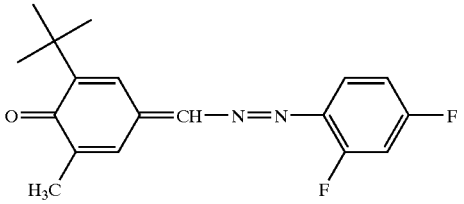
(ET3-103)
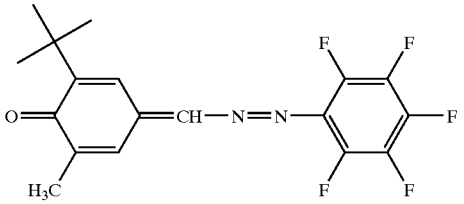
(ET3-104)
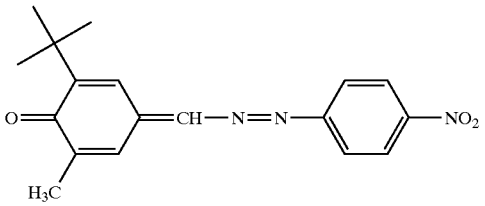
(ET3-105)
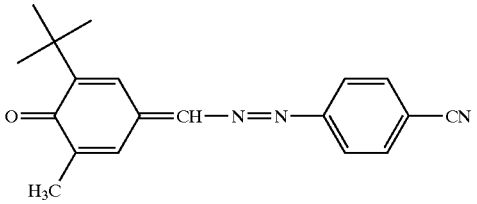
(ET3-106)
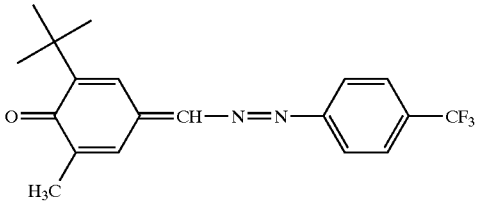
(ET3-107)
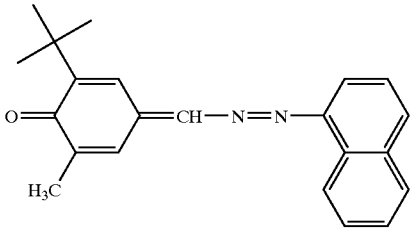
(ET3-108)
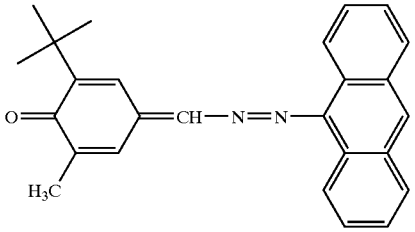

-continued
(ET3-109)
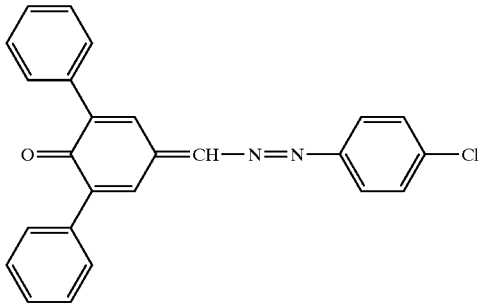
(ET3-110)
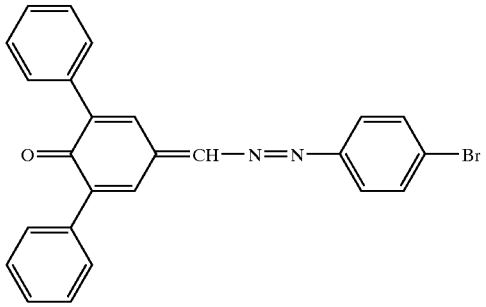
(ET3-111)
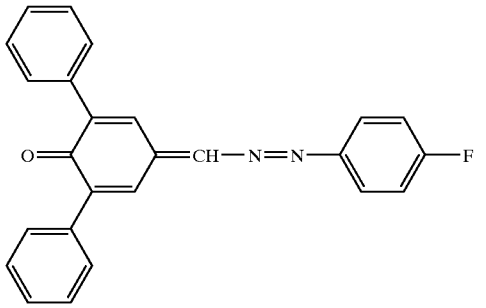
(ET3-112)
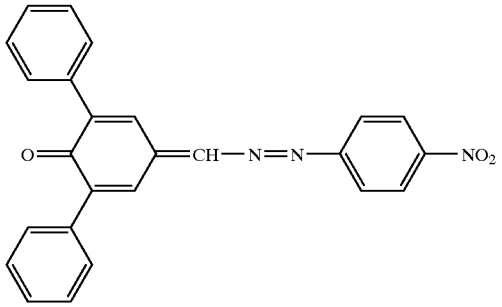
(ET3-113)
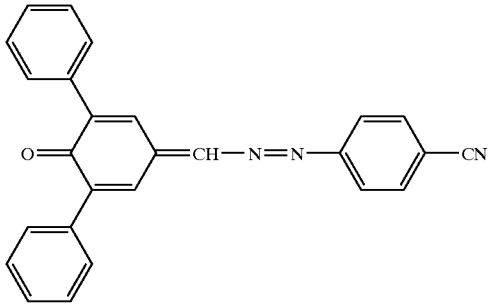
-continued
(ET3-114)
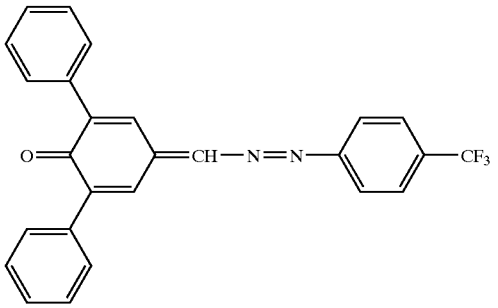
(ET3-115)
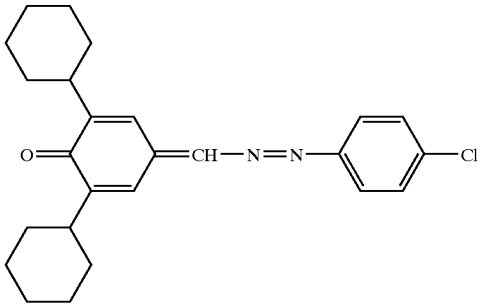
(ET3-116)
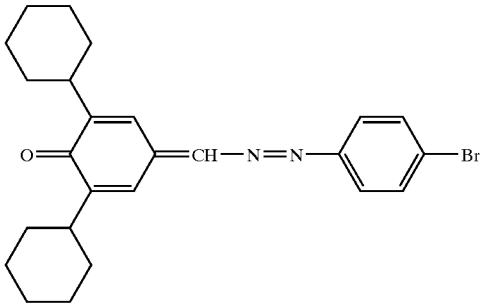
(ET3-117)
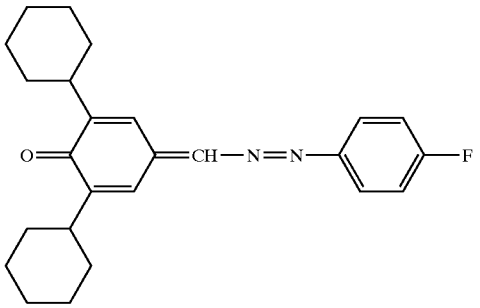
(ET3-118)
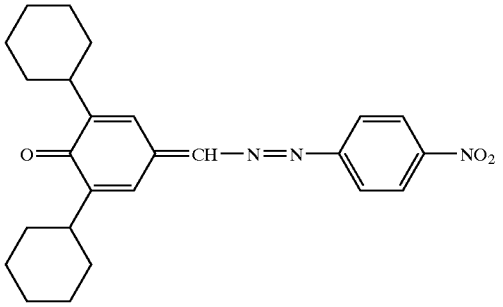

(ET3-119)
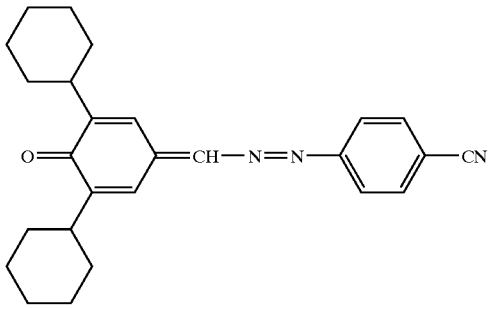
(ET3-120)
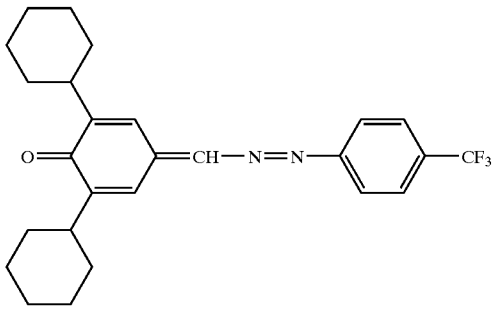
(ET3-121)
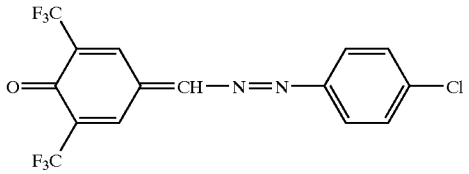
(ET3-122)
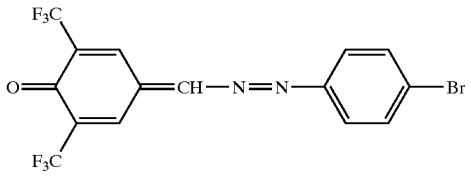
(ET3-123)
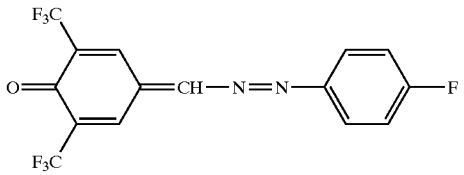
(ET3-124)
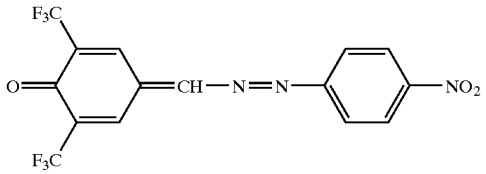
(ET3-125)
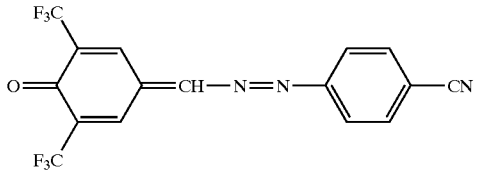
(ET3-126)
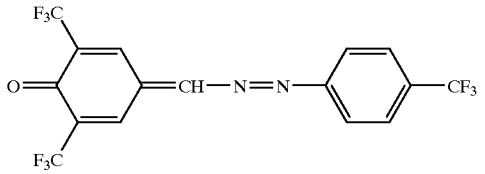
(ET3-127)
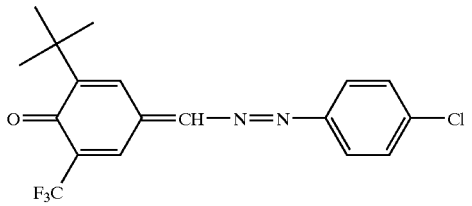
(ET3-128)
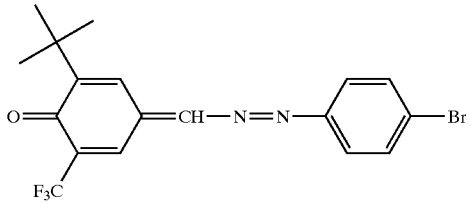
(ET3-129)
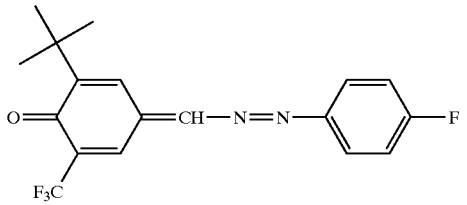
(ET3-130)
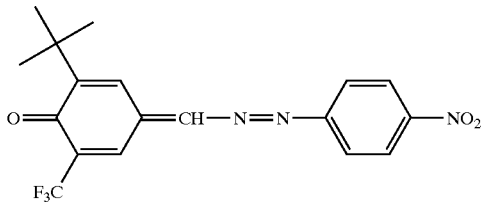
(ET3-131)
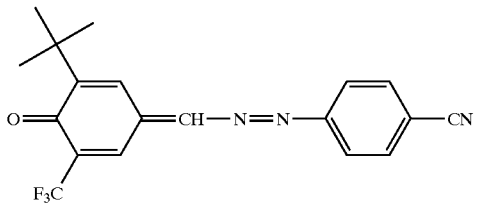

-continued
(ET3-132)
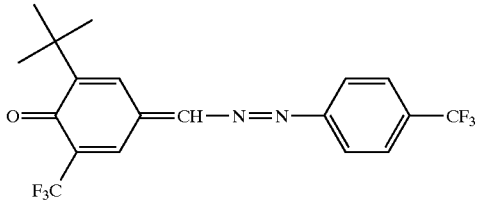
(ET3-133)
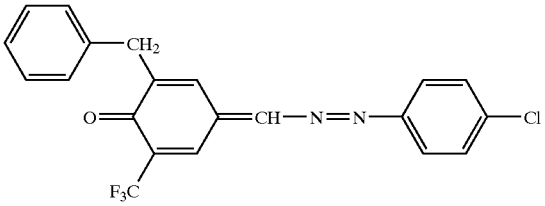
(ET3-134)
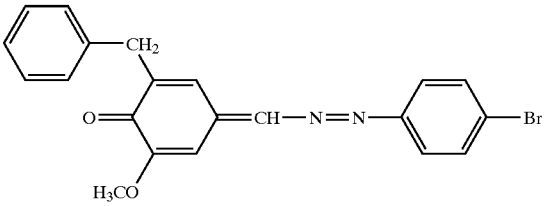
(ET3-135)
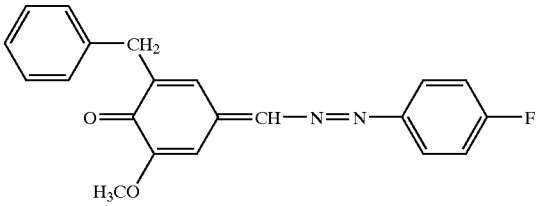
(ET3-136)
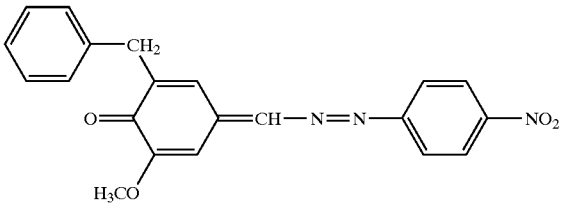
(ET3-137)
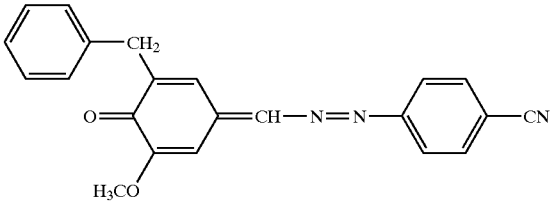
(ET3-138)
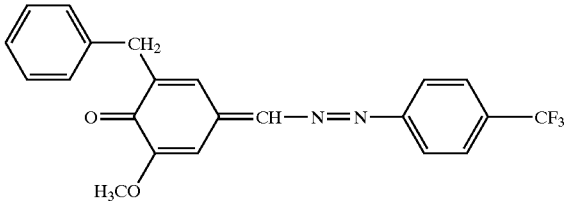
-continued
(ET3-139)
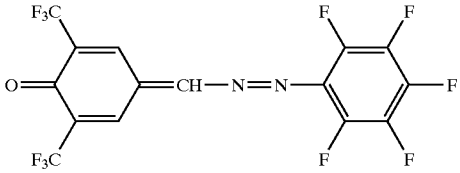
(ET4-1)
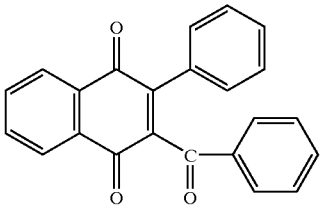
(ET4-2)
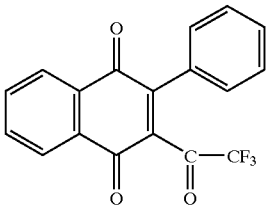
(ET4-3)
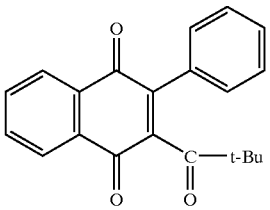
(ET4-4)
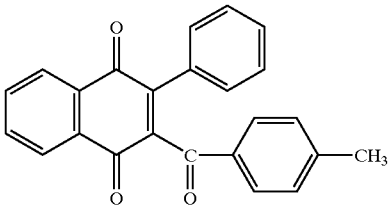
(ET4-5)
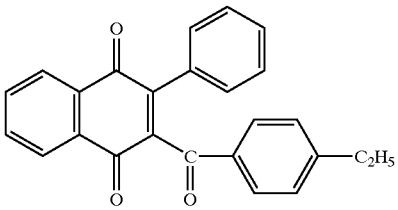
(ET4-6)
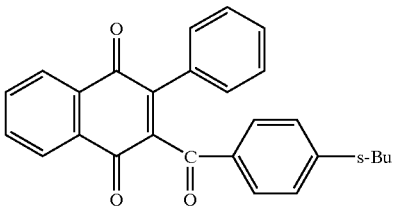

-continued
(ET4-7)
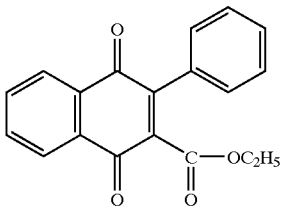
(ET4-8)
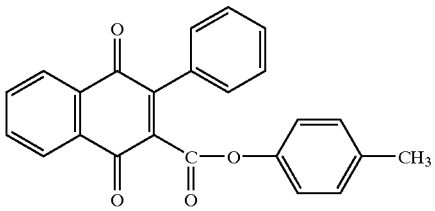
(ET4-9)
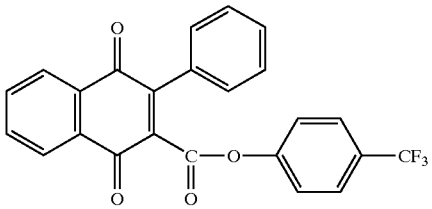
(ET4-10)
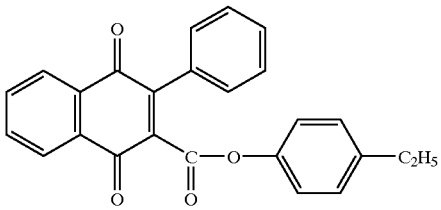
(ET4-11)
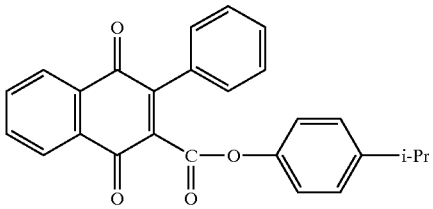
(ET4-12)
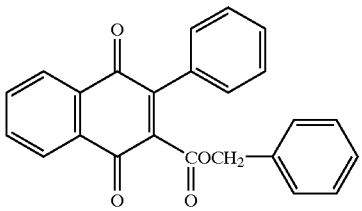
(ET4-13)
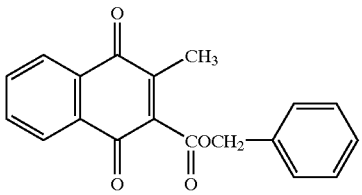
-continued
(ET4-14)
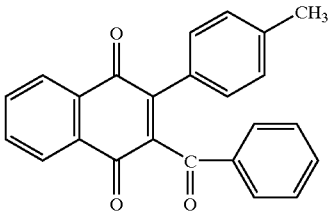
(ET-1)
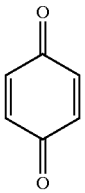
(ET-2)
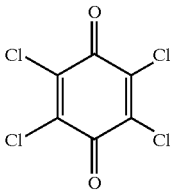
(ET-3)
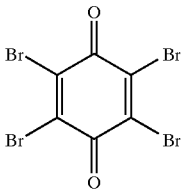
(ET-4)
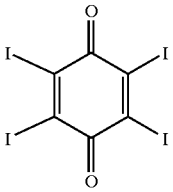
(ET-5)
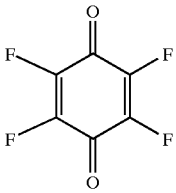
(ET-6)
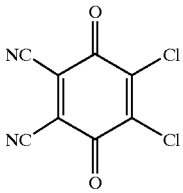
(ET-7)
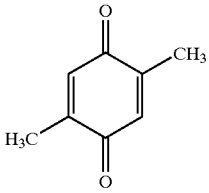

-continued
(ET-8)
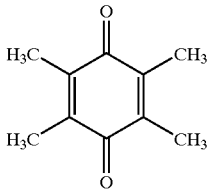
(ET-9)
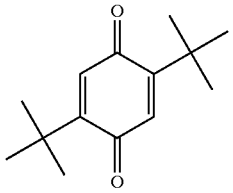
(ET-10)
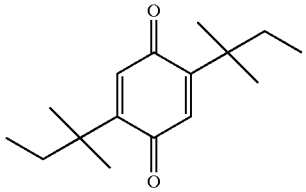
(ET-11)
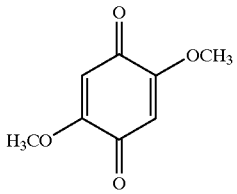
(ET-12)
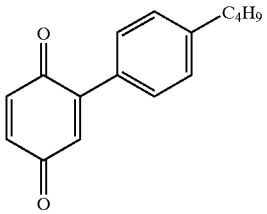
(ET-13)
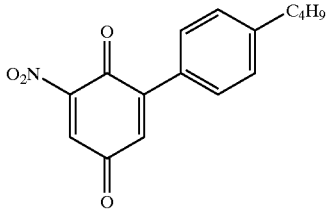
(ET-14)
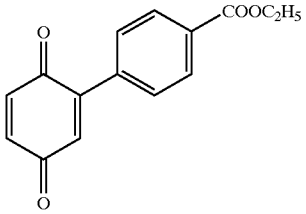
-continued
(ET-15)
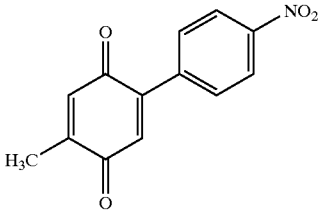
(ET-16)
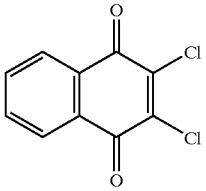
(ET-17)
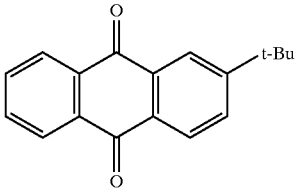
(ET-18)
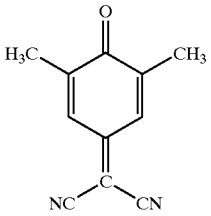
(ET-19)
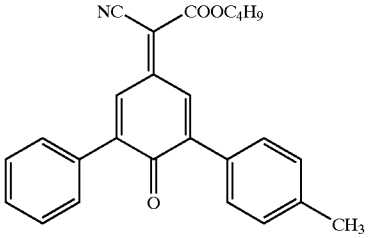
(ET-20)
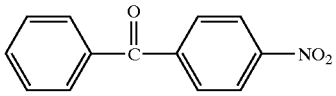
(ET-21)
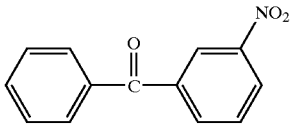
(ET-22)
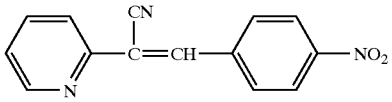
(ET-23)
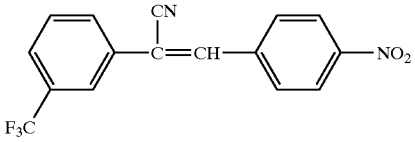

-continued
(ET-24)
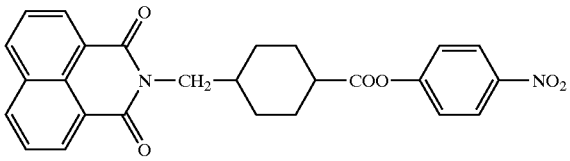
(ET-25)
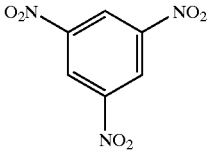
(ET-26)
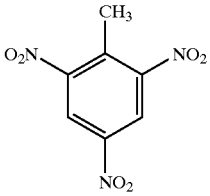
(ET-27)
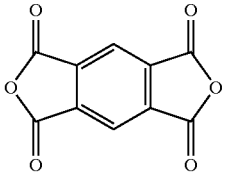
(ET-28)
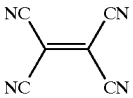
(ET-29)
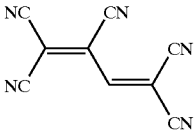
(ET-30)
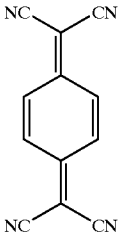
(ET-31)
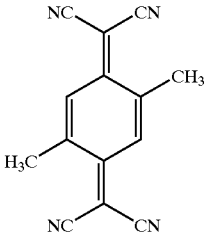
-continued
(ET-32)
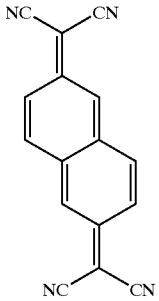
(ET-33)
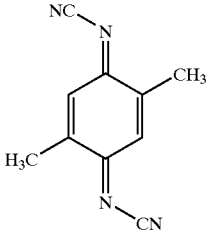
(ET-34)
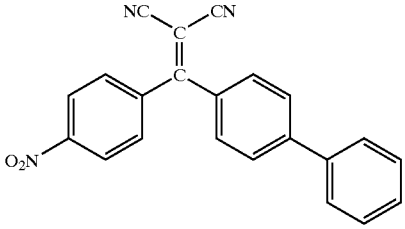
(ET-35)
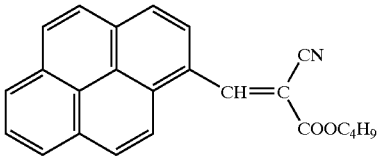
(ET-36)
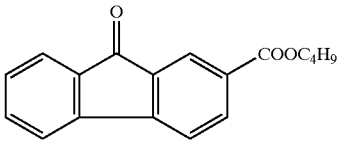
(ET-37)
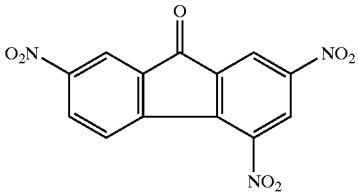
(ET-38)
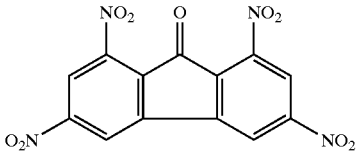

-continued (ET-39)

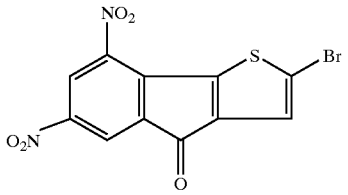

(ET-40)

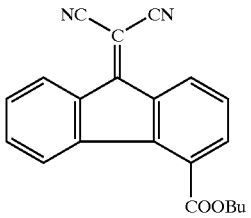

(ET-41)

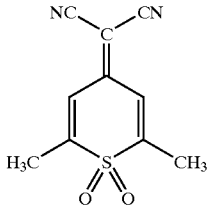

(ET-42)

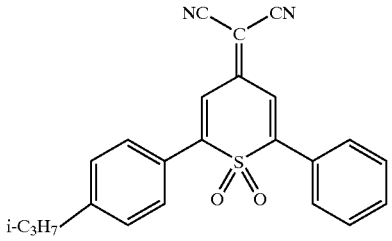

For the resin binder, polymers and co-polymers of the following can be suitably combined and used: polycarbonate resin, polyester resin, polyvinyl acetal resin, polyvinyl butyral resin, polyvinyl alcohol resin, vinyl chloride resin vinyl acetate resin, polyethylene, polypropylene, polystyrene, acrylic resin, polyurethane resin, epoxy resin, melamine resin, silicon resin, silicon resin, polyamide resin, polystyrene resin, polyacetal resin, polyarylate resin, polysulfone resin, ester methacrylate, and co-polymers. In particular, as represented by bis phenol Z type polycarbonate, polycarbonates having a main repeating unit of a structural unit represented by the previous general formula (BD1) is suitable. Concrete examples include polycarbonates having a main repeating unit of a structural unit represented by the following formulas (BD1-1)~(BD1-16). Furthermore, additionally, polycarbonate resins and polyester resins having a main repeating unit of one type or two or more types of structural units represented by the following formula (BD-1)~(BD-6) are suitable. However, the present invention is not limited to these. Furthermore, with these resins, one type can be used or two or more types can be mixed and used. The same resin with differing molecular weights can be mixed and used. The content of resin binder is 10~90 weight % with respect to the solid part of the photosensitive layer, and is preferably 20~80 weight %.

(BD1-1)

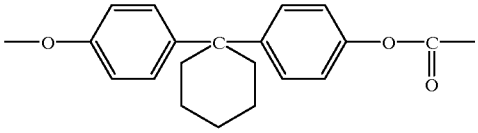

(BD1-2)

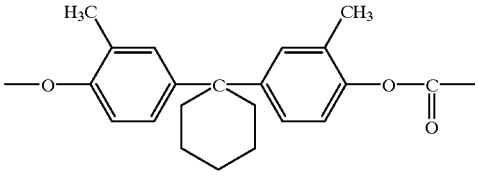

(BD1-3)

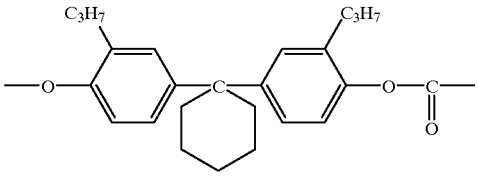

(BD1-4)

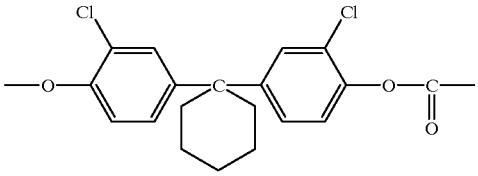

(BD1-5)

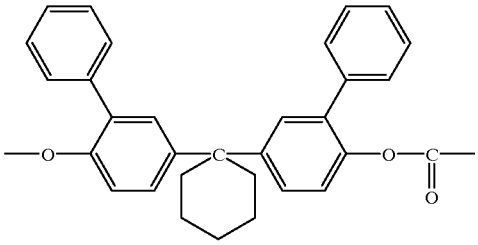

(BD1-6)

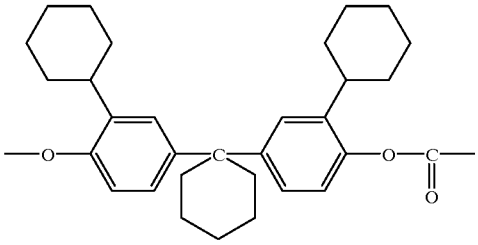

(BD1-7)

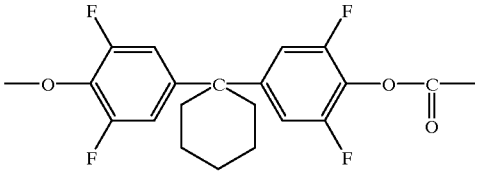

-continued (BD1-8)

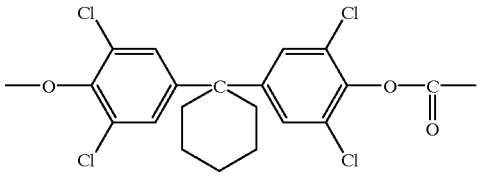

(BD1-9)

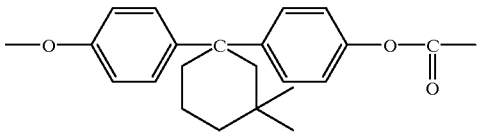

(BD1-10)

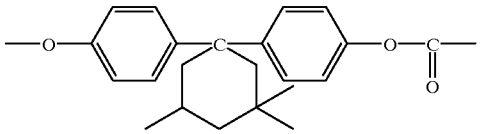

(BD1-11)

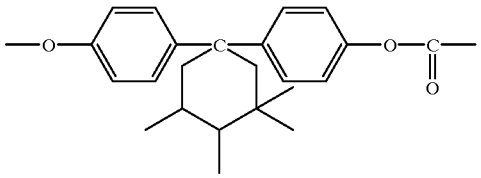

(BD1-12)

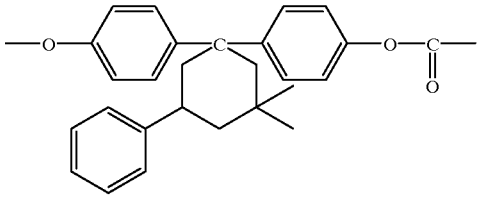

(BD1-13)

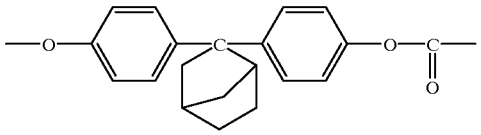

(BD1-14)

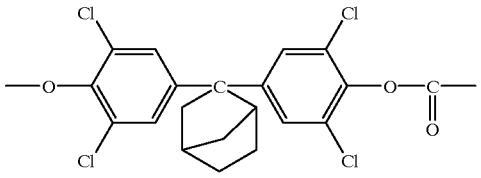

(BD1-15)

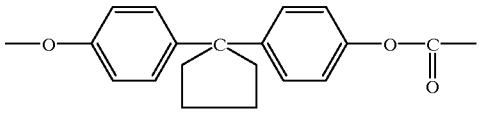

-continued (BD1-16)

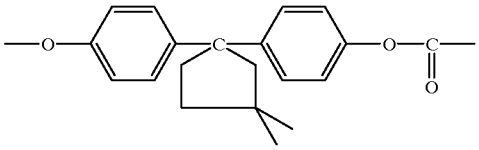

(BD-1)

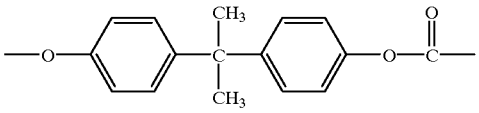

(BD-2)

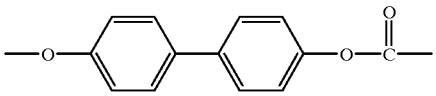

(BD-3)

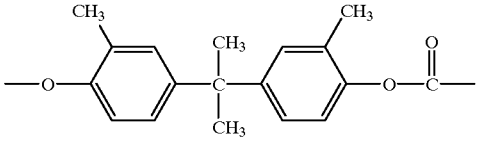

(BD-4)

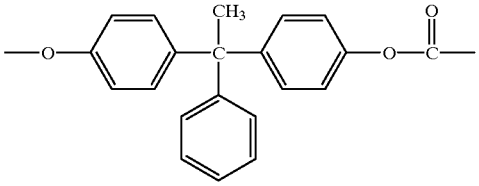

(BD-5)

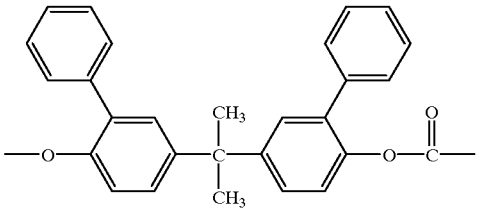

(BD-6)

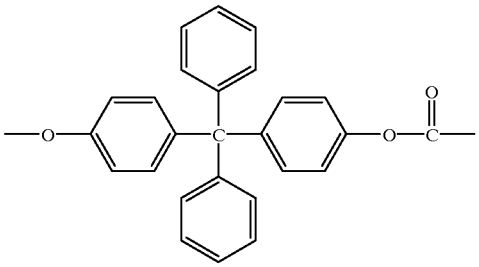

For the purposes of improving environmental resistance and stability with respect to light, photosensitive layer 3 can contain degradation inhibiting agents, such as oxidation inhibiting agents, radical scavengers, single quenchers, ultraviolet light absorbing agents, and the like. Compounds used for these purposes include chromanol derivatives and esterified compounds such as tocopherols and the like, polyaryl alkane compounds, hydroquinone derivatives, esterified compounds, dieetherified compounds, benzophenone derivatives, benzotriazole derivatives, thioether compounds, phenylene diamine derivatives, ester phosphonate, ester phosphite, phenol compounds, hindered amine compounds, biphenyl derivatives, and the like.

Furthermore, for the purposes of improving the level of the formed film and of giving lubrication, the photosensitive layer can contain leveling agents such as silicon oil and fluorine oils, and the like.

Furthermore, for the purposes of reducing the friction coefficient and of providing lubrication, the photosensitive layer can contain the following: metal oxides such as silicon oxide, titanium oxide, zinc oxide, calcium oxide, aluminum oxide, zirconium oxide, and the like; metal sulfides such as barium sulfate, calcium sulfate, and the like; metal nitride fine particles, such as silicon nitride, aluminum nitride, and the like; or fluorine resin particles such as ethylene tetrachloride resin and the like; and fluorine comb graft polymer resins, and the like.

In order to maintain a surface electric potential that is effective in practice, the film thickness of photosensitive layer 3 is preferably in the range of 3~100 $\mu$m, and more preferably in the range of 10~50 $\mu$m.

Protective Layer

The object of protective layer 4 is to improve the print resistance and the like and can be provided as needed. Protective layer 4 comprises a layer that has a main component of a resin binder or comprises an inorganic thin film of amorphous carbon and the like. Furthermore, for the purposes of improving conductivity or of reducing the friction coefficient and of providing lubrication and the like, the resin binder can contain metal oxides, such as silicon oxide, titanium oxide, zinc oxide, calcium oxide, aluminum oxide, zirconium oxide and the like; metal sulfides such as barium sulfate, calcium sulfate, and the like; metal nitride fine particles such as silicon nitride, aluminum nitride, and the like; or fluorine resin particles such as ethylene tetrachloride resin and the like; or fluorine comb graft polymer resins, and the like.

Furthermore, for the purposes of having charge transport properties, protective layer 4 can contain hole transport substances and electron transport substances used in the photosensitive layer described above. For the purposes of improving the leveling of the formed film or for providing lubrication, the protective layer can contain leveling agents such as silicone oil or fluorine oils and the like. Furthermore, other known additives can be added as needed within a range where there is no great negative impact on the electrophotography properties.

Method of Formation

As the method for forming each layer of undercoat layer 2, photosensitive layer 3, protective layer 4 by coating on top of conductive substrate 1, the above described constituent materials are dissolved and dispersed together with a suitable solvent, and a coating solution is created. This is coated by a suitable coating method and then dried.

Examples of solvents used in forming the coating solution include: alcohols, such as methanol, ehtanol, n-propanol, i-propanol, n-butanol, benzyl alcohol, and the like; ketones, such as acetone, methyl ethyl ketone, metyl isobutyl ketone, cyclohexanone, and the like; amides, such as dimethyl foramide, dimethyl acetamide, and the like; sulfoxides such as dimethyl sulfoxide, and the like; annular or straight chain ethers such as tetrahydrofuran, dioxane, dioxoran, diethyl ether, methyl cellosolve, ethyl cellosolve, and the like; esters such as methyl acetate, ethyl acetate, n-butyl acetate, and the like; aliphatic halogenated hydrocarbons such as methylene chloride, chloroform, carbon tetrachloride, dichlorotheylene, trichloroethylene, and the like; mineral oils such as ligroin, and the like; aromatic hydrocarbons such as benzene, toluene, xylene, and the like; aromatic halogenated hydrocarbons such as chlorobenzene, dichlorobenzene, and the like. Two or more types can be mixed and used.

As the method for dispersing and dissolving the coating solution, known methods can be used. For example, beads mill such as a paint shaker, ball mill, dynomill, and the like, and an ultrasonic wave dispersion and the like can be used. Furthermore, for the coating method, known methods, such as dip coating, seal coating, spray coating, bar coating blade coating, and the like can be used.

Furthermore, when drying, the drying temperature and drying time can be set as suitable, taking into account the type of solvent used and the manufacturing costs, and the like. Preferably, the drying temperature is in the range of room temperature or greater and 200° C. or less, and the drying time is in the range of 10 minutes or greater and two hours or less. More preferably, it is within the range of from the boiling point of the solvent to boiling point +80° C. The drying is usually conducted under normal pressure or reduced pressure while stationary or under ventilation.

Figure 6:
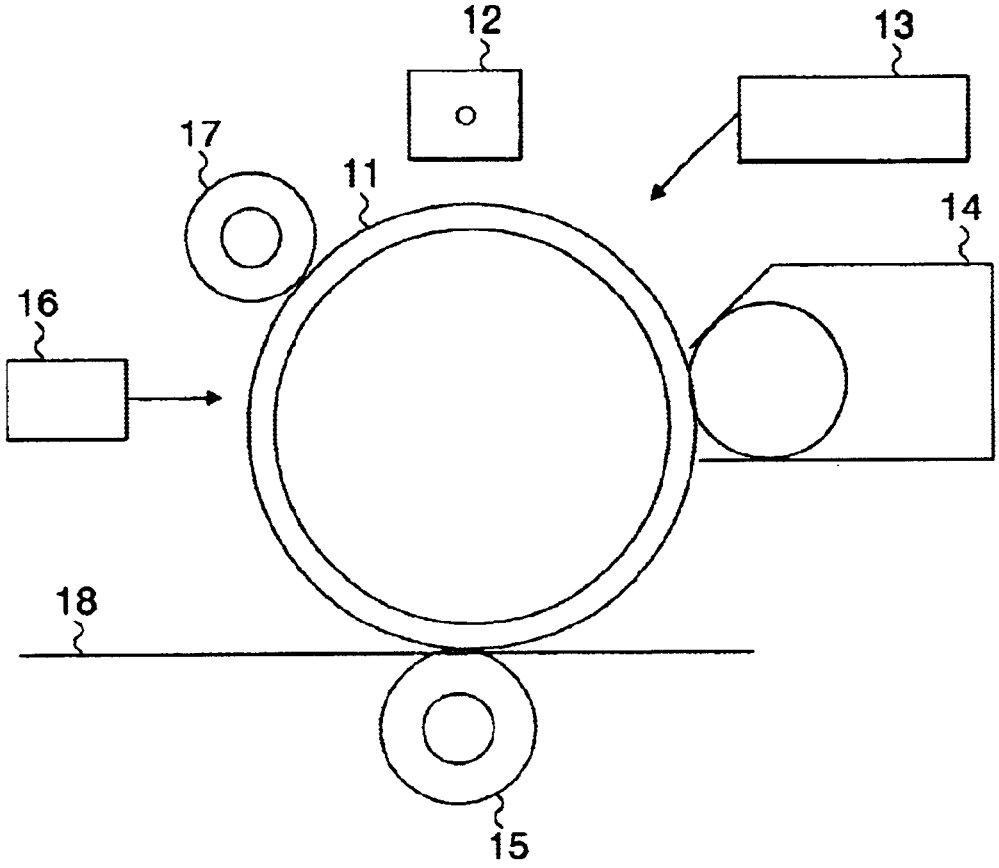
FIG. 6 is a conceptual drawing of one example of an electrophotography device of the present invention.

The electrophotography device of the present invention is equipped with an electrophotography photosensitive body of the present invention and conducts a charging process by a positive charging process. All other constructions and the like is not limited. For example, referring to FIG. 6, it can have a construction as shown in this conceptual drawing. Referring to the figure, there are a photosensitive body drum 11, a charging scortron 12, a laser optical system 13 for light exposure, a developer 14, a transfer roller 15, a discharge light source 16, a cleaning roller 17, a paper 18.

The present invention will be described in detail based on the embodiments.

First, synthesis examples for the titanyl phthalocyanine used in the photosensitive body embodiments and comparative examples are described.

SYNTHESIS EXAMPLE 1

In a reaction container, 800 g of o-phthalonitrile and 1.8 liters of quinoline were added and agitated. Into this, under a nitrogen atmosphere, 297 g of titanium tetrachloride was dripped, and this was agitated. After completing the dripping, the temperature was raised, and while heating and agitating, this was reached for 15 hours at 180° C.

After letting this reaction solution cool to 130° C., this was filtered. Under a nitrogen atmosphere, this was heated and agitated for 1 hour at 100° C. in 1.8 liter of N-methyl-2-pyrrolidinone. This was filtered, and tis was sequentially washed in 2 liters of acetone, 2 liters of methanol, and 4 liters of warm water.

This was further dispersed in 4 liters of water and 360 ml of dilute hydrochloric acid of 36% hydrochloric acid. After heating and agitating for 1 hour at 80° C., this was allowed to cool and was filtered. After rinsing with 10 liters of warm water, this was dried.

Next, 200 g of the above described dried product was slowly added to 4 kg of 96% sulfuric acid at −5° C. or below. While maintaining this solution at 5° C., this was agitated for 1 hour. Next, this sulfuric acid solution was added to 35 liters of water and 5 kg of ice while cooling and agitating. This was agitated for a further 1 hour while cooling. This was filtered, and this was rinsed with 10 liters of warm water. These series of steps are henceforth abbreviated as "Process A."

Next, while maintaining the temperature at 80° C., this was agitated for 1 hour in 10 liters of water and 770 ml of dilute hydrochloric acid of 36% hydrochloric acid. This was allowed to cool and was filtered, and after rinsing with 10 liters of warm water, this was dried. By the above process, titanyl phthalocyanine was created.

SYNTHESIS EXAMPLE 2

In Process A of Synthesis example 1, synthesis was conducted in the same manner as Synthesis example 1, except that the agitating time while maintaining at 5° C. was changed to 30 minutes.

SYNTHESIS EXAMPLE 3

In Process A of Synthesis example 1, synthesis was conducted in the same manner as Synthesis example 1, except that the part of agitating while maintaining at −5° C. was omitted.

COMPARATIVE SYNTHESIS EXAMPLE 1

In Process A of Synthesis example 1, synthesis was conducted in the same manner as Synthesis example 1, except that the amount of 96% sulfuric acid was changed to 2 kg.

COMPARATIVE SYNTHESIS EXAMPLE 2

Synthesis was conducted in the same manner as Synthesis example 1, except that Process A of synthesis example 1 was not conducted.

COMPARATIVE SYNTHESIS EXAMPLE 3

Synthesis of titanyl phthalocyanine was conducted according to the manufacturing method of titanyl phthalocyanine in the embodiment of Japanese Laid Open Patent Publication 61-217050.

Photosensitive Body Embodiment 1

A board shaped photosensitive body was created for the evaluation of electrical properties. A drum shaped photosensitive body (30 mm Φ) was created for the printing evaluation.

An undercoat layer solution with the following composition was dip coated on top of an aluminum board and an aluminum tube. This was dried for 60 minutes at 100° C. An undercoat layer with a film thickness of 0.1 μm was formed. Below, "parts" refer to weight parts.

Vinyl chloride-vinyl acetate copolymer (Solbin C: manufactured by Nisshin

| | |
|---|---|
| Kagaku Corp. Ltd.) | 30 parts |
| Methyl ethyl ketone | 970 parts |

Next, a material with the following composition was mixed, and a single layer photosensitive layer dispersion solution was created in a dynomill. The dispersion solution was dip coated on top of the undercoat layer described above. This was dried for 60 minutes at 100° C., and a single layer photosensitive layer with a film thickness of 25 micrometers was formed.

Charge generating substance: Titanyl phthalocyanine (Synthesis example 1) 2 parts Hole transport substance: compound of the above formula (HT1-23) 100 parts Silicone oil: KF-96 (Shinetsu Kagaku Kogyo (Corp. Ltd)) 0.1 parts Resin binder: bis phenol Z type polycarbonate resin [a resin that has a construction unit of the above formula (BD1-1)] (Panlite TS2050: Teijin Kasei

| | |
|---|---|
| Corp. Ltd.)) | 100 parts |
| Tetrahydrofuran | 800 parts |

An electrophotography photosensitive body was created as described above.

Photosensitive Body Embodiments 2~8 and Comparative Examples 1~6

Each of the photosensitive bodies was manufactured in the same manner as Embodiment 1, except that for the composition of the photosensitive layer dispersion solution used in Embodiment 1, the charge generating substance and hole transport substance were each changed to compounds shown in the Table 1 below.

TABLE 1

| | Charge generating substance | Hole transport substance |
|---|---|---|
| Embodiment 2 | Synthesis example 1 | (HT1-66) |
| Embodiment 3 | Synthesis example 1 | (HT1-101) |
| Embodiment 4 | Synthesis example 1 | (HT2-34) |
| Embodiment 5 | Synthesis example 1 | (HT3-30) |
| Embodiment 6 | Synthesis example 1 | (HT4-2) |
| Embodiment 7 | Synthesis example 2 | (HT1-101) |
| Embodiment 8 | Synthesis example 3 | (HT1-101) |
| Comparative example 1 | Comparative synthesis example 1 | (HT1-101) |
| Comparative example 2 | Comparative synthesis example 2 | (HT1-101) |
| Comparative example 3 | Comparative synthesis example 3 | (HT1-101) |
| Comparative example 4 | beta type titanyl phthalocyanine | (HT1-101) |
| Comparative example 5 | X type metal free phthalocyanine | (HT1-101) |
| Comparative example 6 | Synthesis example 1 | none |

Photosensitive Body Embodiment 9

A photosensitive body was manufactured in the same manner as Embodiment 1, except that the photosensitive layer dispersion solution used in Embodiment 1 was changed to the composition below.

Charge generating substance: titanyl phthalocyanine (Synthesis example 1) 2 parts Hole transport substance: compound of the above formula (HT1-101) 60 parts Electron transport substance: compound of the above formula (ET1-8) 40 parts Silicone oil: KF-96 (manufactured by Shinetsu Kagaku Kogyo Corp. Ltd.) 0.1 parts Resin binder: bis phenol Z type polycarbonate resin [a resin that has a construction unit of the above formula (BDI-1)] (Panlite TS2050: Teijin Kasei

| | |
|---|---|
| Corp. Ltd.)) | 100 parts |
| Tetrahydrofuran | 800 parts |

Photosensitive Body Embodiments 10~19 and Comparative Examples 7~11

Each of the photosensitive bodies was manufactured in the same manner as Embodiment 9, except that for the composition of the photosensitive layer dispersion solution used in Embodiment 9, the charge generating substance, the hole transport substance, and the electron transport substance were each changed to the compounds shown in Table 2 below.

TABLE 2

| | Charge generating substance | Hole transport substance | Electron transport substance |
|---|---|---|---|
| Embodiment 10 | Synthesis example 1 | (HT1-101) | (ET2-11) |
| Embodiment 11 | Synthesis example 1 | (HT1-101) | (ET3-5) |
| Embodiment 12 | Synthesis example 1 | (HT1-101) | (ET4-12) |
| Embodiment 13 | Synthesis example 1 | (HT1-23) | (ET3-5) |
| Embodiment 14 | Synthesis example 1 | (HT1-66) | (ET3-5) |
| Embodiment 15 | Synthesis example 1 | (HT2-34) | (ET3-5) |
| Embodiment 16 | Synthesis example 1 | (HT3-30) | (ET3-5) |
| Embodiment 17 | Synthesis example 1 | (HT4-2) | (ET3-5) |
| Embodiment 18 | Synthesis example 2 | (HT1-101) | (ET3-5) |
| Embodiment 19 | Synthesis example 3 | (HT1-101) | (ET3-5) |
| Comparative Ex. 7 | Comparative synthesis Ex. 1 | (HT1-101) | (ET3-5) |
| Comparative Ex. 8 | Comparative synthesis Ex. 2 | (HT1-101) | (ET3-5) |
| Comparative Ex. 9 | Comparative synthesis Ex. 3 | (HT1-101) | (ET3-5) |
| Comparative Ex. 10 | Beta-type titanyl phthalocyanine | (HT1-101) | (ET3-5) |
| Comparative Ex. 11 | X type metal free phthalocyanine | (HT1-101) | (ET3-5) |

Evaluation of Crystallinity

The evaluation of crystallinity for each of the phthalocyanine compounds used in the photosensitive body embodiments and comparative examples were conducted by the following method.

First, using an X-ray diffraction device MPX-18 manufactured by MAC Science Corp., measurement of the X ray powder diffraction of the titanyl phthalocyanine of Synthesis example 1 as the charge generating substance of the present invention was conducted with the following measurement conditions.

| | |
|---|---|
| X ray generating device: | 18 kW |
| Radiation source: | CuK α rays (1.54056 Å) |
| Tube voltage: | 40 kV |
| Tube current: | 50 mA |
| Sampling width: | 0.02° |
| Scanning velocity: | 4°/minute |
| Divergence slit: | 0.5° |
| Scattering slit: | 0.5° |
| Light receiving slit: | 0.30 mm |

Figure 2:
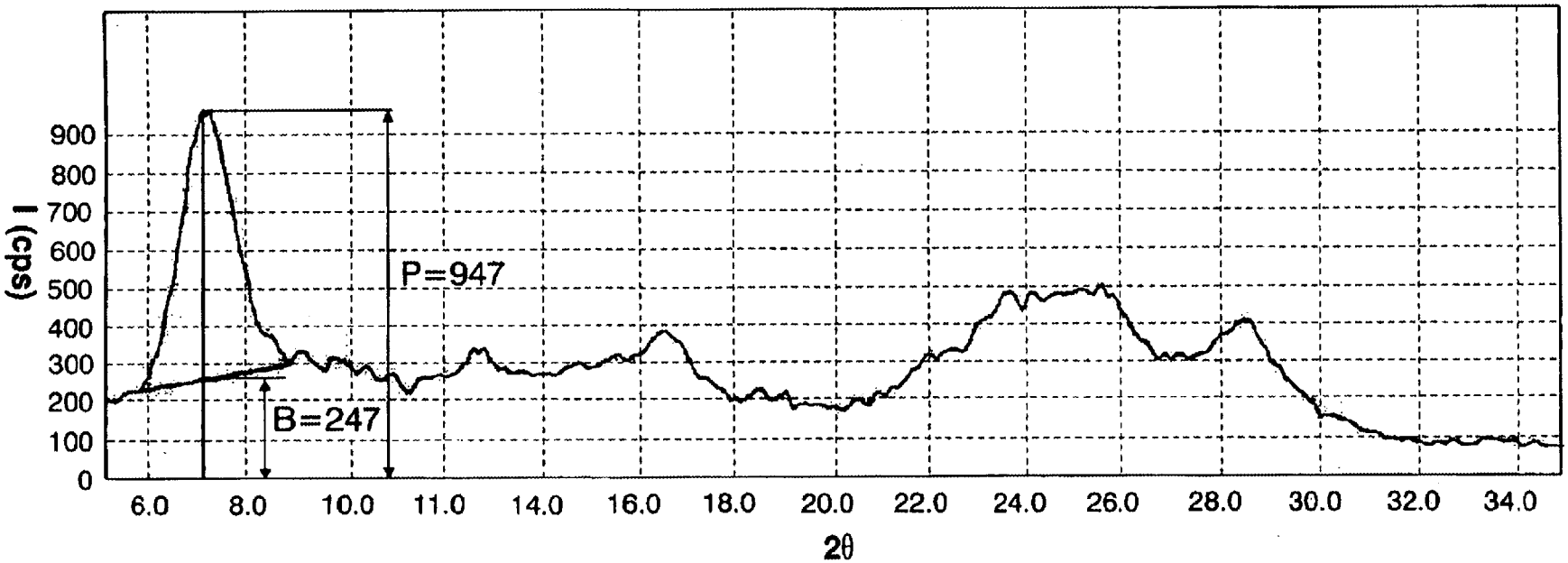
FIG. 2 is a X-ray powder diffraction spectrum of a titanyl phthalocyanine of Synthesis example 1 of the embodiments.

Next, using the resulting X-ray diffraction spectrum (refer to FIG. 2), crystallinity (R) was obtained using the following equation. Value P is the diffraction intensity of the peak that represents the height of the highest of the plurality of diffraction peaks within the range of Bragg angle 2θ=5–35°. In FIG. 2, the maximum peak has a Bragg angle 2θ=7.2°. Value B is the diffraction intensity of the point where a line, which connects the two troughs that are between the highest peak and the peaks positioned on either side of it, crosses a perpendicular line, which is drawn from the peak position of the highest peak to the horizontal axis.

$$R=(P-B)/B$$

P: value of the diffraction intensity of the highest peak

B: at the same Bragg angle as the highest peak, the value of the diffraction intensity of a line that connects the troughs on either side of the highest peak (background diffraction intensity).

Figure 3:
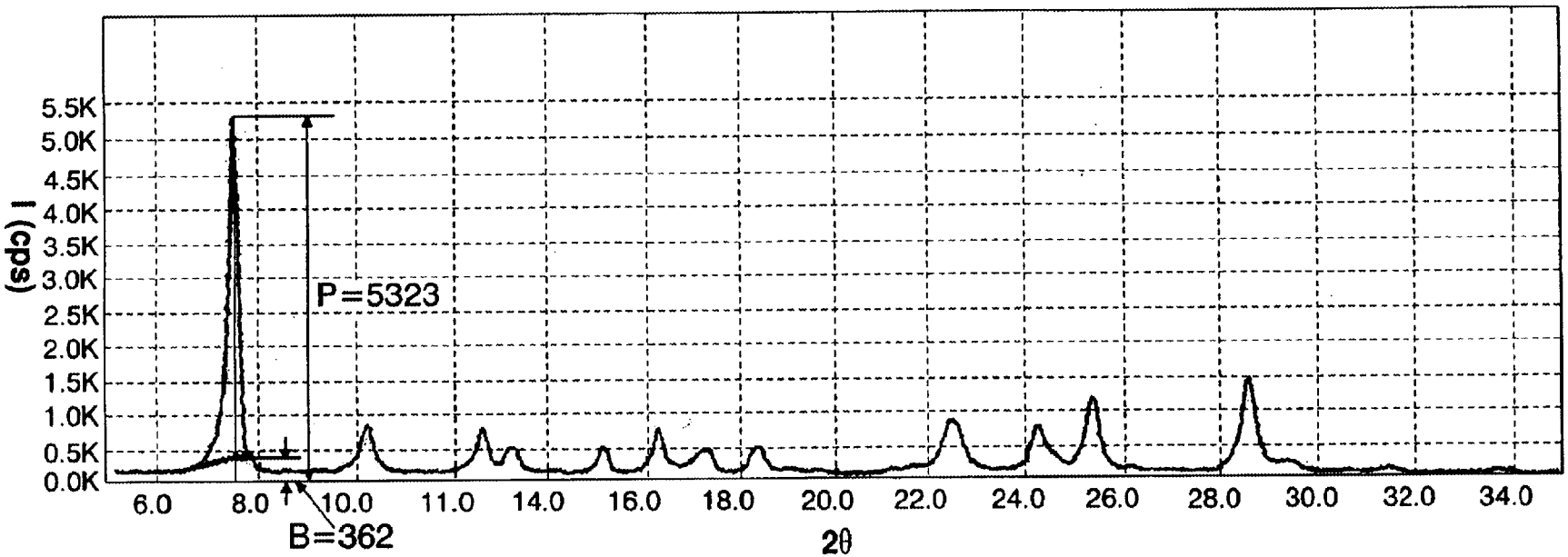
FIG. 3 is a X-ray powder diffraction spectrum of a titanyl phthalocyanine of Comparative synthesis example 3 of the embodiments.
Figure 4:
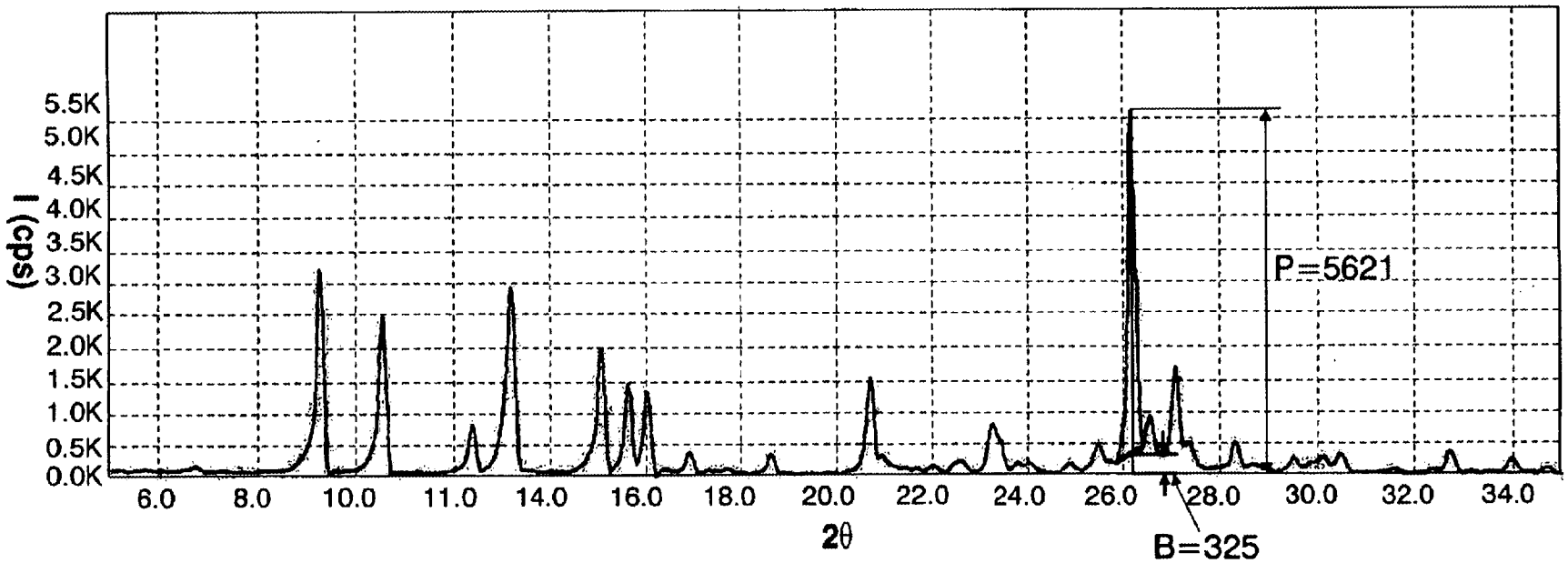
FIG. 4 is a X-ray powder diffraction spectrum of a beta type titanyl phthalocyanine used in the embodiments.
Figure 5:
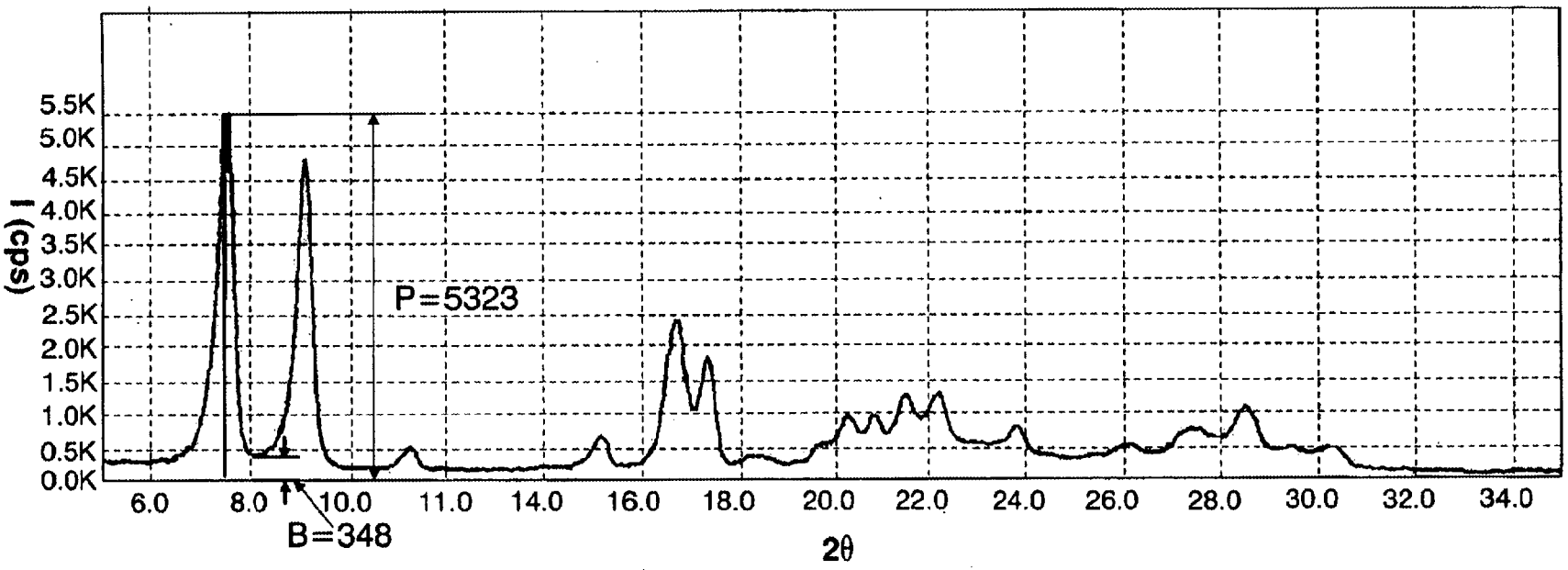
FIG. 5 is a X-ray powder diffraction spectrum of a X type metal-free phthalocyanine used in the embodiments.

Similarly, evaluations were also conducted for Synthesis examples 2, 3, Comparative synthesis examples 1~3, beta type titanyl phthalocyanine, X type metal free phthalocyanine. Referring to FIGS. 3~5, the X-ray diffraction spectrums for the titanyl phthalocyanine of Comparative synthesis example 3, beta type titanyl phthalocyanine, and X-type metal free phthalocyanine are shown.

Evaluation of Photosensitive Body Embodiments 1~8. Photosensitive Comparative Examples 1~6

For the electrical properties evaluation, the board-shaped photosensitive body is used. With an electrostatic copy testing device EPA-8100 (manufactured by Kawaguchi Denki Seisakujo Corp. Ltd.), evaluations were conducted as follows.

First, in an environment of temperature 23° C. and humidity 50%, the photosensitive body was charged in the dark to a surface electric potential of approximately +600V. Afterwards, the retention rate of the surface electric potential in the 5 seconds until light exposure was obtained by the following equation.

$$\text{Retention rate } V_{k5}(\%)=V_5/V_0\times 100$$

$V_0$: surface electric potential immediate after charging $V_5$: surface electric potential after 5 seconds (beginning of light exposure)

Next, the surface electric potential was similarly charged to approximately +600V. This was exposed for five seconds to a single color light of 1.0 microW/cm$^2$ in which light from a halogen lamp was separated to 780 nm by a filter. The light exposure quantity that is necessary for the surface electric potential to become half (+300V) was obtained as sensitivity $E_{1/2}$ ($\mu$J/cm$^2$). The surface electric potential 5 seconds after light exposure was obtained as residual electric potential Vr (V).

Furthermore, for the evaluation of actual printing, the drum-shaped photosensitive body was mounted onto a laser printer HL-730 manufactured by Brother Co. In an environment of temperature 24° C. and humidity 48%, printing was conducted, and the image quality was evaluated. At the same time, the initial surface electric potential $V_0$ (V) and light exposure part electric potential V1 (V) were measured. Next, after printing 5000 pages of an image with a print proportion of approximately 5%, the surface electric potential $V_0$ (V) and light exposure part electric potential V1 (V) were again measured. The differences delta $V_0$ (V) and delta V1 (V) with respect to each of their initial values were obtained, and the repeat fatigue property was evaluated.

Referring to Table 3, the evaluation results are shown.

TABLE 3

| | Electrical Properties According to EPA-8100 | | | Evaluation according to HL-730 | | | |
|---|---|---|---|---|---|---|---|
| | Retention Rate Vk5 (%) | Sensitivity E1/2 ($\mu J/cm^2$) | Residual electric potential Vr (V) | Initial Image | Repeat fatigue $\Delta V_0$(V) | Repeat fatigue ΔV1(V) | Crystallinity (R) |
| Emb. 1 | 86.4 | 0.25 | 66 | ○ | 40 | 30 | 2.8 |
| Emb. 2 | 87.3 | 0.29 | 78 | ○ | 30 | 25 | 2.8 |
| Emb. 3 | 86.5 | 0.27 | 72 | ○ | 35 | 30 | 2.8 |
| Emb. 4 | 88.1 | 0.32 | 78 | ○ | 30 | 40 | 2.8 |
| Emb. 5 | 87.7 | 0.27 | 75 | ○ | 35 | 30 | 2.8 |
| Emb. 6 | 87.3 | 0.24 | 65 | ○ | 35 | 25 | 2.8 |
| Emb. 7 | 86.4 | 0.26 | 71 | Δ | 40 | 35 | 4.1 |
| Emb. 8 | 86.9 | 0.29 | 75 | Δ | 45 | 35 | 6.5 |
| Comp. Ex. 1 | 80.3 | 0.51 | 92 | X | 70 | 40 | 7.8 |
| Comp. Ex. 2 | 80.6 | 0.52 | 98 | X | 80 | 35 | 9.0 |
| Comp. Ex. 3 | 79.5 | 0.55 | 106 | X | 80 | 40 | 13.7 |
| Comp. Ex. 4 | 85.5 | 1.44 | 107 | X | 30 | 75 | 16.3 |
| Comp. Ex. 5 | 91.8 | 0.38 | 85 | Δ | 90 | 45 | 14.7 |
| Comp. Ex. 6 | 92.6 | 1.98 | 386 | X | 25 | 130 | 2.8 |

Table entry in the 'Initial Image' row,
○: excellent,
Δ: good,
X: no good.

Evaluation of Photosensitive Body Embodiments 9~19, Photosensitive Body Comparative Examples 7~11

With the evaluation of the actual printing, the evaluation was conducted in the same manner as photosensitive body Embodiments 1~8 and photosensitive body Comparative examples 1~6, except that the evaluation device was changed to a laser printer HL-1240 manufactured by Brother Company.

In addition, the evaluation of the electric properties were similarly conducted.

Referring to Table 4 below, their evaluation results are shown.

TABLE 4

| | Electrical Properties According to EPA-8100 | | | Evaluation according to HL-1240 | | | |
|---|---|---|---|---|---|---|---|
| | Retention Rate Vk5 (%) | Sensitivity E1/2 ($\mu J/cm^2$) | Residual electric potential Vr (V) | Initial Image | Repeat fatigue $\Delta V_0$(V) | Repeat fatigue ΔV1(V) | Crystallinity (R) |
| Emb. 9 | 87.9 | 0.20 | 19 | ○ | 20 | 15 | 2.8 |
| Emb. 10 | 88.2 | 0.23 | 20 | ○ | 30 | 15 | 2.8 |
| Emb. 11 | 88.1 | 0.22 | 18 | ○ | 25 | 20 | 2.8 |
| Emb. 12 | 87.6 | 0.25 | 22 | ○ | 40 | 35 | 2.8 |
| Emb. 13 | 88.0 | 0.22 | 15 | ○ | 35 | 20 | 2.8 |
| Emb. 14 | 88.5 | 0.24 | 22 | ○ | 20 | 25 | 2.8 |
| Emb. 15 | 89.0 | 0.23 | 21 | ○ | 25 | 35 | 2.8 |
| Emb. 16 | 88.3 | 0.21 | 19 | ○ | 30 | 30 | 2.8 |
| Emb. 17 | 87.4 | 0.21 | 16 | ○ | 30 | 20 | 2.8 |
| Emb. 18 | 87.8 | 0.23 | 19 | Δ | 35 | 30 | 4.1 |
| Emb. 19 | 87.9 | 0.25 | 24 | Δ | 40 | 35 | 6.5 |
| Comp. Ex. 7 | 82.4 | 0.43 | 39 | X | 65 | 45 | 7.8 |
| Comp. Ex. 8 | 81.5 | 0.45 | 39 | X | 75 | 45 | 9.0 |
| Comp. Ex. 9 | 81.8 | 0.45 | 41 | X | 75 | 50 | 13.7 |
| Comp. Ex. 10 | 84.7 | 0.86 | 73 | X | 35 | 85 | 16.3 |
| Comp. Ex. 11 | 85.3 | 0.28 | 32 | Δ | 90 | 50 | 14.7 |

Table entry in the 'Initial Image' row,
○: excellent,
Δ: good,
X: no good.

As can be seen from the results of the above Table 3 and Table 4, electrophotography photosensitive bodies of Embodiments 1~19, which use a charge transport substance and use as a charge generating substance a titanyl phthalocyanine with a crystallinity (R) of 7.0 or less, have a higher sensitivity compared to electrophotography photosensitive bodies of the comparative examples that had a crystallinity (R) of greater than 7.0 and comparative examples that did not use a charge transport substance. Furthermore, the electric potential fluctuations delta V0 and delta V1 were stable after printing 5000 pages, and it was clear that they had excellent repeat quality.

As described above, according to the present invention, with an electrophotography photosensitive body having a single layer photosensitive layer on top of a conductive substrate directly or via an undercoat layer, and the single layer photosensitive layer containing at least a resin binder, a charge generating substance, and a charge transport substance, at least one of the charge generating substances is a titanyl phthalocyanine, in which in a x-ray powder diffraction spectrum having a radiation source of CuK α, the crystallinity as defined by the ratio of the intensity of the highest peak and the intensity of the background is below 7.0, and more preferably below 3.0. As a result, an electrophotography photosensitive body having excellent sensitivity and repeat stability can be obtained. Furthermore, these photosensitive bodies are useful in electrophotography devices such as printers, copiers, faxes and the like which use an electrophotography system.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotography photosensitive body comprising:

a conductive substrate;

a single layer photosensitive layer on said conductive substrate;

an optional undercoat layer between said conductive substrate and said photosensitive layer;

said single layer photosensitive layer including at least a resin binder, at least one charge generating substance, and at least one charge transport substance;

at least one of said at least one charge generating substance is a titanyl phthalocyanine;

said titanyl phthalocyanine, having a maximum peak within the Bragg angle 2θ=7.2°, in an x-ray powder diffraction spectrum having a radiation source of CuK α and within a range of a Bragg angle 2θ=5–35°, a ratio R satisfies the equation $$R=(P-B)/B\leqq 3.0$$

wherein P is the value of the diffraction intensity of a highest peak and B is a value of a diffraction intensity of a line that connects troughs on either side of said highest peak.

2. An electrophotography photosensitive body as described in claim 1 wherein said charge transport substance is a hole transport substance.

3. An electrophotography photosensitive body as described in claim 2, wherein:

said hole transport substance includes a compound having a construction represented by at least one of the following formula (HT1)

(HT1)

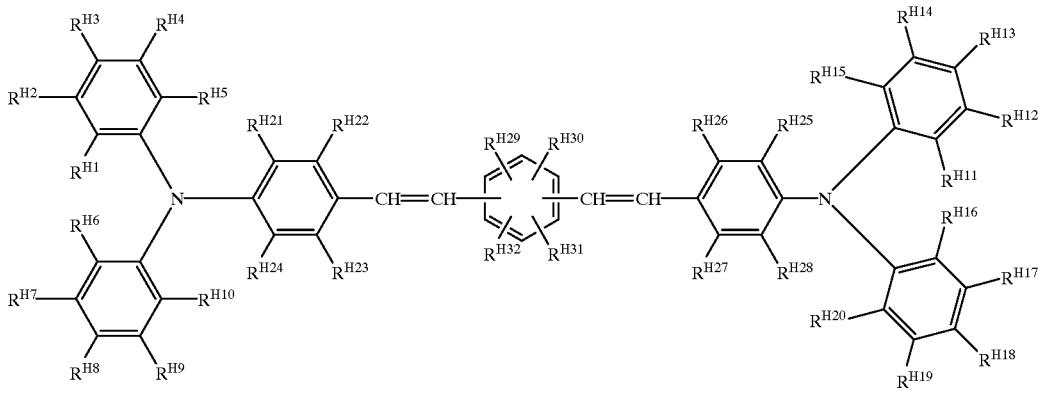

wherein $R^{H1}$–$R^{H32}$ are independently selected from the group consisting of a hydrogen atom, a $C_1$–$C_6$ alkyl group, and a $C_1$–$C_6$ alkoxy group.

4. An electrophotography photosensitive body as described in claim 2, wherein:

said hole transport substance includes a compound having a construction represented by at least one of the following formula (HT2)

(HT2)

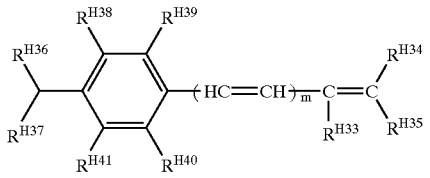

wherein $R^{H33}$ represents a hydrogen atom or a $C_1$–$C_6$ alkyl group, $R^{H34}$ and $R^{H35}$ are each independently selected from the group consisting of a hydrogen atom, a $C_1$–$C_6$ alkyl group, a $C_1$–$C_6$ alkoxy group, an optionally substituted aryl group, and, taken together, $R^{H34}$ and $R^{H35}$ may optionally form a ring by directly bonding or bonding via an oxygen atom, sulfur atom, or a carbon chain, $R^{H36}$ and $R^{H37}$ are independently selected from the group consisting of a $C_1$–$C_{12}$ alkyl group, an optionally substituted $C_3$–$C_{12}$ cycloalkyl group, an optionally substituted aryl group, and an optionally substituted aralkyl group, $R^{H38}$–$R^{H41}$ are independently selected from the group consisting of a hydrogen atom, a $C_1$–$C_6$ alkyl group, a $C_1$–$C_6$ alkoxy group, an optionally substituted aryl group and, taken together, two of more of $R^{H36}$–$R^{H41}$ groups can be bonded directly or via an oxygen atom, sulfur atom, or carbon chain to form a ring, m represents a 0 or 1, and each of said substitution group is independently selected from the group consisting of a halogen atom, a $C_1$–$C_6$ alkyl group, a $C_1$–$C_6$ alkoxy group, an optionally substituted aryl group, an optionally substituted aryl alkoxy group, a hydroxyl group, a cyano group, an amino group, a nitro group, a halogenated alkyl group, an alkyl substituted amino group, and an aryl substituted amino group, wherein two or more of said substitution groups can be bonded directly or bonded via an oxygen atom, sulfur atom, or carbon chain to form a ring.

5. An electrophotography photosensitive body as described in claim 2, wherein:

said hole transport substance includes a compound having a construction represented by at least one of the following formula (HT3)

(HT3)

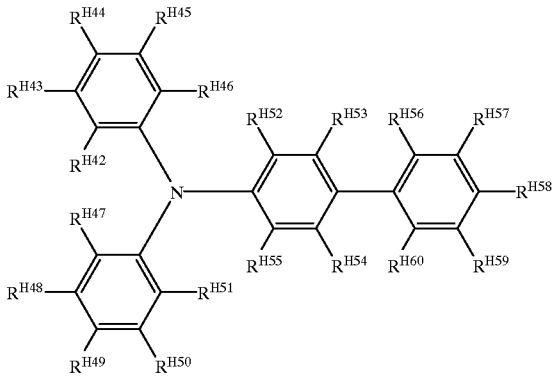

wherein $R^{H42}$–$R^{H60}$ are independently selected from the group consisting of a hydrogen atom, a halogen atom, a $C_1$–$C_{12}$ alkyl group, a $C_1$–$C_{12}$ alkoxy group, an alkyl substituted amino group, an optionally substituted aryl group, and, taken together, two or more $R^{H42}$–$R^{H60}$ groups can be bonded directly or via an oxygen atom, sulfur atom, or a carbon chain to form a ring, wherein each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group, wherein two or more of said substitution groups are optionally bonded directly or via an oxygen atom, a sulfur atom, or a carbon chain to form a ring.

6. An electrophotography photosensitive body as described in claim 2, wherein:

said hole transport substance includes a compound having a construction represented by at least one of the following formula (HT4)

(HT4)

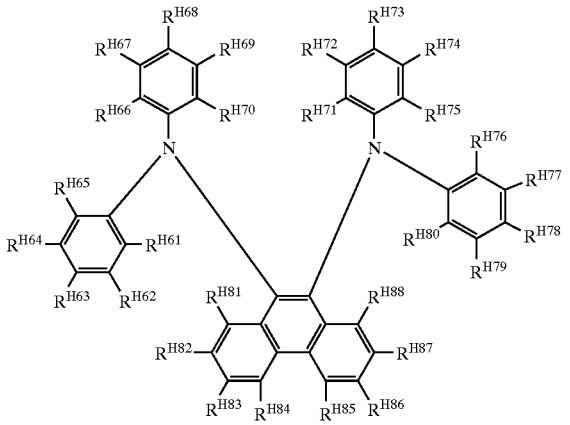

wherein $R^{H61}$–$R^{H88}$ are independently selected from the group consisting of a hydrogen atom, a halogen atom, a $C_1$–$C_{12}$ alkyl group, a $C_1$–$C_{12}$ alkoxy group, and an optionally substituted aryl group, wherein said substitution group is selected from the group consisting of a halogen atom, a $C_1$–$C_6$ alkyl group, a $C_1$–$C_6$ alkoxy group, and an aryl group.

7. An electrophotography photosensitive body as described in claim 1 wherein said charge transport substance includes both a hole transport substance and an electron transport substance.

8. An electrophotography photosensitive body as described in claim 7, wherein:

said hole transport substance includes a compound having a construction represented by at least one of the following formula (HT1)

(HT1)

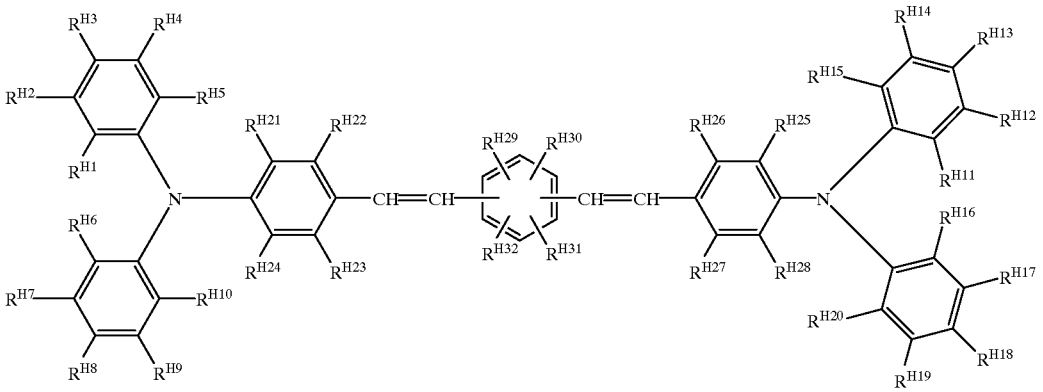

wherein $R^{H1}$–$R^{H32}$ are independently selected from the group consisting of a hydrogen atom, a $C_1$–$C_6$ alkyl group, and a $C_1$–$C_6$ alkoxy group.

9. An electrophotography photosensitive body as described in claim 7, wherein:

said hole transport substance includes a compound having a construction represented by at least one of the following formula (HT2)

(HT2)

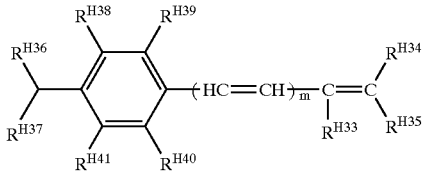

wherein $R^{H33}$ represents a hydrogen atom or a $C_1$–$C_6$ alkyl group, $R^{H34}$ and $R^{H35}$ are each independently selected from the group consisting of a hydrogen atom, a $C_1$–$C_6$ alkyl group, a $C_1$–$C_6$ alkoxy group, an optionally substituted aryl group, and, taken together, $R^{H34}$ and $R^{H35}$ may optionally form a ring by directly bonding or bonding via an oxygen atom, sulfur atom, or a carbon chain, $R^{H36}$ and $R^{H37}$ are independently selected from the group consisting of a $C_1$–$C_{12}$ alkyl group, an optionally substituted $C_3$–$C_{12}$ cycloalkyl group, an optionally substituted aryl group, and an optionally substituted aralkyl group, $R^{H38}$–$R^{H41}$ are independently selected from the group consisting of a hydrogen atom, a $C_1$–$C_6$ alkyl group, a $C_1$–$C_6$ alkoxy group, an optionally substituted aryl group and, taken together, two of more of $R^{H36}$–$R^{H41}$ groups can be bonded directly or via an oxygen atom, sulfur atom, or carbon chain to form a ring, m represents a 0 or 1, and each of said substitution group is independently selected from the group consisting of a halogen atom, a $C_1$–$C_6$ alkyl group, a $C_1$–$C_6$ alkoxy group, an optionally substituted aryl group, an optionally substituted aryl alkoxy group, a hydroxyl group, a cyano group, an amino group, a nitro group, a halogenated alkyl group, an alkyl substituted amino group, and an aryl substituted amino group, wherein two or more of said substitution groups can be bonded directly or bonded via an oxygen atom, sulfur atom, or carbon chain to form a ring.

10. An electrophotography photosensitive body as described in claim 7, wherein:

said hole transport substance includes a compound having a construction represented by at least one of the following formula (HT3)

(HT3)

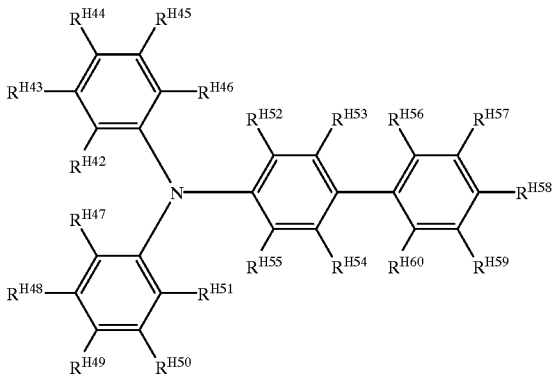

wherein $R^{H42}$–$R^{H60}$ are independently selected from the group consisting of a hydrogen atom, a halogen atom, a $C_1$–$C_{12}$ alkyl group, a $C_1$–$C_{12}$ alkoxy group, an alkyl substituted amino group, an optionally substituted aryl group, and, taken together, two or more $R^{H42}$–$R^{H60}$ groups can be bonded directly or via an oxygen atom, sulfur atom, or a carbon chain to form a ring, wherein each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group, wherein two or more of said substitution groups are optionally bonded directly or via an oxygen atom, a sulfur atom, or a carbon chain to form a ring.

11. An electrophotography photosensitive body as described in claim 7, wherein:

said hole transport substance includes a compound having a construction represented by at least one of the following formula (HT4)

(HT4)

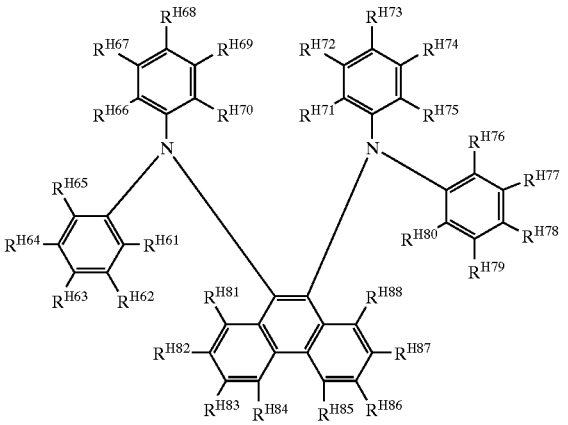

wherein $R^{H61}$–$R^{H88}$ are independently selected from the group consisting of a hydrogen atom, a halogen atom, a $C_1$–$C_{12}$ alkyl group, a $C_1$–$C_{12}$ alkoxy group, and an optionally substituted aryl group, wherein said substitution group is selected from the group consisting of a halogen atom, a $C_1$–$C_6$ alkyl group, a $C_1$–$C_6$ alkoxy group, and an aryl group.

12. An electrophotography photosensitive body as described in claim 4, wherein:

said electron transport substance includes a compound having a construction represented by at least one of the following general formulas (ET1)

(ET1)

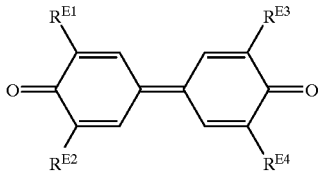

wherein $R^{E1}$–$R^{E4}$ are each independently selected from the group consisting of a hydrogen atom, a $C_1$–$C_{12}$ alkyl group, a $C_1$–$C_{12}$ alkoxy group, an optionally substituted aryl group, a cycloalkyl group, an optionally substituted aralkyl group, and a halogenated alkyl group, wherein each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group.

13. An electrophotography photosensitive body as described in claim 7, wherein:

said electron transport substance includes a compound having a construction represented by at least one of the following general formulas (ET2)

(ET2)

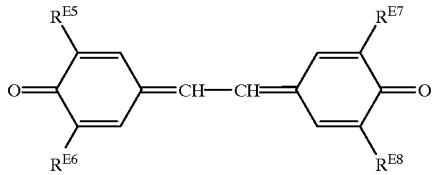

wherein $R^{E5}$–$R^{E8}$ are each independently selected from the group consisting of a hydrogen atom, a $C_1$–$C_{12}$ alkyl group, a $C_1$–$C_{12}$ alkoxy group, an optionally substituted aryl group, a cycloalkyl group, an optionally substituted aralkyl group, and a halogenated alkyl group, wherein each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group.

14. An electrophotography photosensitive body as described in claim 7, wherein:

said electron transport substance includes a compound having a construction represented by at least one of the following general formulas (ET3)

(ET3)

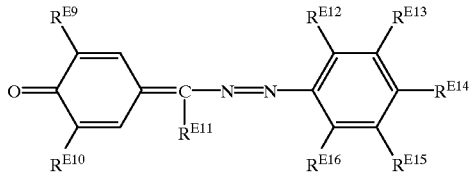

wherein $R^{E9}$ and $R^{E10}$ are independently selected from the group consisting of a hydrogen atom, a $C_1$–$C_{12}$ alkyl group, a $C_1$–$C_{12}$ alkoxy group, an optionally substituted aryl group, a cycloalkyl group, an optionally substituted aralkyl group, and a halogenated alkyl group, $R^{E11}$ is selected from the group consisting of a hydrogen atom, a $C_1$–$C_6$ alkyl group, a $C_1$–$C_6$ alkoxy group, an optionally substituted aryl group, a cycloalkyl group, an optionally substituted aralkyl group, and a halogenated alkyl group, $R^{E12}$–$R^{E16}$ are each independently selected from the group consisting of a hydrogen atom, a halogen atom, a $C_1$–$C_{12}$ alkyl group, a $C_1$–$C_{12}$ alkoxy, an optionally substituted aryl group, an optionally substituted aralkyl group, an optionally substituted phenoxy group, a halogenated alkyl group, a cyano group, and a nitro group, wherein two or more of these groups can be bonded to form a ring, and each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group.

15. An electrophotography photosensitive body as described in claim 7, wherein:

said electron transport substance includes a compound having a construction represented by at least one of the following general formulas (ET4)

(ET4)

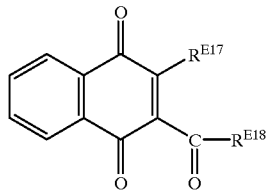

wherein $R^{E17}$ is selected from the group consisting of an optionally substituted alkyl group and an optionally substituted aryl group, $E^{E18}$ is selected from the group consisting of an optionally substituted alkyl group, an optionally substituted aryl group, and a group represented by a following formula (ET4a), $$—O—R^{E19} \quad \text{(ET4a)}$$

wherein $R^{E19}$ is selected from the group consisting of an optionally substituted alkyl group and an optionally substituted aryl group, wherein each of said substitution group in formulas (ET4) and (ET4a) are independently selected from the group consisting of a halogen atom, a $C_1$–$C_6$ alkyl group, a $C_1$–$C_6$ alkoxy group, an aryl group, a hydroxyl group, a cyano group, an amino group, a nitro group, and a halogenated alkyl group.

16. An electrophotography photosensitive body as described in claim 7, wherein:

said hole transport substance includes a compound having a construction represented by at least one of the following formula (HT1)

(HT1)

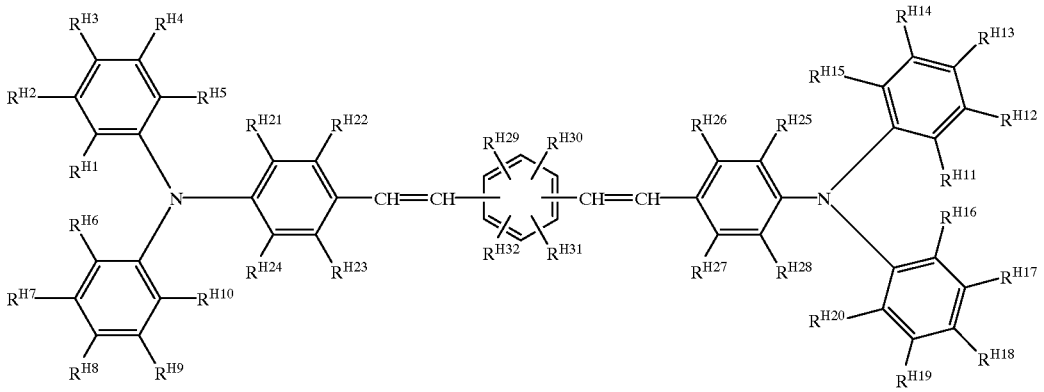

wherein $R^{H1}$–$R^{H32}$ are independently selected from the group consisting of a hydrogen atom, a $C_1$–$C_6$ alkyl group, and a $C_1$–$C_6$ alkoxy group; and said electron transport substance includes a compound having a construction represented by at least one of the following general formulas (ET3)

(ET3)

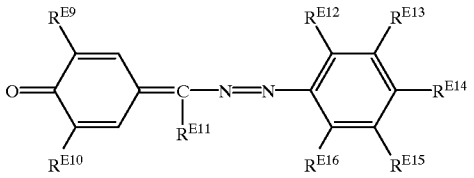

wherein $E^{E9}$ and $E^{E10}$ are independently selected from the group consisting of a hydrogen atom, a $C_1$–$C_{12}$ alkyl group, a $C_1$–$C_{12}$ alkoxy group, an optionally substituted aryl group, a cycloalkyl group, an optionally substituted aralkyl group, and a halogenated alkyl group, $E^{E11}$ is selected from the group consisting of a hydrogen atom, a $C_1$–$C_6$ alkyl group, a $C_1$–$C_6$ alkoxy group, an optionally substituted aryl group, a cycloalkyl group, an optionally substituted aralkyl group, and a halogenated alkyl group, $E^{E12}$–$E^{E16}$ are each independently selected from the group consisting of a hydrogen atom, a halogen atom, a $C_1$–$C_{12}$ alkyl group, a $C_1$–$C_{12}$ alkoxy, an optionally substituted aryl group, an optionally substituted aralkyl group, an optionally substituted phenoxy group, a halogenated alkyl group, a cyano group, and a nitro group, wherein two or more of these groups can be bonded to form a ring, and each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group.

17. An electrophotography photosensitive body as described in claim 7, wherein:

said hole transport substance includes a compound having a construction represented by at least one of the following formula (HT2)

(HT2)

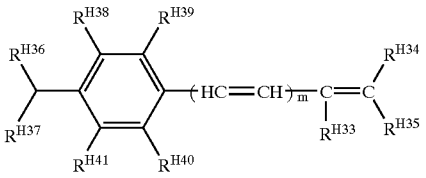

wherein $R^{H33}$ represents a hydrogen atom or a $C_1$–$C_6$ alkyl group, $R^{H34}$ and $R^{H35}$ are each independently selected from the group consisting of a hydrogen atom, a $C_1$–$C_6$ alkyl group, a $C_1$–$C_6$ alkoxy group, an optionally substituted aryl group, and, taken together, $R^{H34}$ and $R^{H35}$ may optionally form a ring by directly bonding or bonding via an oxygen atom, sulfur atom, or a carbon chain, $R^{H36}$ and $R^{H37}$ are independently selected from the group consisting of a $C_1$–$C_{12}$ alkyl group, an optionally substituted $C_3$–$C_{12}$ cycloalkyl group, an optionally substituted aryl group, and an optionally substituted aralkyl group, $R^{H38}$–$R^{H41}$ are independently selected from the group consisting of a hydrogen atom, a $C_1$–$C_6$ alkyl group, a $C_1$–$C_6$ alkoxy group, an optionally substituted aryl group and, taken together, two of more of $R^{H36}$–$R^{H41}$ groups can be bonded directly or via an oxygen atom, sulfur atom, or carbon chain to form a ring, m represents a 0 or 1, and each of said substitution group is independently selected from the group consisting of a halogen atom, a $C_1$–$C_6$ alkyl group, a $C_1$–$C_6$ alkoxy group, an optionally substituted aryl group, an optionally substituted aryl alkoxy group, a hydroxyl group, a cyano group, an amino group, a nitro group, a halogenated alkyl group, an alkyl substituted amino group, and an aryl substituted amino group, wherein two or more of said substitution groups can be bonded directly or bonded via an oxygen atom, sulfur atom, or carbon chain to form a ring; and said electron transport substance includes a compound having a construction represented by at least one of the following general formulas (ET3)

(ET3)

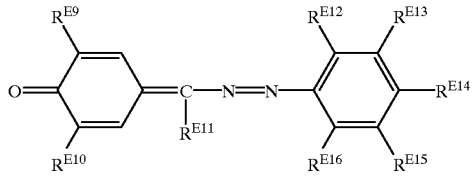

wherein $R^{E9}$ and $R^{E10}$ are independently selected from the group consisting of a hydrogen atom, a $C_1$–$C_{12}$ alkyl group, a $C_1$–$C_{12}$ alkoxy group, an optionally substituted aryl group, a cycloalkyl group, an optionally substituted aralkyl group, and a halogenated alkyl group, $R^{E11}$ is selected from the group consisting of a hydrogen atom, a $C_1$–$C_6$ alkyl group, a $C_1$–$C_6$ alkoxy group, an optionally substituted aryl group, a cycloalkyl group, an optionally substituted aralkyl group, and a halogenated alkyl group, $R^{E12}$–$R^{E16}$ are each independently selected from the group consisting of a hydrogen atom, a halogen atom, a $C_1$–$C_{12}$ alkyl group, a $C_1$–$C_{12}$ alkoxy, an optionally substituted aryl group, an optionally substituted aralkyl group, an optionally substituted phenoxy group, a halogenated alkyl group, a cyano group, and a nitro group, wherein two or more of these groups can be bonded to form a ring, and each of said substitution group is independently selected from the group consisting of a halogen atom, a $C_1$–$C_6$ alkyl group, a $C_1$–$C_6$ alkoxy group, a hydroxyl group, a cyano group, an amino group, a nitro group, and a halogenated alkyl group.

* * * * *